US007568688B2

(12) United States Patent
Nomura et al.

(10) Patent No.: US 7,568,688 B2
(45) Date of Patent: Aug. 4, 2009

(54) SHEET ALIGNMENT DEVICE, SHEET FINISHING APPARATUS INCLUDING THE SAME, AND IMAGE PROCESSING SYSTEM INCLUDING THE SAME

(75) Inventors: Tomoichi Nomura, Aichi (JP); Hiroshi Maeda, Aichi (JP); Masahiro Tamura, Tokyo (JP); Nobuyoshi Suzuki, Tokyo (JP); Shuuya Nagasako, Kanagawa (JP); Kazuhiro Kobayashi, Kanagawa (JP); Shohichi Satoh, Kanagawa (JP); Akira Kunieda, Tokyo (JP); Hitoshi Hattori, Tokyo (JP); Makoto Hidaka, Tokyo (JP); Ichiro Ichihashi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 87 days.

(21) Appl. No.: 11/774,595

(22) Filed: Jul. 7, 2007

(65) Prior Publication Data

US 2008/0006993 A1 Jan. 10, 2008

(30) Foreign Application Priority Data

Jul. 7, 2006 (JP) ..... 2006-188169

(51) Int. Cl.
*B65H 39/02* (2006.01)

(52) U.S. Cl. ..... 270/58.12; 270/58.08; 271/221; 271/207

(58) Field of Classification Search ..... 271/207, 271/241, 22; 270/58.08, 58.11, 58.12, 58.13
See application file for complete search history.

(56) References Cited

U.S. PATENT DOCUMENTS 6,231,039 B1 * 5/2001 Chung ..... 270/58.01
6,698,744 B2 * 3/2004 Yamada et al. ..... 270/58.12
6,871,851 B2 * 3/2005 Tamura et al. ..... 271/221
7,055,815 B2 * 6/2006 Sato et al. ..... 270/58.11
7,300,052 B2 * 11/2007 Tamura et al. ..... 271/221
2002/0079642 A1 * 6/2002 Tamura et al. ..... 271/207
2002/0163120 A1 * 11/2002 Yamada et al. ..... 271/221
2004/0104529 A1 * 6/2004 Sato et al. ..... 271/226
2005/0189706 A1 * 9/2005 Tamura et al. ..... 271/221
2006/0261544 A1 11/2006 Tamura
2007/0007718 A1 * 1/2007 Sato et al. ..... 271/226

(Continued)

FOREIGN PATENT DOCUMENTS

JP 61-059252 4/1986

(Continued)

*Primary Examiner*—Kaitlin S Joerger
(74) *Attorney, Agent, or Firm*—Harness Dickey & Pierce

(57) ABSTRACT

A sheet alignment device, that is included in a sheet finishing apparatus integrally mounted with an image forming apparatus to an image forming system or connected to the image forming apparatus, includes an accommodating unit configured to temporarily accommodate a paper sheet and a paper sheet stack including the paper sheet therein, and a sheet alignment unit configured to align the sheet stack including the paper sheet in a direction perpendicular to a sheet travel direction. The sheet alignment unit has a first alignment member configured to move between a sheet receiving position and a sheet alignment position along the direction perpendicular to the sheet travel direction so as to push the sheet stack and a second alignment member configured to move to a fixed position and remain stationary thereat so as to stop the sheet stack pushed by the first alignment member.

19 Claims, 43 Drawing Sheets

U.S. PATENT DOCUMENTS

2007/0051219 A1 3/2007 Tamura

FOREIGN PATENT DOCUMENTS

JP 08-133561 5/1996
JP 08-169623 7/1996
JP 11-322181 11/1999
JP 2000-219418 8/2000
JP 2002-265125 9/2002
JP 2005-029299 2/2005

* cited by examiner

SHEET ALIGNMENT DEVICE, SHEET FINISHING APPARATUS INCLUDING THE SAME, AND IMAGE PROCESSING SYSTEM INCLUDING THE SAME

PRIORITY STATEMENT

The present patent application claims priority under 35 U.S.C. §119 upon Japanese patent application No. 2006-188169 filed on Jul. 7, 2006, in the Japan Patent Office, the entire contents and disclosures of which are hereby incorporated herein by reference herein in their entirety.

BACKGROUND

1. Technical Field

Example embodiments of the present invention generally relate to a sheet alignment device, and/or a sheet processing apparatus including the sheet alignment device, and/or an image processing system including an image forming apparatus connected to or integrally mounted with the sheet processing apparatus including the sheet alignment device. More particularly, the present invention relates to a sheet alignment device that aligns sheet-type recording media, and/or a sheet finishing apparatus that includes such a sheet alignment device and executes operations such as sorting, stacking, binding or stapling, folding, punching, and the like with respect to the recording media, and/or an image processing system including an image forming apparatus integrally mounted with or connected to the sheet finishing apparatus including the sheet alignment device.

2. Discussion of the Related Art

Sheet processing is executed for aligning paper sheets in both a sheet travel direction and a direction perpendicular to the sheet travel direction. When aligning paper sheets in the direction perpendicular to the sheet travel direction, which is hereinafter referred to as a "sheet width direction", a pair of alignment members is used. One of such pairs of alignment members is generally called as "jogger fences."

In one technique of sheet alignment, a related art sheet finishing apparatus includes a processing tray to temporarily stack discharged paper sheets to reduce a moment load applied to alignment members, a pair of discharging rollers to discharge the paper sheets onto the processing tray, and a pair of alignment members disposed at both sides of paper sheet in the sheet width direction to align the paper sheets on the processing tray along the sheet width direction. At least one of the pair of alignment members is flexibly movable in the sheet width direction. With the above-described structure, the pair of alignment members of the related art sheet finishing apparatus form respective protruding portions on alignment surfaces of the pair of alignment members facing each other so as to overlap in a position of a sheet discharging direction.

In a different technique of sheet alignment, to neatly align paper sheet regardless of a reference position during sheet conveyance, sheet size, and the like, a tamper is movably arranged to face a lateral reference wall is provided with a lever. With the lever on the tamper, paper sheets can be aligned while lifting the end part at the tamper side of a newly supplied paper sheet. Accordingly, the end part of the newly supplied paper sheet is caught between the paper sheet that is already aligned and the tamper, and is folded to cause a situation of sheet alignment error.

In a further different technique of sheet alignment, a related art sheet finishing apparatus includes a sheet handling device that can prevent the overlap of the bound positions of stapled sheet stacks on a sheet discharging tray. Specifically, the conveyed sheets are placed on a stacking tray and adjusted by an adjusting plate and a shutter. After binding a sheet stack by a stapler, the sheet stack is discharged and placed on the sheet discharging tray by a pair of discharging rollers. Each bound position of each sheet stack on the sheet discharging tray is displaced by a displacing unit so as not to overlap each other. Accordingly, the related art sheet finishing apparatus can prevent a sheet stacking failure caused by the overlap of the binding positions.

When binding or stapling the end portions of a sheet stack, related art sheet finishing apparatuses generally execute a sheet alignment in a sheet width direction with a pair of alignment members operating at the same time. With such a structure, however, both side ends of sheet stack cannot be properly aligned. Specifically, since sheet stack has variations of distance in the sheet width direction, when the pair of alignment members pushes both end sides of the sheet stack, the sheet stack may be tossed to undetermined side and may keep non-uniform surface of the end sides thereof.

To eliminate the drawback, the above-described technique in which one of the pair of alignment members moves to align sheet stack and the other one of the pair of alignment members is fixed at a given position on one side of the tray to stop the sheet stack pushed by the opposite alignment member. With the above-described structure, however, the side end of the sheet stack that is pushed to the stopping alignment member may not sufficiently be aligned. In addition, when one of the pair of alignment members is completely fixed at and cannot move from a sheet receiving position, the other alignment member, which is a movable alignment member, may need to move by a greater of distance along the sheet width direction, which can result in a requirement of a longer operation period.

SUMMARY

One or more embodiments of the present invention has been made, taking the above-mentioned circumstances into consideration.

An embodiment of the present invention provides an accommodating unit configured to temporarily accommodate a paper sheet and a paper sheet stack including the paper sheet therein, and a sheet alignment unit configured to align the sheet stack including the paper sheet in a direction perpendicular to a sheet travel direction. The sheet alignment unit has a first alignment member configured to move between a sheet receiving position and a sheet alignment position along the direction perpendicular to the sheet travel direction so as to push the sheet stack and a second alignment member configured to move to a fixed position and remain stationary so as to stop the sheet stack pushed by the first alignment member.

The above-described sheet alignment device may further include a control unit configured to control to set an arbitrary reference side for the sheet alignment operation, in which the first alignment member may be set to the reference side.

At least one embodiment of the present invention provides a sheet finishing apparatus that includes the above-described sheet alignment device.

The above-described sheet finishing apparatus may further include a sheet binding unit configured to bind the sheet stack, in which the sheet stack may be processed at a first position arranged by the first alignment member to be closer to the second alignment member from a center portion of the sheet stack stored in the accommodating unit.

The above-described sheet finishing apparatus may further include a discharging unit configured to discharge the sheet stack bound by the sheet binding unit from the accommodating unit, in which the first and second alignment members may move the bound sheet stack from a first position arranged by the first alignment member to be closer to the second alignment member from a center portion of the sheet stack stored in the accommodating unit, to a second position in the vicinity of the center portion so that the discharging unit discharges the sheet stack therefrom.

The above-described sheet finishing apparatus may further include a discharging unit configured to discharge the sheet stack bound by the sheet binding unit from the accommodating unit, in which the bound sheet stack may be discharged from the first position.

The above-described sheet finishing apparatus may further include a discharging unit configured to discharge the sheet stack bound by the sheet binding unit from the accommodating unit, in which the control unit may select, according to a given condition, one of a first mode to cause the first and second alignment members to move the bound sheet stack from the first position to a second position in the vicinity of the center portion so that the discharging unit discharges the sheet stack therefrom and a second mode to discharge the bound sheet stack from the first position.

The above-described sheet finishing apparatus may further include a discharging unit configured to discharge the sheet stack bound by the sheet binding unit from the accommodating unit, in which the bound sheet stack may be conveyed from the first position when the sheet stack satisfies the given condition.

At least one embodiment of the present invention provides an image processing system that includes an image forming apparatus connected to or integrally provided therein with the above-described sheet finishing apparatus including the above-described sheet alignment device.

Additional features and advantages of the present invention will be more fully apparent from the following detailed description of example embodiments, the accompanying drawings and the associated claims.

BRIEF DESCRIPTION OF THE DRAWINGS

The accompanying drawings are intended to depict example embodiments of the present invention and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
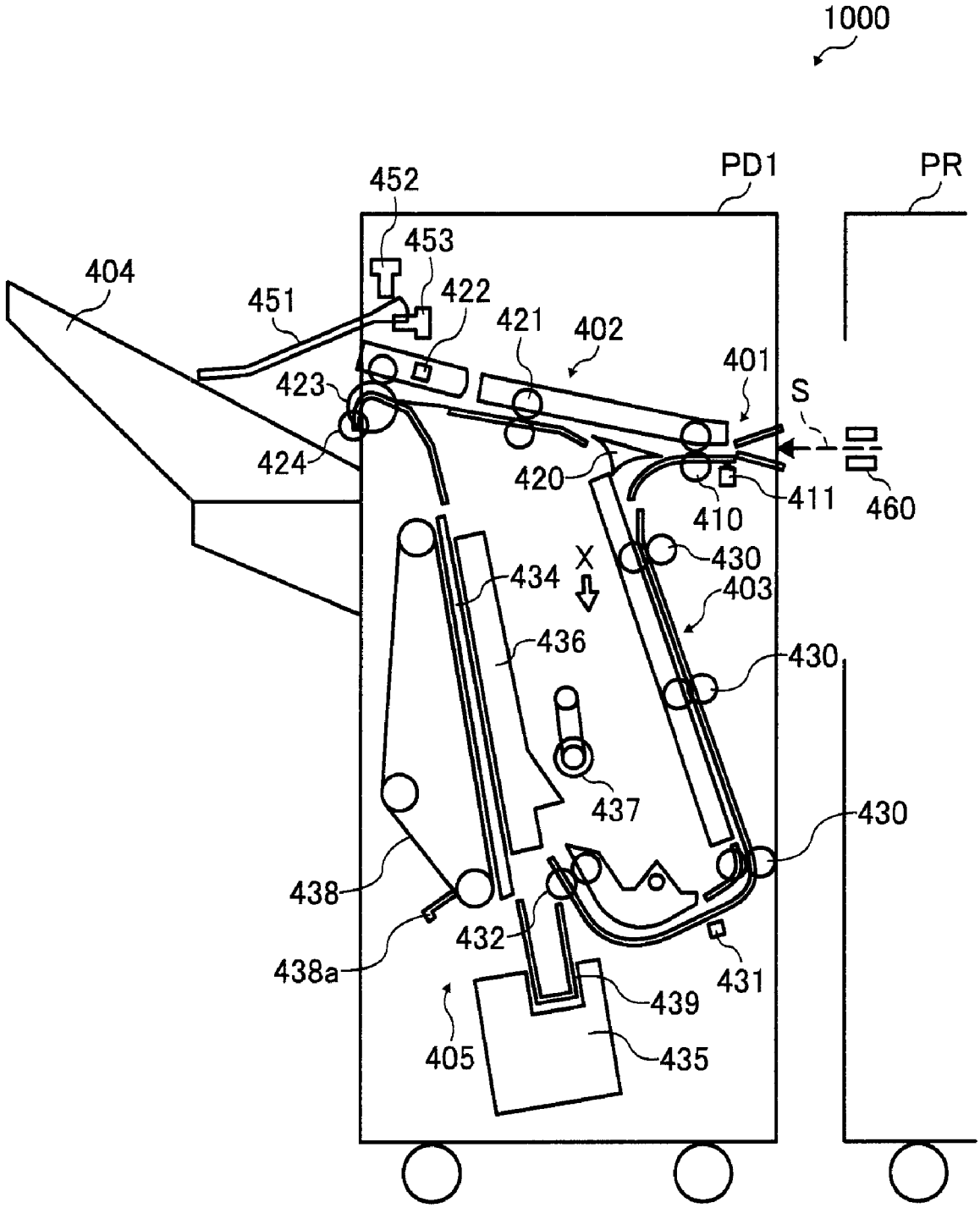
FIG. 1 is a schematic configuration of a sheet finishing apparatus, according to an example embodiment of the present invention, included in an image processing system according to an example embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above" "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present invention are described.

It should be noted that an accommodating unit mainly corresponds to a staple tray 434 and/or an end face binding processing tray F, an alignment unit mainly corresponds to a jogger 436 and/or jogger fences 53, an alignment member mainly correspond to first and second jogger fences 436*a* and 436*b* and/or first and second jogger fences 53*a* and 53*b*, a flexible or reference jogger fence mainly corresponds to the first jogger fence 436*a* and/or 53*a*, a stopping or non-reference jogger fence mainly corresponds to the second jogger fence 436*b* and/or 53*b*, a control unit mainly corresponds to a central processing unit or CPU 360, a sheet binding unit mainly corresponds to an end face binding stapler S1, and a sheet discharging unit mainly corresponds to a discharge belt 52 and a hook 52*a* (52*a*'). The CPU 360 controls each component.

Now, example embodiments of the present invention are described in detail below with reference to the accompanying drawings.

Referring to FIG. 1, a schematic structure of an image processing system 1000 according to an example embodiment of the present invention.

The image processing system 1000 includes a sheet finishing apparatus PD1 and an image forming apparatus PR.

The image forming apparatus PR of the image processing system 1000 of FIG. 1 may form an image on a surface of a sheet S of a printable medium, e.g., paper. Typically, but not necessarily, the medium is paper. Other printable media is available in sheets and their use here is included. For simplicity, the remaining description refers to a "paper sheet" or "paper sheets." It should be understood, however, that the sheets are not limited only to being paper. The image forming apparatus PR may convey the paper sheet S via a sheet outlet portion to the sheet finishing apparatus PD1. The image forming apparatus PR includes a sheet outlet portion 460 from which a paper sheet S that serves as a recording medium may be discharged.

The sheet finishing apparatus PD1 of FIG. 1 is connected to the image forming apparatus PR and includes a sheet inlet path 401 to which the paper sheet S is conveyed from the sheet outlet portion 460 of the image forming apparatus PR.

The sheet inlet path 401 includes a pair of inlet rollers 410, an inlet sensor 411, and a path separator 420.

When the paper sheet S is conveyed from the sheet outlet portion 460, the inlet sensor 411 may detect the paper sheet S and the pair of inlet rollers 410 may convey the paper sheet S toward the path separator 420.

One end of the path separator 420 may be swingably disposed, and the other end may be arranged in the vicinity of the sheet outlet portion 460 of the image forming apparatus PR.

The path separator 420 may guide the paper sheet S to one of two sheet conveying paths.

The two sheet conveying paths may branch from the sheet inlet path 401 into an upper sheet conveying path 402, and a lower sheet conveying path 403.

The upper sheet conveying path 402 may guide the paper sheet S to a sheet discharging tray 404. The lower sheet conveying path 403 may guide the paper sheet S to a stapler unit 405 in which a sheet binding or stapling operation is performed to bind or staple paper sheets stacked therein together.

The sheet discharging tray 404 may have a tray elevating mechanism. When the image forming apparatus PR of the image processing system 1000 starts an image forming operation, the sheet discharging tray 404 is elevated up to a given height. When a plurality of the paper sheets S are stacked on the sheet discharging tray 404 up to a height of "full of paper sheets" or a paper sheet full state, a controller (not shown) may cause the image forming apparatus PR to stop the image forming operation.

The upper sheet conveying path 402 may include a pair of sheet conveying rollers 421, a sheet discharging sensor 422, a pair of sheet discharging rollers 423, a guide roller 424, a filler 451, and upper and lower sheet surface detection sensors 452 and 453.

The pair of sheet conveying rollers 421 may convey the paper sheet S into the upper sheet conveying path 402.

The sheet discharging sensor 422 is disposed in the vicinity of the pair of sheet discharging rollers 423. The sheet discharging sensor 422 may detect the paper sheet S when the paper sheet S passes a given position.

The paper sheet S may be then discharged by the pair of sheet discharging rollers 423 and be guided by the guide roller 424 to the sheet discharging tray 404 so that the paper sheet S can be sequentially stacked into the sheet discharging tray 404.

The filler 451 may be disposed in the vicinity of and above the pair of sheet discharging rollers 423 in the upper sheet conveying path 402. One end or a movably attached end of the filler 451 may be swingably disposed above the pair of sheet discharging rollers 423. The other end or a free end of the filler 451 may be arranged to contact a top surface of the paper sheet S at its center area with respect to a sheet travel direction of the paper sheet S when the paper sheet S is conveyed to the sheet discharging tray 404.

The upper and lower sheet surface detection sensors 452 and 453 may detect a position of the free end of the filler 451, so as to detect the height of the stack of paper sheet.

The upper and lower sheet surface detection sensors 452 and 453 may be disposed in the vicinity of the movably attached end of the filler 451, which is opposite to the free end thereof, and may sandwich the pivoted end of the filler 451 therebetween.

When the movably attached end of the filler 451 is located at a substantially center portion between the upper and lower sheet surface detection sensors 452 and 453, the upper and lower sheet surface detection sensors 452 and 453 may remain in an undetected state.

As previously described, the sheet discharging tray 404 may be elevated to the given height when the image forming apparatus PR of the image processing system 1000 starts the image forming operation. At this time, the movably attached end of the filler 451 may move closer to the lower sheet surface detection sensor 453. This may once turn on the lower sheet surface detection sensor 453. That is, the state of the lower sheet surface detection sensor 453 may change from the undetected state to a detected state.

The sheet discharging tray 404 may then move down to adjust its position for receiving the paper sheet S to be discharged. This action of the sheet discharging tray 404 may turn off the lower sheet surface detection sensor 453. That is, the state of the lower sheet surface detection sensor 453 may change from the detected state to the undetected state. The position of the sheet discharging tray 404 corresponding to the timing at which the lower sheet surface detection sensor 453 turns off in the above-described operation may be set as a home position thereof for performing a regular sheet processing operation.

Along with an increase of the number or height of paper sheets S output on the sheet discharging tray 404, the lower sheet surface detection sensor 453 may turn on or may change to the detected state. On changing the state of the lower sheet surface detection sensor 453 to the detected state, a controller (not shown) of the sheet finishing apparatus PD1 may cause a drive unit (not shown) to move the sheet discharging tray 404 to a downward direction. The drive unit may move the sheet discharging tray 404 in a vertical direction according to instructions from the controller.

After the sheet discharging tray 404 has been moved to a given downward position and the lower sheet surface detection sensor 453 has been turned off or has been changed to the undetected state, the controller of the sheet finishing apparatus PD1 may cause the drive unit to stop the movement of the sheet discharging tray 404.

The controller may repeatedly cause the drive unit to adjust the position of the sheet discharging tray 404 until the height of the paper sheets S on the sheet discharging tray 404 reaches a given height indicating the paper sheet full state. When the paper sheet full state is detected in the image processing system 1000, the sheet finishing apparatus PD1 may send the image forming apparatus PR a signal to stop the image forming operation performed by the image forming apparatus PR.

The lower sheet conveying path 403 includes pairs of sheet conveying rollers 430, a sheet discharging sensor 431, and a pair of sheet discharging rollers 432.

The pairs of sheet conveying rollers 430 may sequentially convey the paper sheet S in the lower sheet conveying path 403.

The sheet discharging sensor 431 is disposed in the vicinity of the lowest one of the pairs of sheet conveying rollers 430. The sheet discharging sensor 431 may detect the paper sheet S when the paper sheet S passes a given position near the sheet discharging sensor 431.

The paper sheet S may be then discharged by the pair of sheet discharging rollers 432 to the stapler unit 405 disposed in the vicinity of an exit of the pair of sheet discharging rollers 432 in the lower sheet conveying path 403.

The stapler unit 405 includes a staple tray 434, a stapler 435, a jogger 436, a knock roller 437, a discharge belt 438, a hook 438*a*, and a trailing end fence 439.

The staple tray 434 may serve as an accommodating unit and may receive and accommodate or stack the paper sheet S therein.

The stapler 435 is disposed below the trailing end fence 439 and may bind or staple a plurality of the paper sheets S stacked and aligned in the staple tray 434. The stapler 435 may move in a width direction of the paper sheet S so as to perform a sheet binding or stapling operation. The "width direction" in at least one example embodiment of the present invention represents a direction parallel to a bottom of the sheet finishing apparatus PD1 or a horizontal direction on a surface of the paper sheet S. Further, the "sheet travel direction" described for the operations performed in the stapler unit 405 in at least one example embodiment of the present invention represents a direction to which the paper sheet S travels or is conveyed in the stapler unit 405 or a vertical direction on a surface of the paper sheet S.

Figure 4:
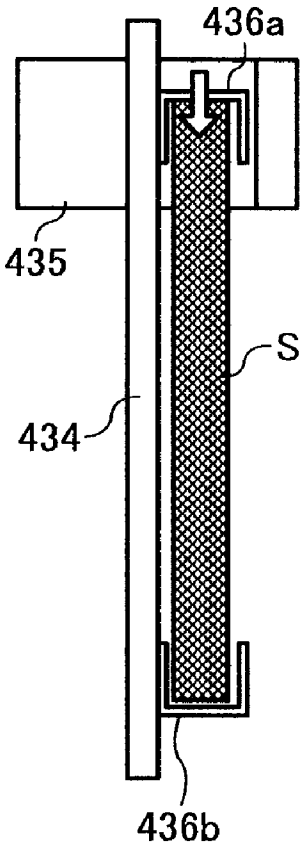
FIG. 4 is an illustration showing a third action of operations of the sheet alignment device of FIG. 2.
Figure 3:
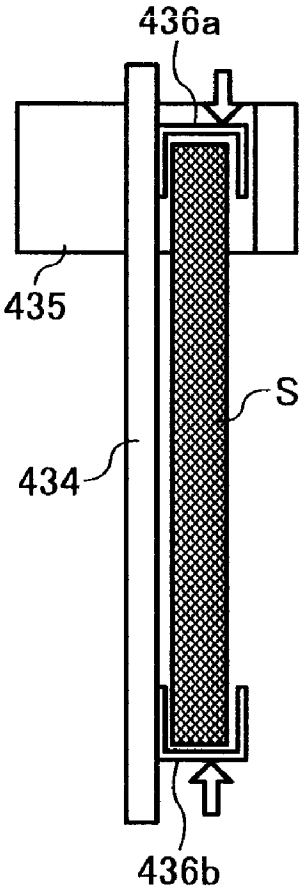
FIG. 3 is an illustration showing a second action of operations of the sheet alignment device of FIG. 2.
Figure 2:
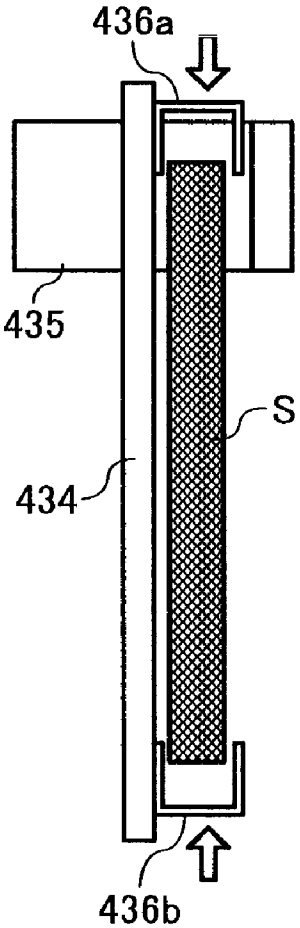
FIG. 2 is an illustration showing a first action of operations of a sheet alignment device according to an example embodiment of the present invention.

The jogger 436 may serve as an alignment unit and include first and second jogger fences 436*a* and 436*b* (see FIGS. 2 through 4). The first and second jogger fences 436*a* and 436*b* of the jogger 436 may move in the width direction of the paper sheet S so as to align the width of the plurality of the paper sheets S stacked on the staple tray 434.

The knock roller 437 may serve as an alignment member and may knock back the upper surface of the paper sheet S to a downward direction of the sheet travel direction so that the paper sheet S can be aligned in the sheet travel direction or in the vertical direction on the paper sheet S.

The discharge belt 438 may serve as a sheet discharging unit and convey the accumulated or stacked paper sheets S to be discharged to the sheet discharging tray 404.

The hook 438*a* is mounted on the discharge belt 438. The hook 438*a* may serve as a sheet discharging unit and support or hold a trailing end or rear end of the paper sheet S when the paper sheet S is conveyed from the staple tray 434 to the sheet discharging tray 404.

The trailing end fence 439 is disposed in the vicinity of and above the stapler 435. The trailing end fence 439 may serve as an alignment unit and may receive and align the paper sheet S that can fall therein after the knock roller 437 has aligned the paper sheet S in the sheet travel direction.

When a staple mode signal for binding or stapling an end face of the paper sheets S is issued from the image forming apparatus PR of the image processing system 1000, the stapler 435 may move in the width direction of the paper sheet S to a given position of the trailing end of a plurality of paper sheets S, and wait at a standby position. Hereinafter, the plurality of the paper sheets S stacked on the stapled tray 434 may also be referred to as a "sheet stack S."

The paper sheet S that has traveled through the lower sheet conveying path 403 may be conveyed by the pair of sheet discharging rollers 432 to the staple tray 434. The knock roller 437 may knock the upper surface of the paper sheet S to fall in the trailing end fence 439 to align the paper sheet S in the sheet travel direction. Further, the jogger 436 may align the paper sheet S in the width direction or in the horizontal direction of the paper sheet S.

When the trailing end fence 439 receives the paper sheet S therein, a trailing end holding mechanism (not shown) may move to press and hold the paper sheet S toward the staple tray 434 so that a room for a newly supplied paper sheet S can be effectively obtained and the newly supplied paper sheet S can easily fall into the trailing end fence 439.

After a given number of the paper sheets S has been stacked and aligned in the staple tray 434, the stapler 435 may move from the standby position to a stapling position so that the sheet stack S may be bound or stapled.

The discharge belt 438 may be then driven to discharge the stapled sheet stack S. When the discharge belt 438 is driven, the stapled sheet stack S may be conveyed to the sheet discharging tray 404 in a counterclockwise direction as shown in FIG. 1 while the hook 438*a* is supporting the trailing end of the sheet stack S. With the above-described operation, the sheet stack S may be conveyed in the upward direction and may be discharged to the sheet discharging tray 404.

During the staple mode, the home position of the sheet discharging tray 404 may be set to a position in which the movably attached end of the filler 451 is located in the vicinity of the upper sheet surface detection sensor 452. That is, a position that corresponds to the timing at which the state of the upper sheet surface detection sensor 452 changes from the undetected state to the detected state.

Along with an increase of the number or height of the sheet stack S output onto the sheet discharging tray 404, the upper sheet surface detection sensor 452 may turn off or may change to the undetected state. On changing the state of the upper sheet surface detection sensor 452 to the undetected state, the controller (not shown) of the sheet finishing apparatus PD1 may cause the drive unit (not shown) to move the sheet discharging tray 404 to the downward direction.

After the sheet discharging tray 404 has been moved to a given downward direction and the upper sheet surface detection sensor 452 has been turned on or has been changed to the detected state, the controller may cause the drive unit to stop the movement of the sheet discharging tray 404.

As previously described, the controller may repeatedly cause the drive unit to adjust the position of the sheet discharging tray 404 until the height of the sheet stack S on the sheet discharging tray 404 reaches the given height indicating the paper sheet full state. When the paper sheet full state is detected, the sheet finishing apparatus PD1 may send the image forming apparatus PR the signal to stop the image forming operation performed by the image forming apparatus PR.

Referring to FIGS. 2 through 4, structures and detailed states and functions of the staple tray 434 of the stapler unit 405 of the sheet finishing apparatus PD1 according to example embodiments of the present invention are described.

The staple tray 434 of FIGS. 2 through 4 are viewed from a direction indicated by an arrow "X" in FIG. 1. Specifically, the front side or near side of the image processing system 1000 in FIG. 1 is illustrated in a lower part of FIGS. 2 through 4 and the back side or far side is illustrated in an upper part of FIGS. 2 through 4.

When the image forming apparatus PR sends the staple mode signal to staple or bind an end face of the sheet stack S at its far side position, the stapler 435 and the first and second jogger fences 436*a* and 436*b* of the jogger 436 may move in the sheet width direction to a sheet receiving position and stand by at the sheet receiving position as shown in FIG. 2. In the staple tray 434 of the staple unit 5 of the sheet finishing apparatus PD1 according to at least one example embodiment of the present invention, the "far side position" represents a position near the first jogger fence 436*a* on the paper sheet S or the sheet stack S.

Under the above-described condition, the paper sheet S may be aligned by the knock roller 437 in the sheet travel direction or the vertical direction and by the first and second jogger fences 436*a* and 436*b* in the sheet width direction or the horizontal direction when the paper sheet S is conveyed to the staple tray 434.

In FIGS. 2 through 4, the sheet stack S is aligned in the sheet width direction or horizontal direction when the stapler 435 side of the staple tray 434 at which the first jogger fence 436*a* is arranged is set as a "reference side."

As shown in FIG. 2, the first and second jogger fences 436*a* and 436*b* may stay at respective sheet receiving positions before receiving the sheet stack S.

When the sheet stack S is conveyed to the staple tray 434, the first and second jogger fences 436*a* and 436*b* may move from the sheet receiving positions and stop to stand by at each give position arranged a given distance away from the sheet width of the sheet stack S, as shown in FIG. 3.

After the above-described movements of the first and second jogger fences 436*a* and 436*b*, the alignment operation for the sheet stack S may start. In the alignment operation, the second jogger fence 436*b*, which is not on the reference side, may move to a fixed position and remain stationary thereat shown in FIG. 3. The first jogger fence 436*a*, which is on the reference side, may move toward the second jogger fence 436*b* and push against the side face of the sheet stack S to the second jogger fence 436*b* so that the sheet stack S can be aligned in the sheet width direction. At this time, the first jogger fence 436*a* constantly contacts the side face on the reference side of the sheet stack S. Therefore, the side face of the sheet stack S on the reference side can be preferably aligned regardless of positional deviation of each paper sheet S in the sheet width direction.

In addition, before a newly supplied paper sheet S is conveyed into the staple tray 434, the jogger fences 436*a* and 436*b* may return to the respective sheet receiving positions. At this time, the second jogger fence 436*b* may move to return before the first jogger fence 436*a* moves. This can keep the preferable state of the aligned side faces of the stack of paper sheet S and can avoid further positional variation of the side faces of the sheet stack S.

Accordingly, a given number of paper sheets can be aligned and the stapler 435 may start the stapling operation.

Figure 5A:
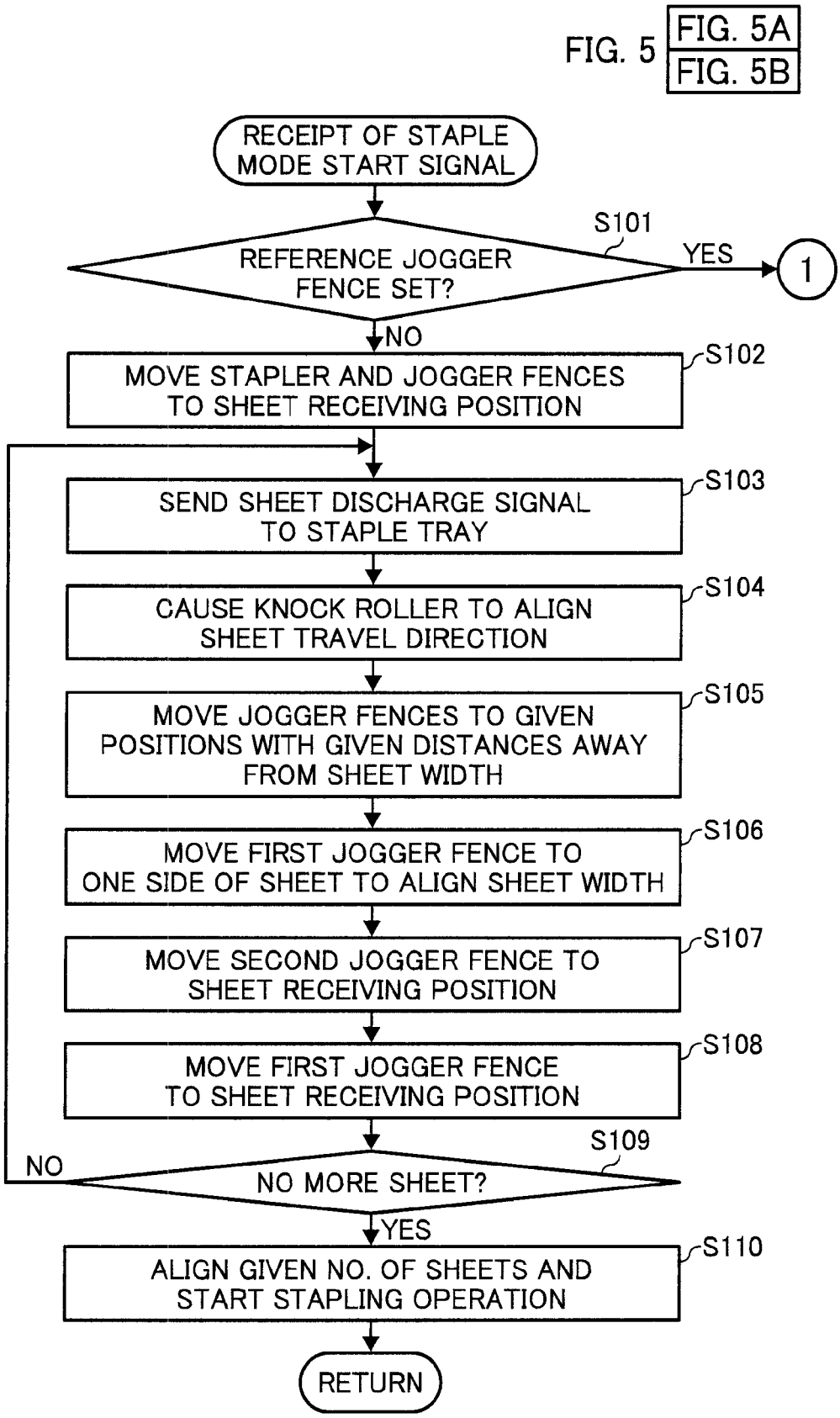
FIG. 5A is one part of a flowchart showing a procedure of a stapling operation performed by the sheet finishing apparatus of FIG. 1.
Figure 5B:
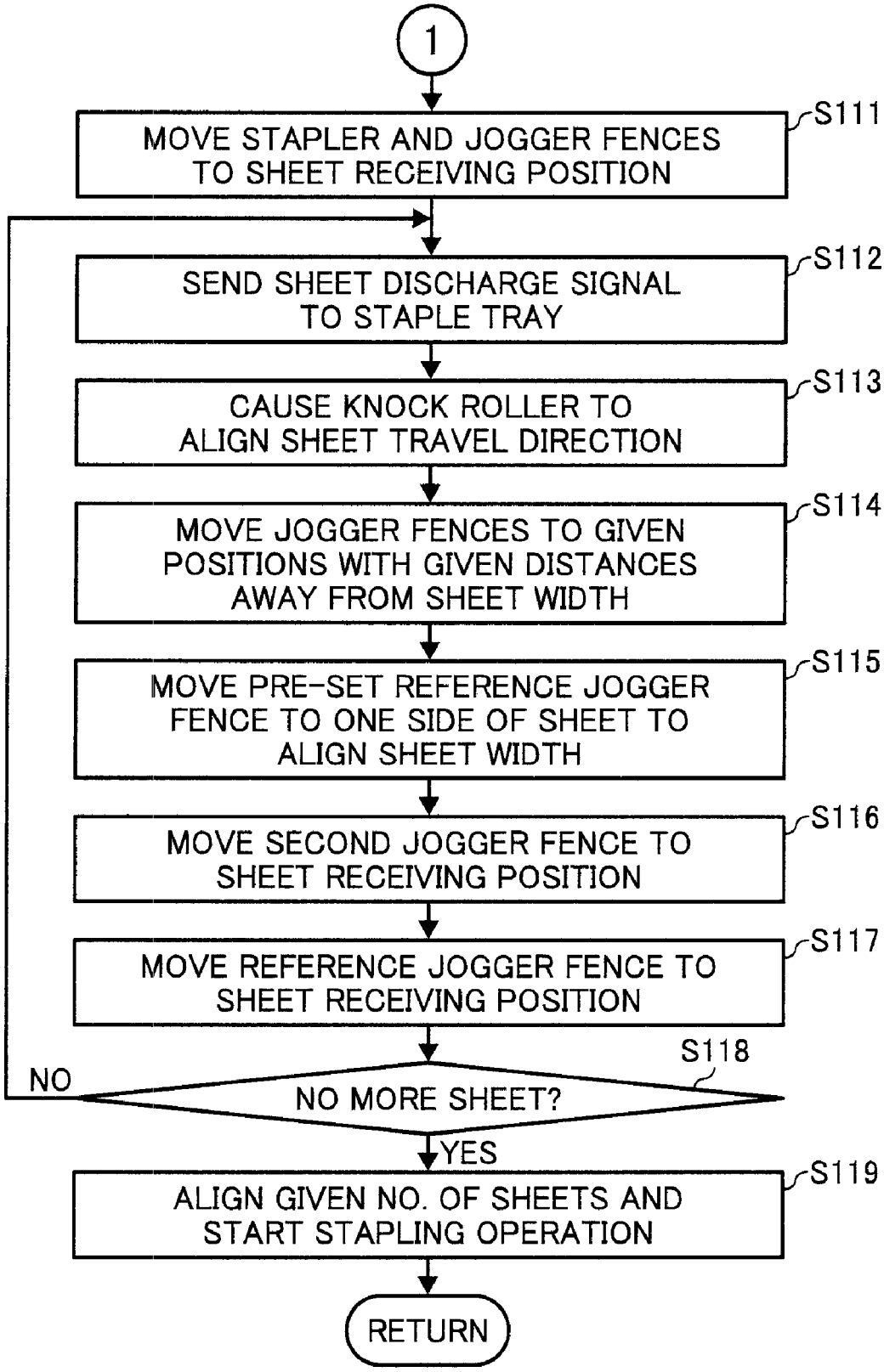
FIG. 5B is a second part of the flowchart showing the procedure of the stapling operation.

Referring to FIGS. 5A and 5B, two parts of a flowchart showing a procedure of a stapling operation are described according to an example embodiment of the present invention.

The flowchart of FIGS. 5A and 5B shows operations when a reference side for alignment is set and operations when a reference side for alignment is not set.

In FIG. 5A, on receiving a staple mode start signal, a central processing unit or CPU (not shown in this example embodiment) checks whether either one of the first and second jogger fences 436*a* and 436*b* of the jogger 436 is set as a reference jogger fence in step S101.

When none of the first and second jogger fences 436*a* and 436*b* of the jogger 436 is set as a reference jogger fence, the result of step S101 is NO, and the stapler 435 and the first and second jogger fences 436*a* and 436*b* move to the respective sheet receiving positions in step S102, as shown in FIG. 2.

When a sheet discharge signal is sent to the staple tray 435 in step S103, the paper sheet S is discharged onto the staple tray 434. At this time, the knock roller 437 abuts the paper sheet S against the trailing end fence 439 to align the paper sheet S in the sheet travel direction in step S104.

The first and second jogger fences 436*a* and 436*b* move to respective given positions arranged a given distance away from the sheet width of the sheet stack S in step S105, as shown in FIG. 3.

Here, the CPU (not shown) automatically causes the first and second jogger fences 436*a* and 436*b* arranged in the vicinity of the stapler 435 to serve as a jogger fence on the reference side. That is, the first jogger fence 436*a* serves as the "reference jogger fence."

The first jogger fence 436*a*, shown on the far side in FIGS. 2 through 4, moves to the sheet width position so as to align in the sheet width direction in step S106.

The second jogger fence 436*b*, which is located on the opposite side of the reference side, moves back to the sheet receiving position in step S107. Then, the first jogger fence 436*a*, which is arranged on the reference side, returns to the sheet receiving position in step S108.

The CPU then checks whether there is no more paper sheet S in step S109. When there is another paper sheet S, the result of step S109 is NO, and the process goes back to step S103 to repeat the operation from and after step S103. When there is no more paper sheet S, the result of step S109 is YES, and the CPU executes the stapling operation in step S110.

Specifically, the operations of steps S103 through S108 may be repeated for each paper sheet S until one set of sheet stack S completes. At the completion of the one set of sheet stack S, the CPU executes the stapling operation, and returns to step S101. When a plurality of sheet stacks S are handled in one copying or printing job, the above-described stapling operations may be repeated for the entire job. When the stapling operation for the job is completed, the CPU may complete the procedure of the flowchart of FIG. 5A.

When a reference side for the stapling of the sheet stack S is set, the result of step S101 is YES, and a reference jogger fence is determined regardless of the home position of the stapler 435. In this case, the first jogger fence 436*a* serves as a jogger fence on the reference side or a reference jogger fence.

The operations in steps S111 through S114 shown in FIG. 5B are same as the operations in steps S102 through S105 shown in FIG. 5A, respectively. Therefore, the descriptions of steps P111 through S114 shown in FIG. 5B are omitted.

In step S115, the CPU causes the first jogger fence 436*a* determined as the jogger fence on the reference side in step S101 to move to the sheet width and align the sheet stack S in the sheet width direction.

The second jogger fence 436*b* returns to the sheet receiving position in step S116.

The operations in steps S116 through S119 are same as the operations in step S107 through S110, respectively. Therefore, the descriptions of steps S116 through S119 are omitted.

With the above-described operations, when no jogger fence is set as a reference jogger fence, the CPU (not shown) automatically specifies a jogger fence arranged in the vicinity of the stapler 435 side to be the reference jogger fence. Accordingly, the CPU controls to move a reference jogger fence in any case so as to enhance ability in alignment.

According to this example embodiment, the following advantages can effectively be achieved.

(1) The alignment of the sheet stack S in the sheet width direction or horizontal direction may be executed by moving the jogger fence on the reference side. Therefore, the sheet stack S on the reference side can preferably be aligned.

(2) Before the alignment of a sheet stack S, the first and second jogger fences 436*a* and 436*b* may move to the side faces of the sheet stack S and stop to stand by at each given position arranged a given distance away from the corresponding side face of the sheet stack S. Therefore, the period of time taken for the alignment operation can be reduced.

(3) After the sheet stack S in the sheet width direction has been aligned, the jogger fence on a side opposite to the reference side may return to the sheet receiving position, and then the jogger fence on the reference side may return to the sheet receiving position. Therefore, the alignment of the sheet stack S on the reference side can be performed preferably.

(4) The CPU can determine either one of a pair of jogger fences to serve as a reference jogger fence. Therefore, a user can freely specify a reference jogger fence according to an image forming direction or a sheet traveling direction.

(5) When a reference jogger fence is not specified, the CPU may automatically select a jogger fence arranged in the vicinity of a stapler so as to cause the jogger fence to serve as a reference jogger fence. Therefore, the side faces of a sheet stack S can be aligned without forcing a user to determine a reference jogger fence. This can enhance performance of the operations of the sheet finishing apparatus PD1.

Referring to FIGS. 6 through 38 of the drawings, an image processing system 2000 according to an example embodiment of the present invention is shown.

Figure 6:
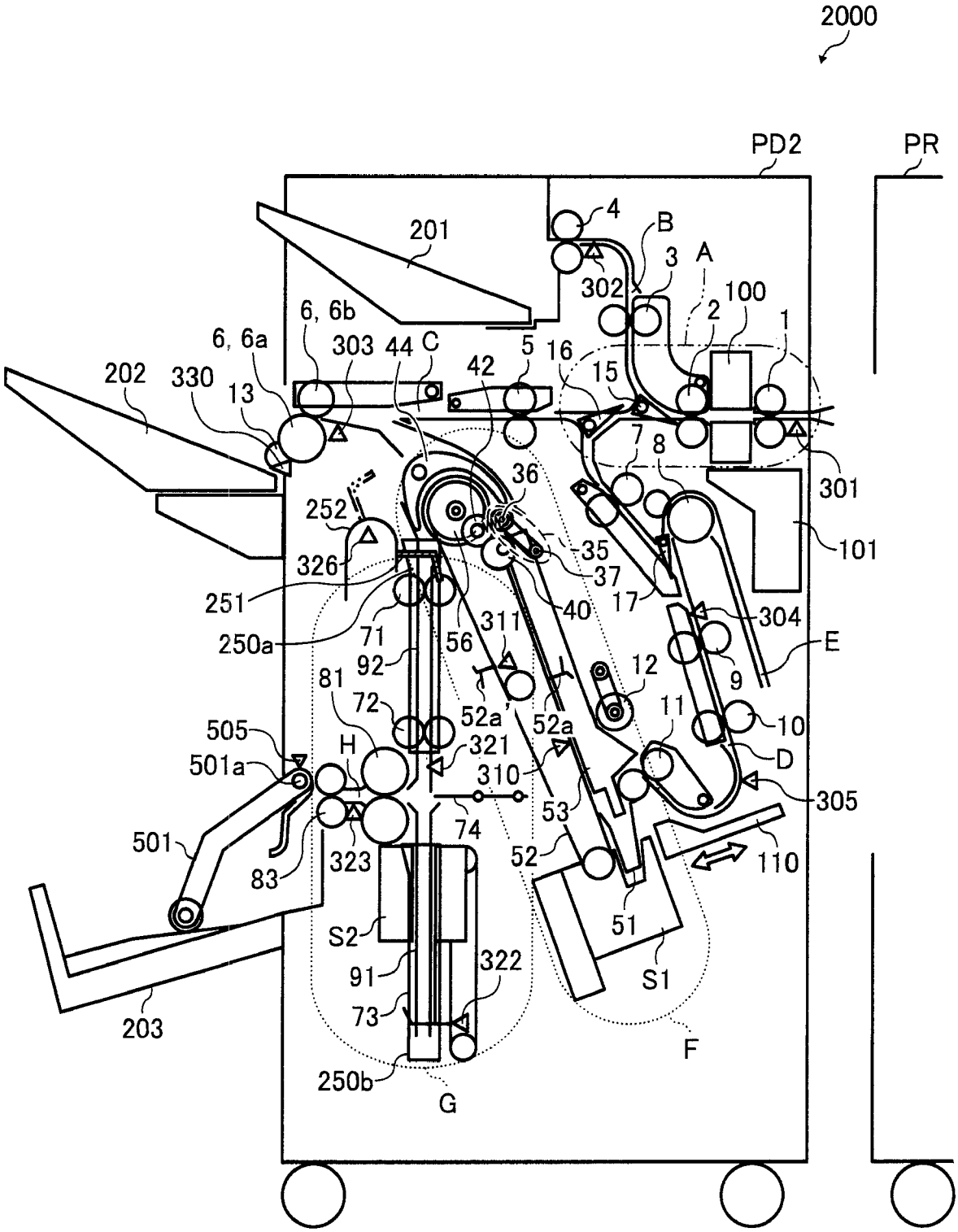
FIG. 6 is a schematic configuration of a sheet finishing apparatus, according to an example embodiment of the present invention, included in an image processing system according to an example embodiment of the present invention.

As shown in FIG. 6, the image processing system 2000 is generally made up of the image forming apparatus PR and a sheet finishing apparatus PD2 operatively connected to one side of the image forming apparatus PR. A paper sheet or recording medium driven out of the image forming apparatus PR is introduced in the sheet finishing apparatus PD2. In the sheet finishing apparatus PD2, there is a plurality of sheet conveying paths.

A sheet conveying path A includes a sheet finishing mechanism for finishing a single paper sheet. In the illustrative embodiment, this sheet finishing mechanism is implemented as a punch unit 100. Path selectors 15 and 16 steer the paper sheet coming in through the sheet conveying path A to any one of a sheet conveying path B terminating at an upper tray 201, a sheet conveying path C terminating at a shift tray 202, and a processing tray F. The processing tray F is used to position, staple or otherwise process a paper sheet or paper sheets and, in this sense, will also be referred to as an "end face binding processing tray F", hereinafter.

The image forming apparatus PR further includes at least an image processor, an optical writing unit, a developing unit, an image transfer unit, and a fixing unit although not shown specifically.

The image processor converts an image signal input thereto to image data that can be printed out.

The optical writing unit optically scans the surface of a photoconductive element in accordance with the image data output from the image processor, thereby forming an electrostatic latent image.

The developing unit develops the electrostatic latent image with toner to thereby produce a corresponding toner image.

The image transferring unit transfers the toner image onto a paper sheet.

The fixing unit fixes the toner image on the paper sheet.

While the image forming apparatus PR is assumed to execute an electrophotographic process, it may alternatively be of the type executing any other conventional image forming process, e.g., an ink-jet or a thermal transfer image forming process. In the illustrative embodiment, the image processor, optical writing unit, developing unit, image transferring unit and fixing unit constitute image forming mechanism in combination.

Paper sheets sequentially brought to the end face binding processing tray F via the sheet conveying paths A and a sheet finishing path D are positioned one by one, stapled or otherwise processed, and then steered by a guide plate 44 to either one of the sheet conveying path C and a center binding and center folding processing tray G. The center binding and center folding processing tray G folds or otherwise processes the paper sheets and, in this sense, will sometimes be referred to as a "folding processing tray G", hereinafter. The paper sheets folded by the folding processing tray G are guided to a lower tray 203 via a sheet conveying path H. The sheet finishing path D includes a path selector 17 constantly biased to a position shown in FIG. 6 by a light-load spring, which is not shown. An arrangement is made such that after the trailing end of a paper sheet has moved away from the path selector 17, among pairs of sheet conveying rollers 7, 9 and 10 and a pair of staple sheet discharging rollers 11, at least the pair of sheet conveying rollers 9 is rotated in the reverse direction along a turn roller 8. This conveys the trailing end of the paper sheet to a prestacking portion E and causes the paper sheet to stay or prestack there. In this case, the paper sheet can be conveyed together with the newly supplied paper sheet placed thereon. Such an operation may be repeated to convey two or more paper sheets together.

In the prestacking portion E, a prestack sensor 304 is arranged so as to set a timing to convey the paper sheet to the reverse direction for prestacking the paper sheet.

On the sheet conveying path A merging into the sheet conveying paths B, and C, and the sheet finishing path D, there are sequentially arranged an inlet sensor 301 responsive to a paper sheet coming into the sheet finishing apparatus PD2, a pair of inlet rollers 1, the punch unit 100, a punch dust hopper 101, a roller pair 2, and the path selectors 15 and 16. Springs (not shown) constantly bias the path selectors 15 and 16 to the positions shown in FIG. 6. When solenoids (not shown) are turned on, the path selectors 15 and 16 selectively rotate upward and downward to thereby steer the paper sheet to desired one of the sheet conveying paths B, and C, and the sheet finishing path D.

More specifically, to guide a paper sheet to the conveying path B, the path selector 15 may be held in the position shown in FIG. 6 while the solenoid assigned thereto is turned off. To guide a paper sheet to the conveying path C, the solenoids may be turned on to rotate the path selectors 15 and 16 upward and downward, respectively. Accordingly, the paper sheet may be output to the upper tray 201 via a pair of sheet conveying rollers 3 and a pair of sheet discharging rollers 4.

Further, to guide a paper sheet to the sheet finishing path D, the path selector 16 may be held in the position shown in FIG. 6 while the solenoid assigned thereto is turned off; at the same time, the solenoid assigned to the path selector 15 is turned on to rotate it upward. Accordingly, the paper sheet may be output to the shift tray 202 via a pair of sheet conveying rollers 5 and a pair of sheet discharging rollers 6 or first and second sheet discharging rollers 6*a* and 6*b* on the sheet conveying path C.

In the illustrative embodiment, the sheet finishing apparatus PD2 is capable of selectively effecting punching (the punch unit 100), sheet alignment and end binding (jogger fences 53 and an end face binding stapler S1), sheet alignment and center binding (a center binding upper jogger fence 250*a*, a center binding lower jogger fence 250*b*, and a center binding stapler S2), sorting (the shift tray 202), and center folding (a folding plate 74, and a pair of pair of folding rollers 81).

(Shift Tray Section)

A shift tray outlet section is located at the most downstream position of the sheet finishing apparatus PD2 and includes the pair of sheet discharging rollers 6 (the shift outlet rollers 6*a* and 6*b*), a return roller 13, a sheet surface sensor 330, and the shift tray 202. The shift tray outlet section additionally includes a shifting mechanism J (see FIG. 7) and a shift tray elevating mechanism K (see FIG. 8).

As shown in FIG. 6, the return roller 13 contacts a paper sheet driven out by the pair of sheet discharging rollers 6 and causes the trailing end of the paper sheet to abut against an end fence 32 (see FIG. 7) for thereby aligning the paper sheet. The return roller 13 is formed of sponge and is caused to rotate by the pair of sheet discharging rollers 6. A limit switch 333 (see FIG. 8) is positioned in the vicinity of the return roller 13 so that the limit switch 333 can raise the return roller 13 when the shift tray 202 is lifted, and the limit switch 333 may turn on, causing a tray elevation motor 168 (see FIG. 8) to stop rotating. This prevents the shift tray 202 from overrunning.

Further, as shown in FIG. 6, the sheet surface sensor 330 senses the surface of a paper sheet or that of a sheet stack driven out to the shift tray 202.

Figure 7:
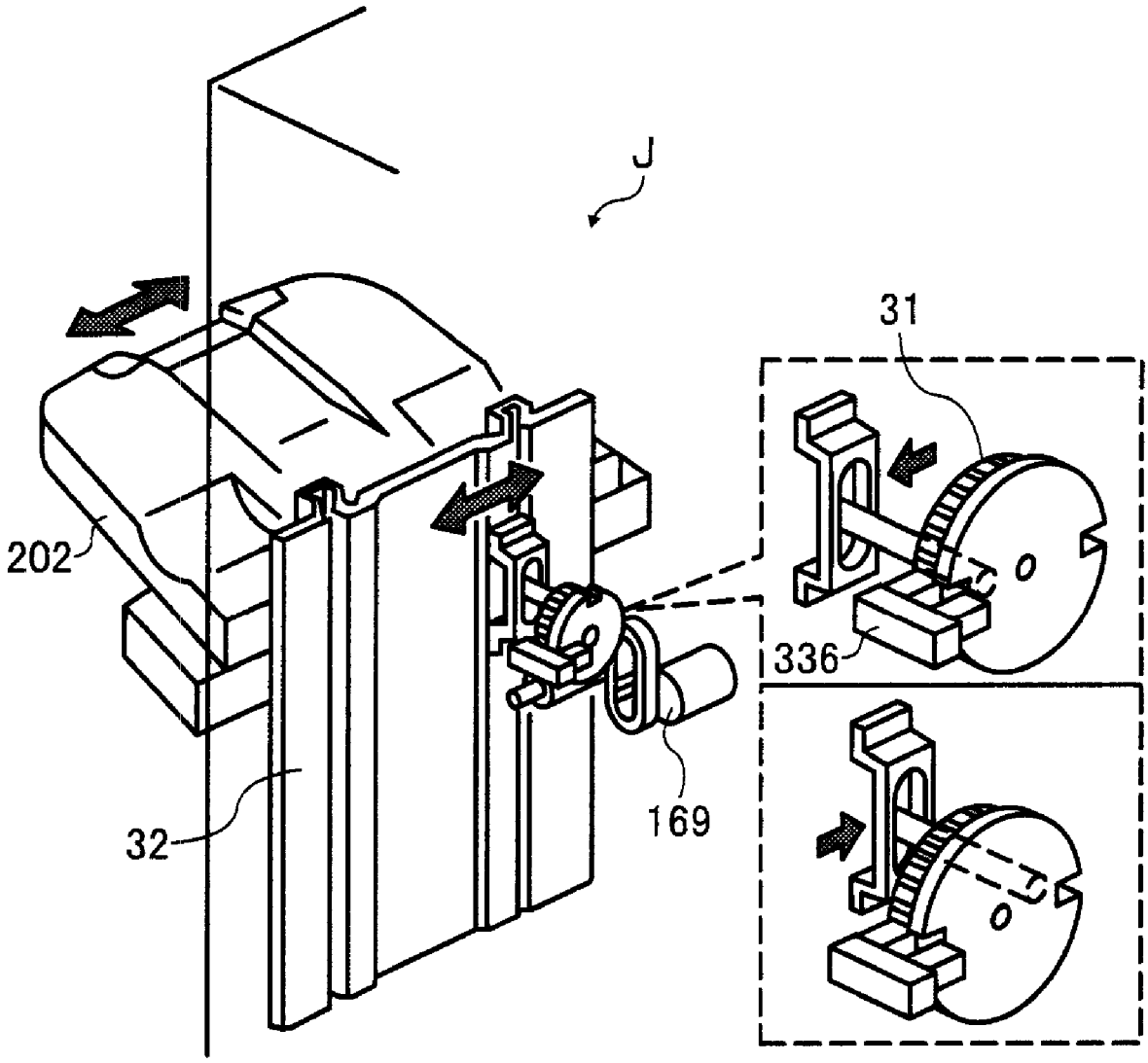
FIG. 7 is a schematic structure of a shifting mechanism included in the sheet finishing apparatus of FIG. 6.

Referring to FIG. 7, a schematic structure of the shifting mechanism J is described.

As shown in FIG. 7, the shifting mechanism J includes a shift motor 169 and a shift cam 31. When the shift motor 169 serving as a drive source 169 causes the shift cam 31 to rotate, the shift cam 31 causes the shift tray 202 to move back and forth in a direction perpendicular to the sheet travel or sheet discharging direction. A pin may be studded on the shift cam 31 at a position spaced from the axis of the shift cam 31 by a given distance. The tip of the pin may be movably received in an elongate slot formed in an engaging member, which is affixed to the back of the end fence 32 not facing the shift tray 202. The engaging member may move back and forth in a direction perpendicular to the sheet discharging direction in accordance with the angular position of the pin, entraining the shift tray 202 in the same direction. The shift tray 202 may stop at a front position and a rear position in the direction perpendicular to the sheet surface of FIG. 7. A shift sensor 336 is responsive to a notch formed in the shift cam 31. To stop the shift tray 202 at the above-described two positions, the shift motor 169 may selectively be turned on or off on the basis of the output of the shift sensor 336.

Figure 8:
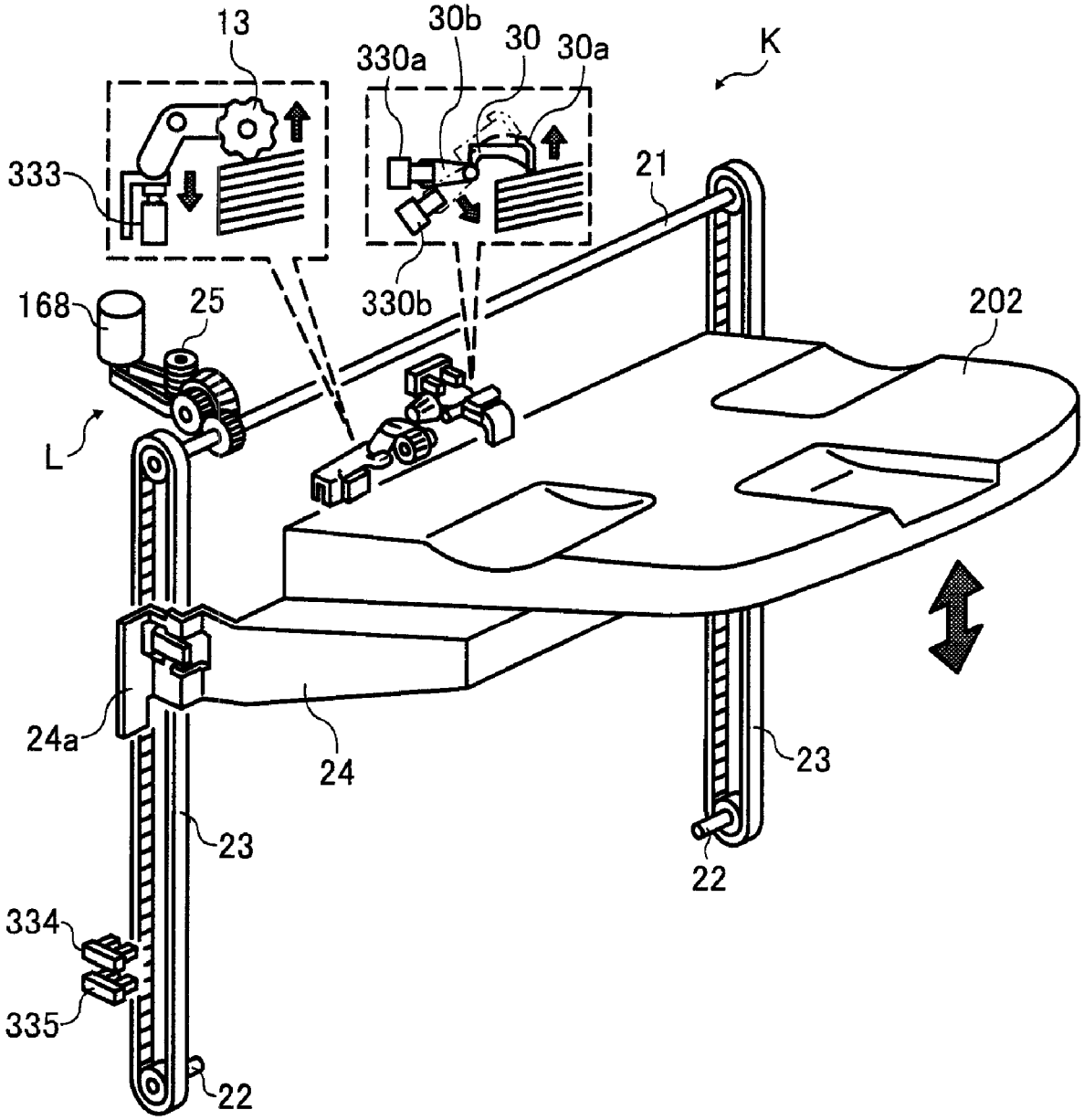
FIG. 8 is a schematic structure of a shift tray elevating mechanism included in the sheet finishing apparatus of FIG. 6.

Referring to FIG. 8, a schematic structure of the shift tray elevating mechanism K is described.

In FIG. 8, the shift tray elevating mechanism K includes a sheet surface sensor 330*a* relating to stapling and a sheet surface sensor 330*b* relating to non-stapling may respectively turn on when interrupted by a sectorial interrupter 30*b* of a lever 30. Therefore, when the shift tray 202 is lifted with a contact end 30*a* of the lever 30 moving upward, the sheet surface sensor 330*a* may turn off. As the shift tray 202 is further lifted, the sheet surface sensor 330*b* may turn on. When the outputs of the sheet surface sensors 330*a* and 330*b* indicate that paper sheets S are stacked on the shift tray 202 to a pre-selected height, the tray elevation motor 168 is driven to lower the shift tray 202 by a pre-selected amount. The top of the sheet stack on the shift tray 202 is therefore maintained at a substantially constant height.

As shown in FIG. 8, the shift tray elevating mechanism K further includes a drive unit L for moving the shift tray 202 in an upward or downward direction via a drive shaft 21. Timing belts 23 may be passed over the drive shaft 21 and respective driven shafts 22 under tension via timing pulleys (not shown). A side plate 24 may support the shift tray 202 and be affixed to the timing belts 23. In this configuration, the entire unit including the shift tray 202 can be supported by the timing belts 23 in such a manner as to be movable up and down.

The drive unit L includes a worm gear 25 in addition to the tray elevation motor 168, which is a reversible drive source of the shift tray 202. Torque output from the tray elevation motor 168 may be transmitted to the last gear of a gear train mounted on the drive shaft 21 to thereby move the shift tray 202 in the upward or downward direction. The worm gear 25 included in the driveline allows the shift tray 202 to be held at a pre-selected position and therefore prevents the shift tray 202 from dropping by accident.

An interrupter 24*a* may be formed integrally with the side plate 24 of the shift tray 202. A full sensor 334 responsive to the full condition of the shift tray 202 and a lower limit sensor 335 responsive to the lower limit position of the shift tray 202 may be positioned below the interrupter 24*a*. The full sensor 334 and the lower limit sensor 335, which are implemented by photosensors, may respectively turn off when interrupted by the interrupter 24*a*. In FIG. 8, the pair of sheet discharging rollers 6 is not shown.

Figure 9:
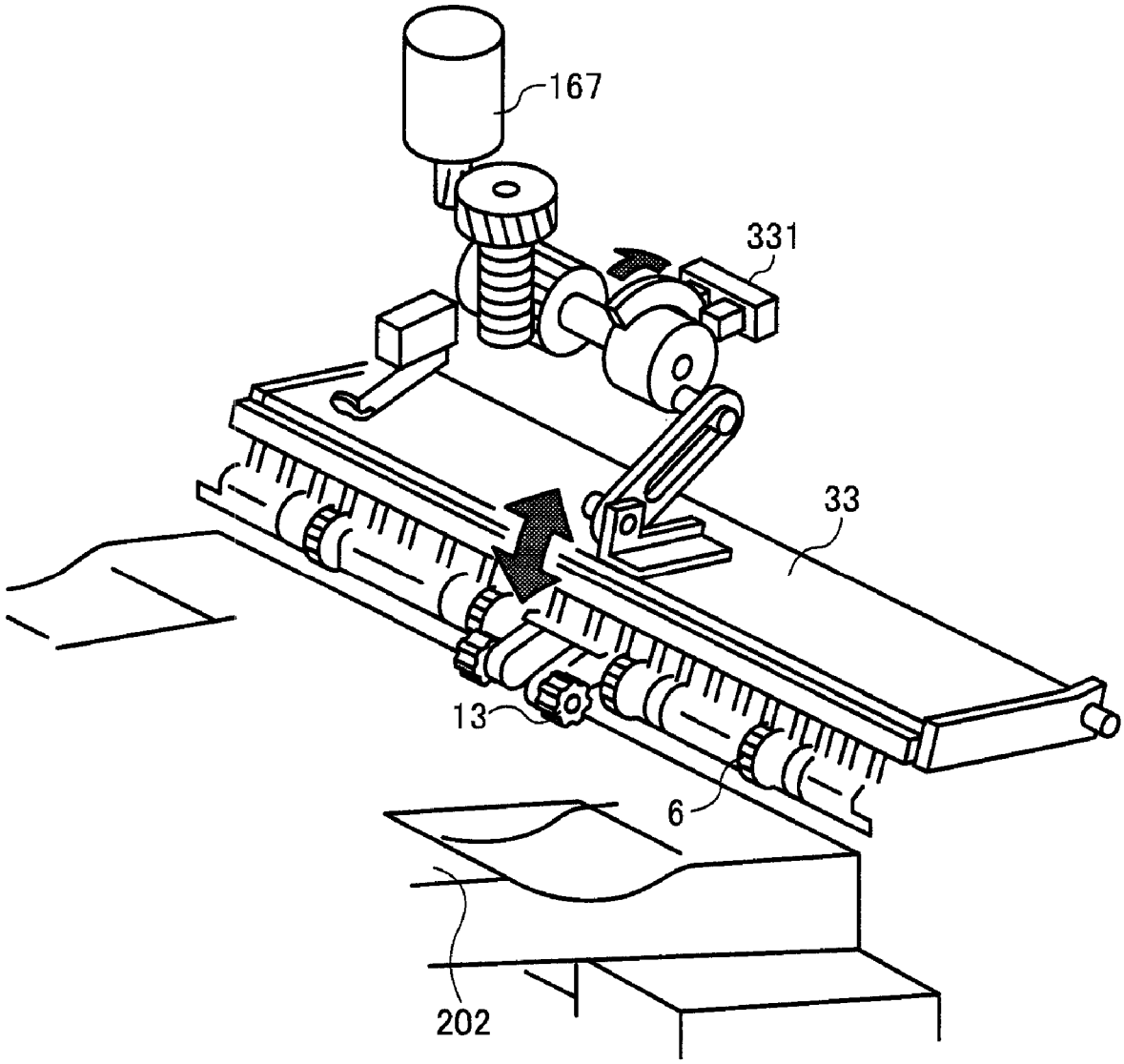
FIG. 9 is a schematic structure of a pair of shift discharging rollers and a guide plate included in the sheet finishing apparatus of FIG. 6.

Referring to FIG. 9, a specific configuration of the arrangement for discharging a paper sheet to the shift tray 202 is described.

As shown in FIGS. 6 and 9, the pair of sheet discharging rollers 6 has the first sheet discharging roller 6*a* as a drive roller and the second sheet discharging roller 6*b* as a driven roller. A guide plate 33 may be supported at its upstream side in the sheet discharging direction and angularly movable in the up-and-down or vertical direction. The second sheet discharging roller 6*b* serving as a driven roller may be supported by the guide plate 33 and contact the first sheet discharging roller 6*a* serving as a drive roller due to its own weight or by being biased, nipping a paper sheet between it and the first sheet discharging roller 6*a*. When a stapled sheet stack is to be driven out to the shift tray 202, the guide plate 33 may be lifted and then lowered at a pre-selected timing, which is determined based on a detection signal of a shift sheet discharging sensor 303 (see FIG. 6). Further, a stop position of the guide plate 33 may be determined on the basis of the output of a sheet discharging guide plate sensor 331. A sheet discharging guide plate motor 167 drives the guide plate 33 in such a manner in accordance with the ON/OFF state of a limit switch 332.

(End Face Binding Processing Tray)

Referring to FIGS. 10, 11, 12, and 13, schematic structures and functions of the end face binding processing tray F are described.

(Configuration of End Face Binding Processing Tray)

Figure 10:
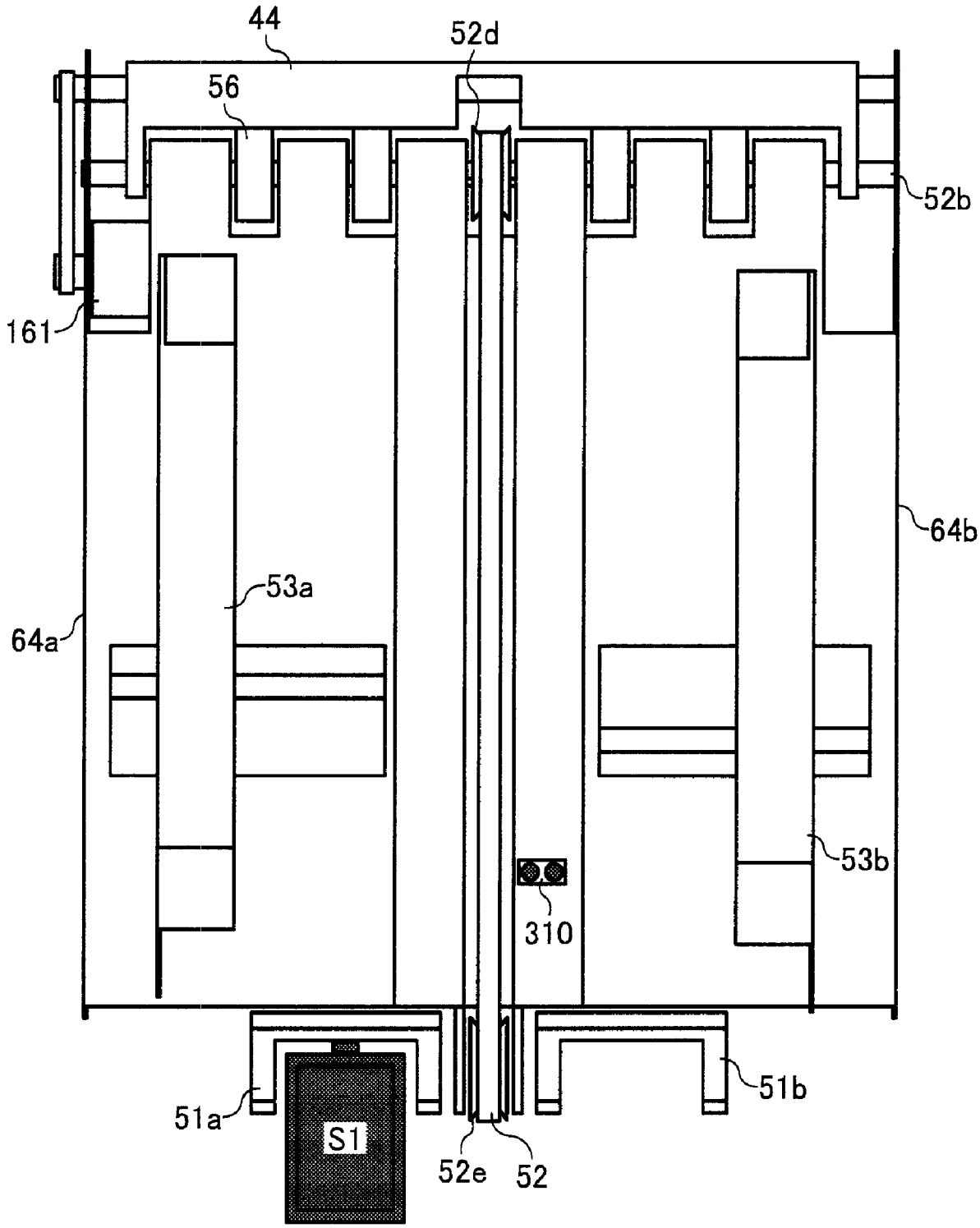
FIG. 10 is a plane view of an end face binding processing tray included in the sheet finishing apparatus of FIG. 6.
Figure 11:
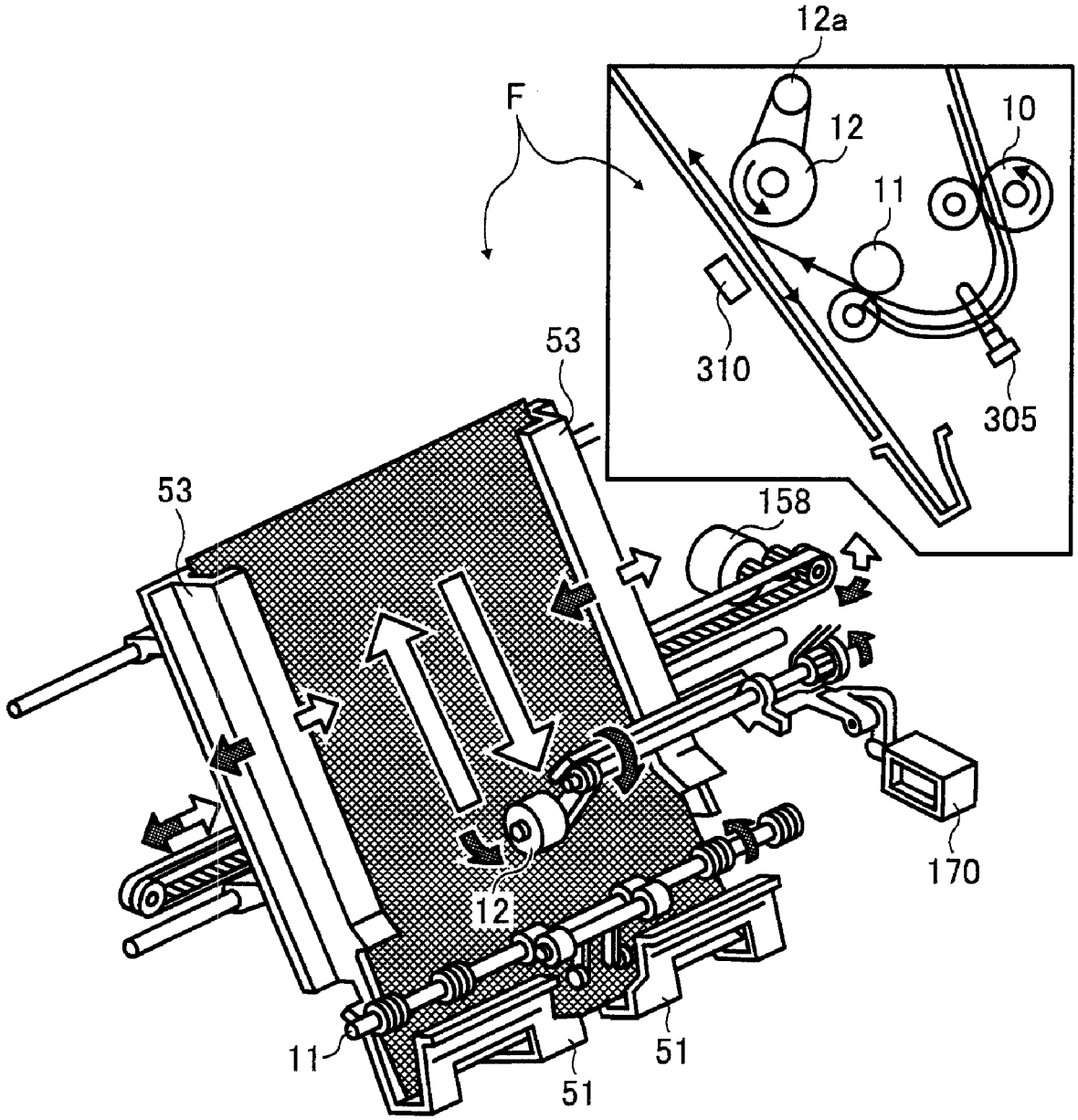
FIG. 11 is a perspective view of the end face biding processing tray of FIG. 10.
Figure 12:
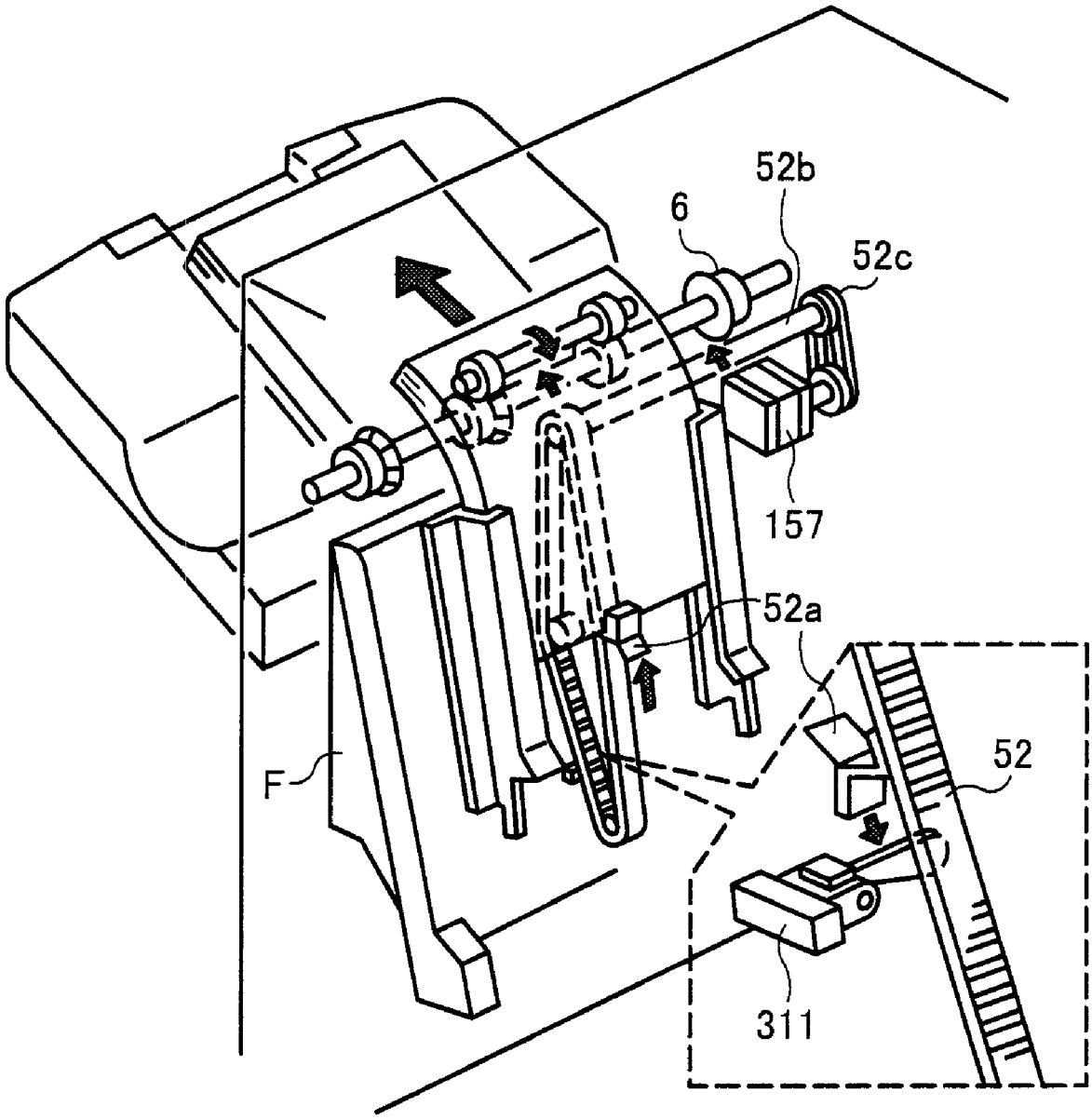
FIG. 12 is a schematic structure of a driving mechanism for driving a discharge belt and a hook.
Figure 13:
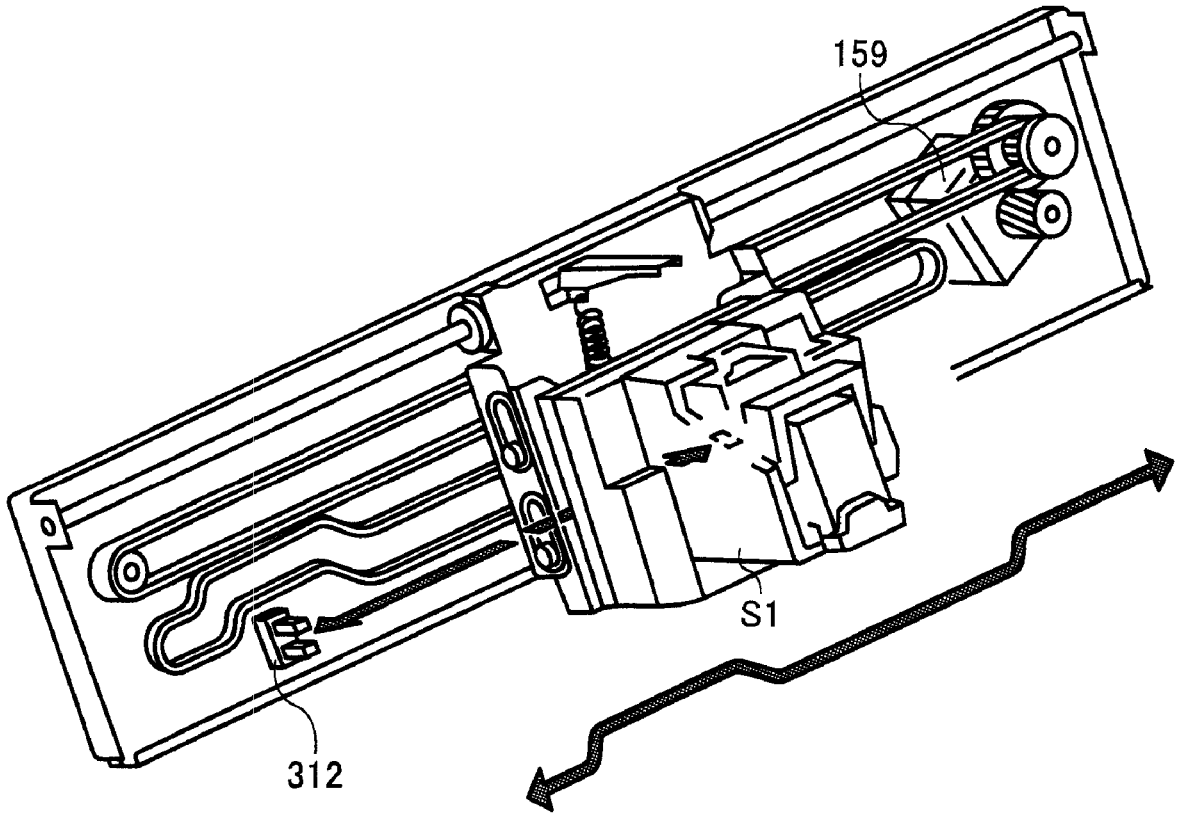
FIG. 13 is a schematic structure of a mechanism for moving an end face binding stapler.

FIG. 10 shows the end face binding processing tray F as seen in a direction perpendicular to the sheet conveyance plane. FIG. 11 shows a drive mechanism assigned to the end face binding processing tray F. FIGS. 12 and 13 show schematic structures of a sheet stack discharging mechanism.

As shown in FIG. 10, paper sheets sequentially conveyed by the pair of staple sheet discharging rollers 11 to the end face binding processing tray F are sequentially stacked on the end face binding processing tray F. At this instant, a knock roller 12 (see FIGS. 6 and 11) may knock every paper sheet for aligning the paper sheet in the vertical direction or the sheet travel direction while the jogger fences 53 align or position the paper sheet in the horizontal direction perpendicular to the sheet travel direction (sometimes referred to as a "sheet width direction"). Between consecutive jobs, i.e., during an interval between the last sheet of a sheet stack and the first sheet of the next sheet stack, a control unit 350 (see FIG. 38) may output a staple signal for causing the end face binding stapler S1 to perform a stapling operation. A discharge belt 52 with a hook 52*a* may immediately convey the stapled sheet stack to the pair of sheet discharging rollers 6, so that the pair of sheet discharging rollers 6 can convey the sheet stack to the shift tray 202 held at the sheet receiving position.

(Sheet Discharging Mechanism)

As shown in FIG. 12, a discharge belt HP (Home Position) sensor 311 senses the hook 52*a* of the discharge belt 52 brought to its home position. More specifically, two hooks 52*a* and 52*a*' may be positioned on the discharge belt 52 face-to-face at spaced locations in the circumferential direction and alternately convey sheet stacks stapled on the end face binding processing tray F one after another. The discharge belt 52 may be moved in the reverse direction such that one hook 52*a* held in a stand-by position and the back of the other hook 52*a*' align the leading edge of the sheet stack stored in the end face binding processing tray F in the sheet travel direction, as needed. The hook 52*a* may therefore play the role of positioning member at the same time.

As shown in FIG. 10, the discharge belt 52 is located at a center of alignment in a sheet width direction and is extended by a drive pulley 52*d* and a driven pulley 52*e*. As shown in FIG. 12, a discharge motor 157 causes the discharge belt 52 to move via a sheet discharge drive shaft 52*b* and a pulley 52*c*. The discharge belt 52 and the drive pulley 52*d* therefore may be positioned at the center of the sheet discharge drive shaft 52*b* in the sheet width direction. A plurality of sheet discharge rollers 56 are mounted on the sheet discharge drive shaft 52*b* in a symmetrical arrangement. The plurality of sheet discharge rollers 56 are configured to rotate at a higher peripheral speed than the discharge belt 52.

FIG. 10 further shows a front frame plate 64*a*, a rear frame plate 64*b*, first and second trailing end fences 51*a* and 51*b* (described with a reference number 51 in FIG. 6), and first and second jogger fences 53*a* and 53*b*.

(Staple Processing Mechanism)

A staple processing mechanism will be described hereinafter.

As shown in FIG. 11, a solenoid 170 causes the knock roller 12 to move about a fulcrum 12*a* in a pendulum fashion, so that the knock roller 12 can intermittently act on paper sheets sequentially driven to the end face binding processing tray F and cause their trailing ends to abut against the trailing end fences 51. The knock roller 12 may rotate counterclockwise about its axis.

As shown in FIG. 10, the first and second jogger fences 53*a* and 53*b* may be mounted as one pair. A jogger motor 158 may drive the first and second jogger fences 53*a* and 53*b* via a timing belt and causes the first and second jogger fences 53*a* and 53*b* to move back and forth in the direction of sheet width.

FIGS. 6 and 10 further show a sheet presence/absence sensor 310 that is responsive to the presence and absence of a sheet stack on the end face binding processing tray F.

As shown in FIG. 13, a mechanism for moving the end face binding stapler S1 includes a reversible, a stapler motor 159 for driving the end face binding stapler S1 via a timing belt. The end face binding stapler S1 may be movable in the sheet width direction in order to bind or staple a sheet stack at a desired end position. A stapler HP sensor 312 may be positioned at one end of the movable range of the end face binding stapler S1 in order to sense the end face binding stapler S1 brought to its home position. The stapling position in the sheet width direction may be controlled in terms of the displacement of the end face binding stapler S1 from the home position.

Figure 14:
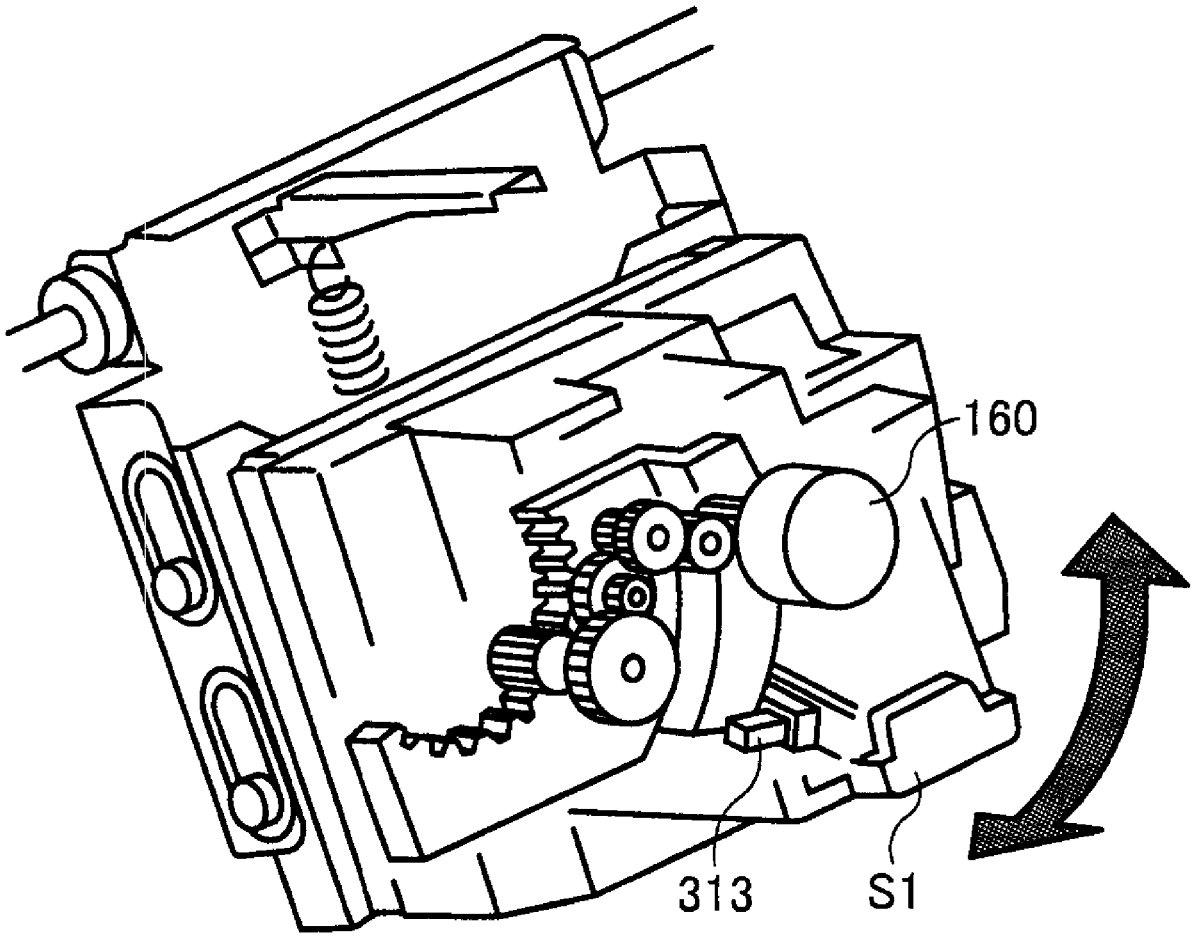
FIG. 14 is schematic structure of a mechanism for an oblique stapling of the end face binding stapler.

Referring to FIG. 14, a schematic structure of the end face binding stapler S1 is described.

As shown in FIG. 14, the end face binding stapler S1 is capable of selectively driving a staple into a sheet stack in parallel to or obliquely relative to the edge of the sheet stack. Further, at the home position, only the stapling mechanism portion of the end face binding stapler S1 may be rotatable by a given angle for the replacement of staples. For this purpose, an oblique motor 160 may cause the above-described mechanism of the end face binding stapler S1 to rotate until an oblique sensor 313 senses the mechanism reached a preselected replacement position. After oblique stapling or the replacement of staples, the oblique motor 160 may cause the stapling mechanism portion to return to its original angular position.

(Sheet Stack Trailing End Holding Mechanism)

Referring to FIGS. 15 through 19, schematic structures of a sheet stack trailing end holding mechanism for pressing and holding the trailing end of a sheet stack S on the end face binding processing tray F are described.

When paper sheets are output to the end face binding processing tray F, the knock roller 12 may knock each paper sheet S to align the paper sheets S in the vertical direction or sheet travel direction.

When the trailing end of the paper sheets on the end face binding processing tray F is curled or thinner at the portion, the trailing end thereof can buckle in a bow shape and deform due to its own weight to increase space to occupy in the end face binding processing tray F. Further, according to an increase of the number of paper sheets S to be loaded in the end face binding processing tray F, only little space can be saved for the next paper sheet S in the trailing end fences 51, which can cause poor alignment of the paper sheets S in the vertical or sheet travel direction.

The sheet stack trailing end holding mechanism can reduce the volume at the trailing end of the sheet stack S to cause the paper sheets S to easily enter into the trailing end fences 51.

Figure 15:
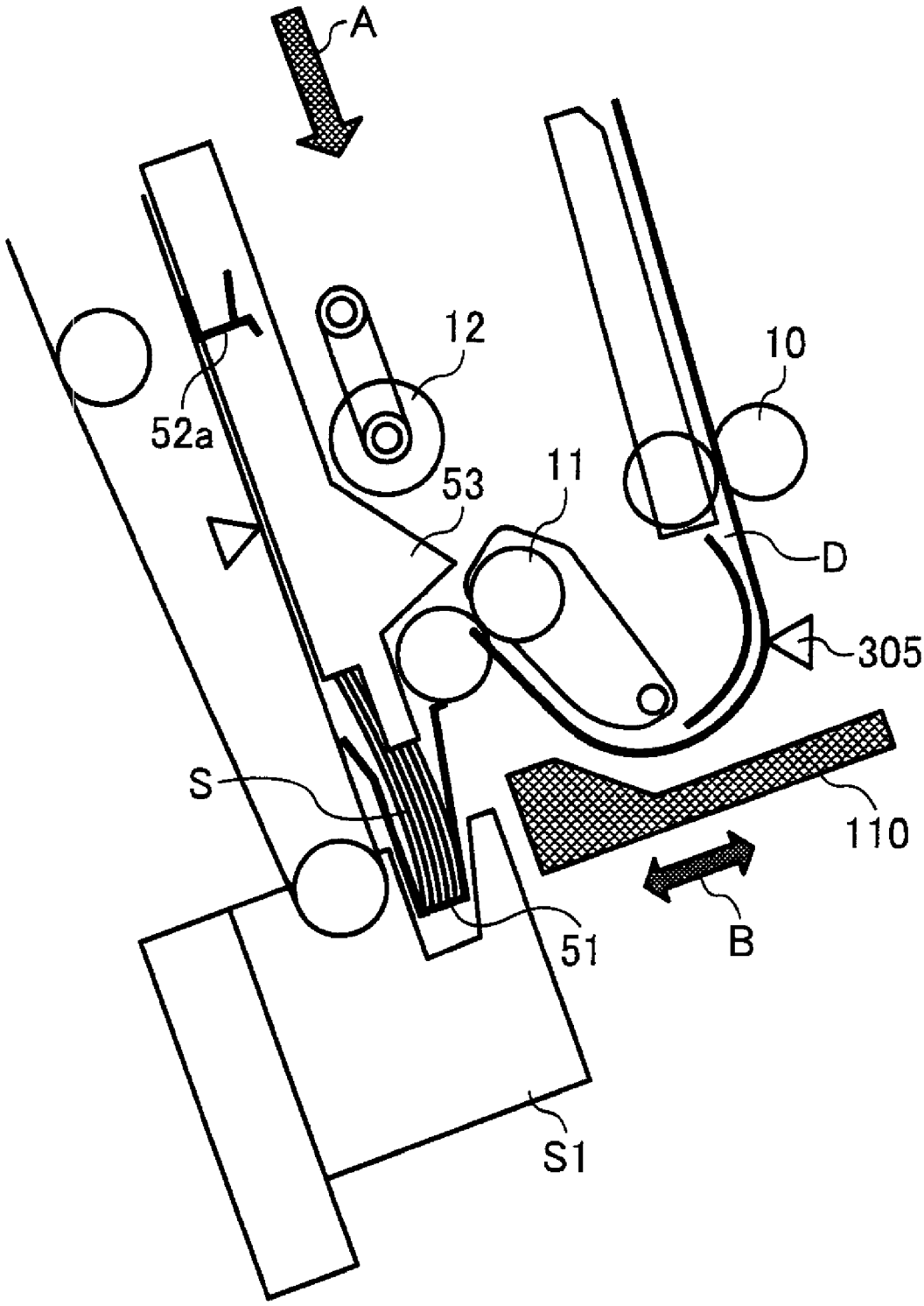
FIG. 15 is a schematic structure of a sheet stack trailing end holding mechanism included in the sheet finishing apparatus of FIG. 6.

In FIG. 15, the sheet stack trailing end holding mechanism includes a trailing end holding unit 110.

The trailing end holding unit 110 includes first, second, and third trailing end holding levers 110*a*, 110*b*, and 110*c* as shown in FIGS. 16 through 19, and is disposed in the vicinity of the trailing end fences 51 that presses and holds the trailing end of the sheet stack S stored in the trailing end fences 51. The trailing end holding unit 110 may move forward and backward in a substantially direction perpendicular to the end face binding processing tray F.

FIGS. 16 through 19 are views seen from a direction indicated by an arrow "A" in FIG. 15.

Figure 16:
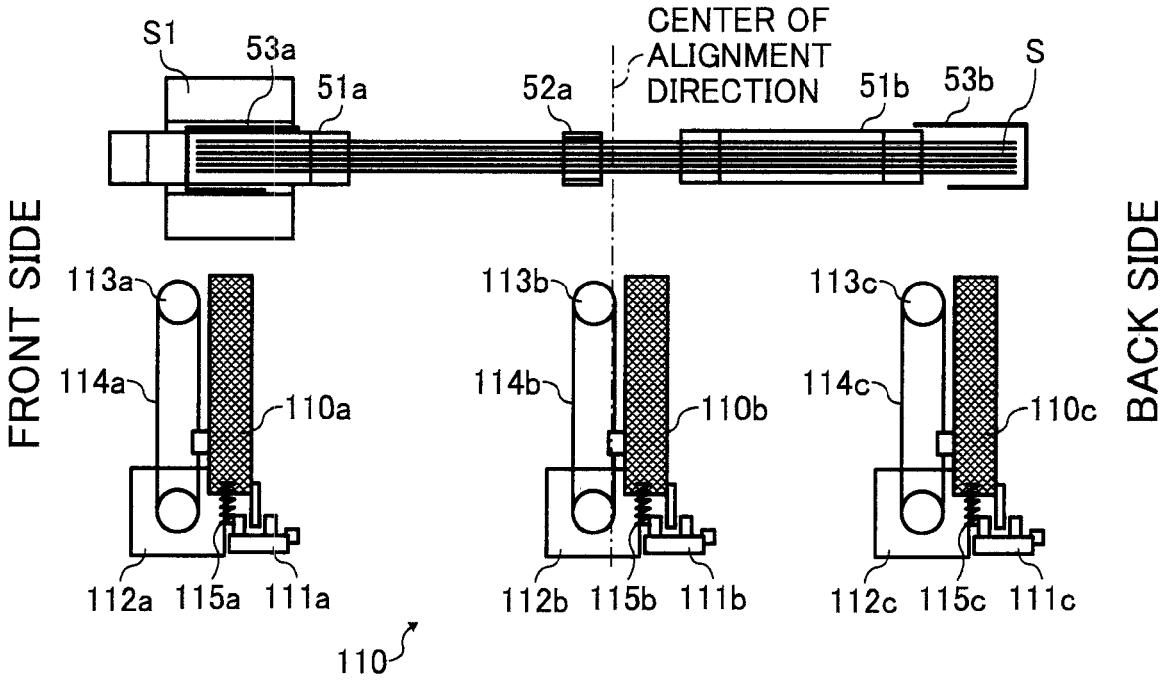
FIG. 16 is a schematic structure of the sheet stack trailing end holding mechanism, seen from a direction indicated by arrow "A" in FIG. 15.

As shown in FIG. 16, the first, second, and third trailing end holding levers 110*a*, 110*b*, and 110*c* of the trailing end holding unit 110 may be disposed at the front, center, and back sides of the sheet finishing apparatus PD2, respectively.

Next, operations of the trailing end holding unit 110 are described.

The first trailing end holding lever 110*a* may operate with a home sensor 111*a*, a trailing end holding lever motor 112*a*, a pulley 113*a*, a timing belt 114*a*, and a spring 115*a*.

The second trailing end holding lever 110*b* may operate with a home sensor 111*b*, a trailing end holding lever motor 112*b*, a pulley 113*b*, a timing belt 114*b*, and a spring 115*b*.

The third trailing end holding lever 110*c* may operate with a home sensor 111*c*, a trailing end holding lever motor 112*c*, a pulley 113*c*, a timing belt 114*c*, and a spring 115*c*.

Since each of the first, second, and third trailing end holding levers 110*a*, 110*b*, and 110*c* may basically have a similar structure, the following description will be made focusing on the first trailing end holding lever 110*a* disposed at the front side of the sheet finishing apparatus PD2 and detailed descriptions of the structures and functions of the second and third trailing end holding levers 110*b* and 110*c* are omitted.

The first trailing end holding lever 110*a* may be fixed to the timing belt 114*a*. The timing belt 114*a* may be extended by the trailing end holding lever motor 112*a* and the pulley 113*a*, and rotate according to the rotations of the trailing end holding lever motor 112*a*.

The trailing end holding lever 110*a* may include an interrupter, which has a protruding shape and is disposed at one end of the trailing end holding lever 110*a*. By blocking the home sensor 111*a* by the interrupter, the home position of the trailing end holding lever 110*a* can be detected. The home position of the trailing end holding lever 110*a* may move to and stand by at a given position at which the end face binding stapler S1 can avoid interference with the first trailing end holding lever 110*a* to perform its next operation when moving in a sheet width direction for binding or stapling the end face of the sheet stack, which is a direction indicated by an arrow shown in FIG. 13.

A distance of movement for pressing and holding the trailing end of the sheet stack S in a sheet pressing direction indicated by a bi-directional arrow "B" shown in FIG. 15 may be determined according to the number of pulses input to the trailing end holding lever motor 112*a*. The leading end of the trailing end holding lever 110*a* may contact the surface of the sheet stack S and push the sheet stack S until the expanded volume at the trailing end of the sheet stack is reduced to a normal volume.

The variation in thickness of the sheet stack S supported by the trailing end fence 51 may be controlled to absorb with expansion and contraction of the spring 115*a*.

As previously described, respective operations of the trailing end holding levers 110*b* and 110*c* are basically identical to the above-described operation performed by the trailing end holding lever 110*a*.

Figure 17:
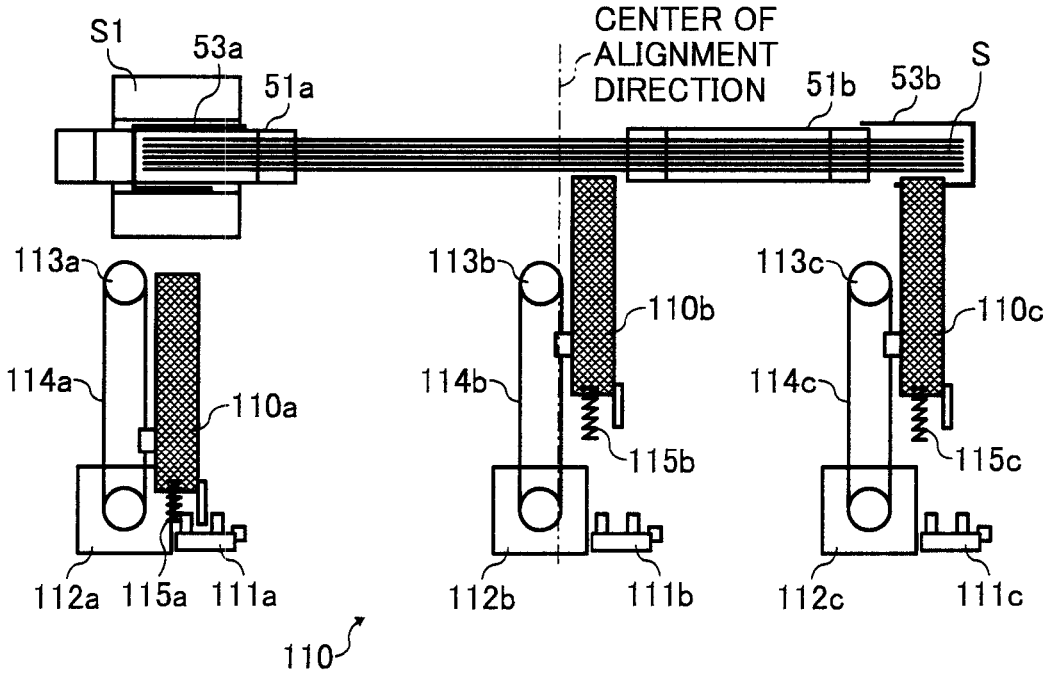
FIG. 17 is a schematic view showing a position of the end face binding stapler.
Figure 18:
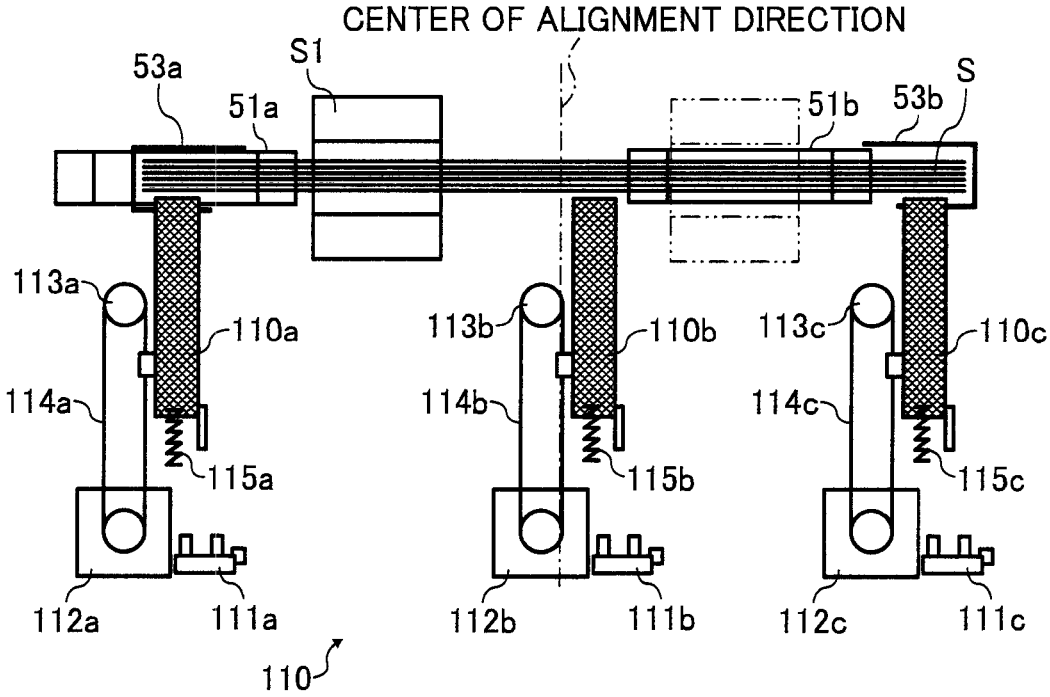
FIG. 18 is a schematic view showing a different position of the end face binding stapler of FIG. 17.
Figure 19:
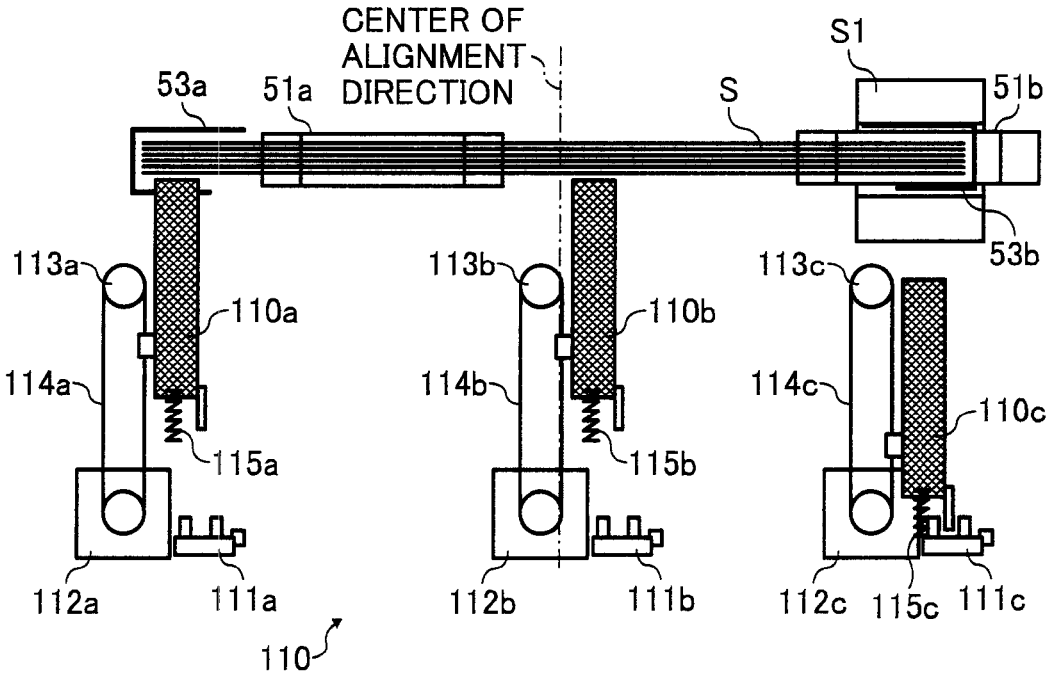
FIG. 19 is a schematic view showing a different position of the end face binding stapler of FIG. 17.

In FIGS. 17 through 19, respective positions of the end face binding stapler S1 in each binding mode are shown. Specifically, FIG. 17 shows the position of the end face binding stapler S1 in a front end face binding mode, FIG. 18 shows the position in a two place binding mode, and FIG. 19 shows the position in a back end face binding mode.

The end face binding stapler S1 may need to avoid interference with the trailing end holding levers 110*a*, 110*b*, and 110*c* while standing by in each binding mode. The trailing end holding levers 110*b* and 110*c* may move in the front end face binding mode as shown in FIG. 17. The trailing end holding levers 110*a*, 110*b*, and 110*c* may move in the two place binding mode as shown in FIG. 18. The trailing end holding levers 110*a* and 110*b* may move in the back end face binding mode as shown in FIG. 19. Each operation timing of the trailing end holding levers 110*a*, 110*b*, and 110*c* may be set to a period from a time that one paper sheet S discharged in the trailing end fences 51 is aligned in the sheet width direction by the first and second jogger fences 53*a* and 53*b* to a time that the following paper sheet S is aligned in the sheet travel direction by the knock roller 12.

<Sheet Stack Steering Mechanism>

Figure 20:
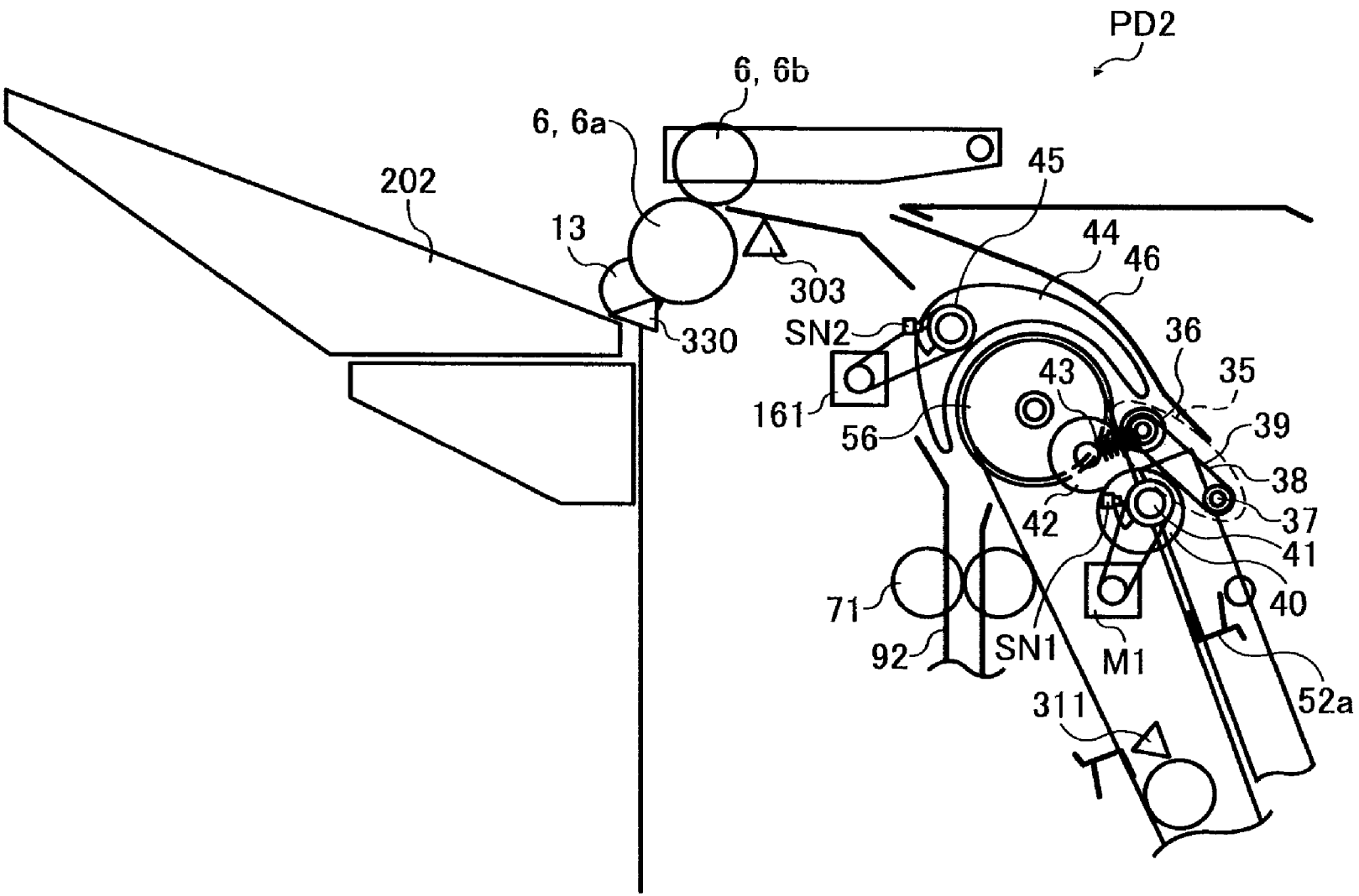
FIG. 20 is a schematic structure of a sheet stack steering mechanism included in the sheet finishing apparatus of FIG. 6.

Referring to FIG. 20, a schematic structure of a sheet stack steering mechanism is described.

FIG. 20 is an enlarged view of the sheet stack steering mechanism, showing the end face binding processing tray F and the folding processing tray G in the sheet finishing apparatus PD2 according to an example embodiment of the present invention.

As shown in FIGS. 6 and 20, the sheet stack steering mechanism conveys a paper sheet S or a sheet stack S in a conveying path from the end face binding processing tray F to the folding processing tray G or in a conveying path from end face binding processing tray F to the shift tray 202. The sheet stack steering mechanism includes a conveying mechanism 35, the plurality of sheet discharging rollers 56, and the turn guide member 44.

The conveying mechanism 35 may apply a conveying force to the sheet stack S.

The plurality of sheet discharging rollers 56 may turn and change the direction of the sheet stack. Hereinafter, the plurality of sheet discharging rollers 56 may also be referred to in a singular form as the "sheet discharging roller 56."

The turn guide member 44 may guide a turn section of the sheet stack S.

As detailed structures of the end face binding processing tray F and the folding processing tray G, as shown in FIG. 20, a driving force of a driving shaft 37 may be transmitted to a roller 36 of the conveying mechanism 35 by a timing belt 38. The roller 36 and the driving shaft 37 may be coupled and supported by an arm 39 and can move with the driving shaft 37 as a rotation fulcrum. A rotational movement of the roller 36 of the conveying mechanism 35 may be performed by a cam 40 that serves as a rotation drive mechanism. The cam 40 may rotate around a rotation shaft 41 and a driving force for the cam 40 may be transmitted from a motor M1 that serves as a rotation drive mechanism.

A home position of the cam 40, which rotationally moves the conveying mechanism 35, may be detected by a sensor SN1. A rotation angle from the home position may be controlled by adding sensors in FIG. 20 or may be adjusted according to pulse control by the motor M1.

Figure 21A:
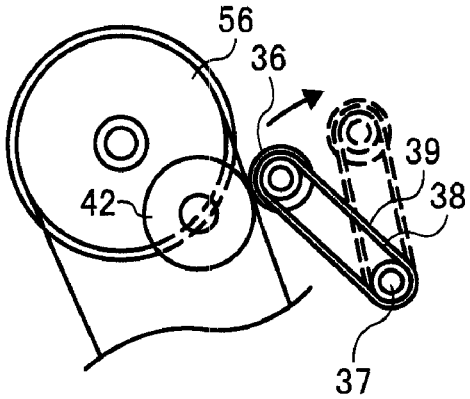
FIG. 21A is a drawing showing an example of action of the sheet stack steering mechanism of FIG. 20.
Figure 21B:
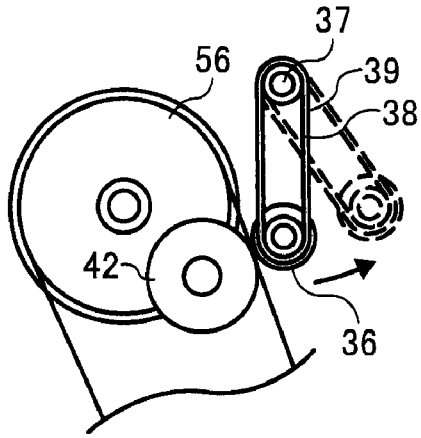
FIG. 21B is a drawing showing another example of action of the sheet stack steering mechanism of FIG. 20.

The structure of the conveying mechanism 35 may be one of two structures as shown in FIGS. 21A and 21B. Specifically, the driving shaft 37 may be arranged at an upstream side in a sheet travel direction as shown in FIG. 21A or at a downstream side in a sheet travel direction as shown in FIG. 21B. These two structures have identical function to each other, and either one of the structures can be selected according to a layout of the conveying mechanism 35 with respect to other mechanism.

Figure 22:
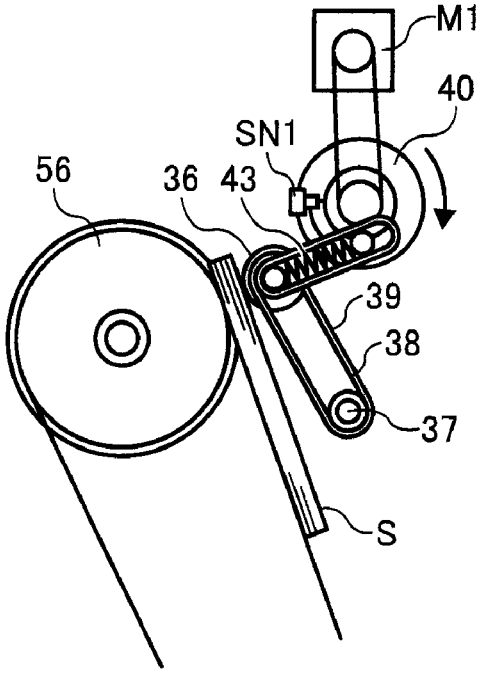
FIG. 22 is a drawing showing another example of action of the sheet stack steering mechanism of FIG. 20.

FIG. 20 further includes a driven roller 42 that is arranged in a position of the conveying mechanism 35 opposite to the roller 36. A sheet stack S may be nipped by the driven roller 42 and the roller 36 and be pressed by an elastic member 43 formed by, for example, a tension spring and applied with a conveying force. As thickness of the sheet stack S increases, a larger conveying force, i.e., a larger pressing force may be needed. Thus, as shown in the structure of FIG. 22, the roller 36 of the conveying mechanism 35 may be pressed against a sheet stack S by the cam 40 biased by the elastic member 43 so that a pressing force can be adjusted according to a pressing angle of the cam 40.

Figure 23A:
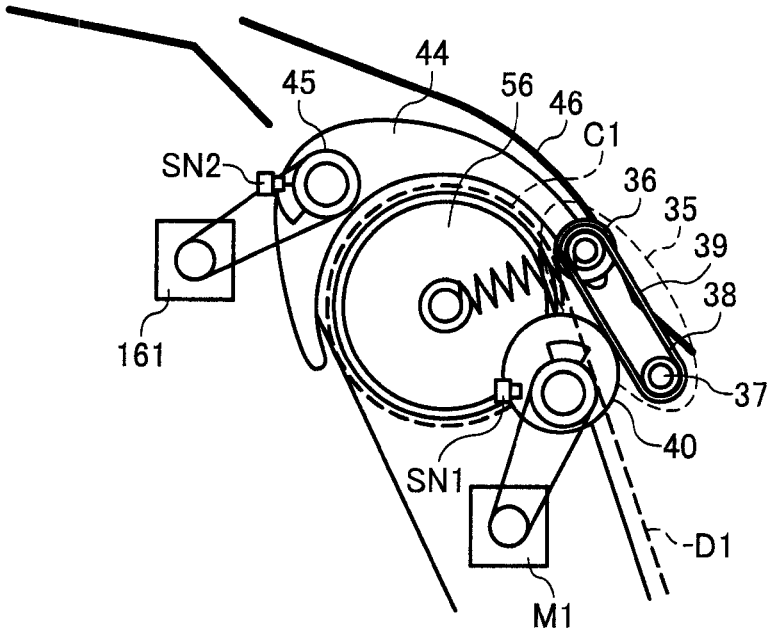
FIG. 23A is a drawing showing an example of sheet steering action of the sheet steering mechanism of FIG. 20.

As shown in FIG. 23A, it is also possible to cause the sheet discharging roller 56 to also function as the driven roller 42 opposed to the roller 36 of the conveying mechanism 35 in FIG. 20. However, in this case, it is preferable that a nip position between the roller 36 and the sheet discharging roller 56 is set to a contact position at which a stack conveyance locus line D1 and an eccentric circle C1 of the sheet discharging roller 56 come into contact with each other or set in the vicinity of the contact position.

As previously described, the conveying path that conveys a sheet stack S from the end face binding processing tray F to the folding processing tray G includes the sheet discharging roller 56 and the turn guide member 44 on the opposite side of the sheet discharging roller 56.

The turn guide member 44 rotates around a fulcrum 45 and a driving force for the turn guide member 44 is transmitted from a sheet stack separation motor 161 (see FIG. 10). A home position of the turn guide member 44 is detected by a sensor SN2.

Figure 23B:
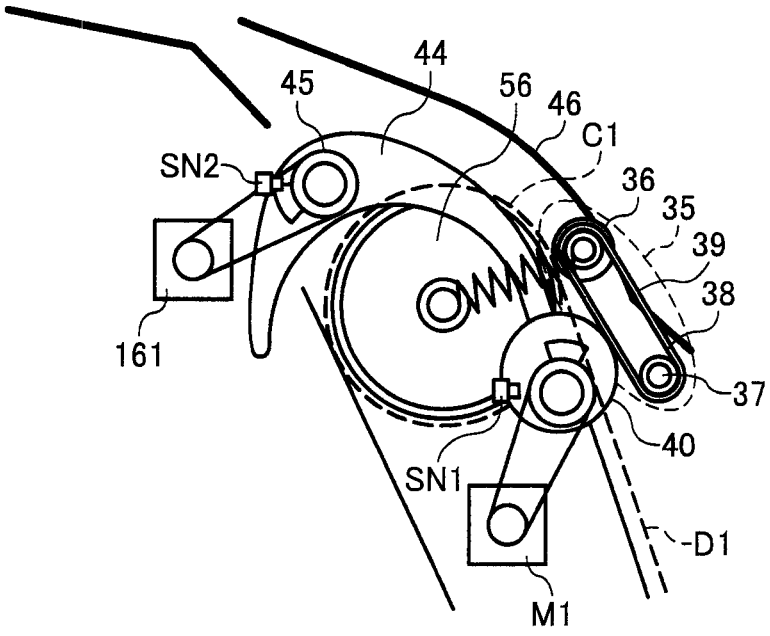
FIG. 23B is a drawing showing another example of sheet steering action of the sheet steering mechanism of FIG. 20.

A conveying path that conveys a sheet stack S from the end face binding processing tray F to the shift tray 202 serving as a stacking unit is formed by the turn guide member 44 and a guide plate 46 in a state in which the turn guide member 44 rotates in the clockwise direction around the fulcrum 45 as shown in FIG. 23B.

Referring to FIGS. 24 through 27, basic operations of the sheet stack steering mechanism of the sheet finishing apparatus PD2 are described.

The sheet stack steering mechanism shown in FIGS. 24 through 27 includes the conveying mechanism 35, the turn guide member 44, and the discharging roller 56.

Figure 24:
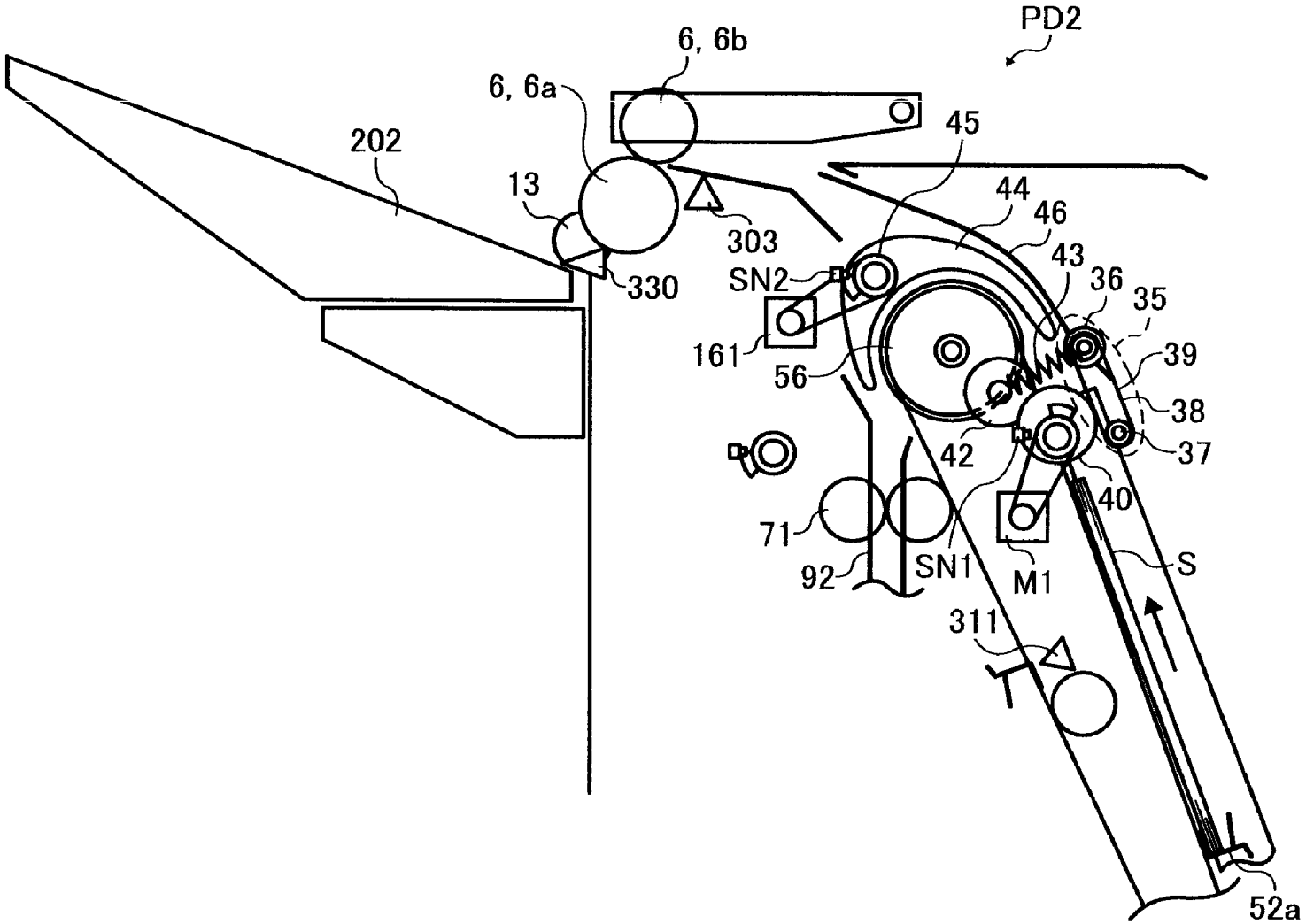
FIG. 24 is a drawing showing an example of sheet conveying action of the sheet steering mechanism of FIG. 20.

When a sheet stack S is sent from the end face binding processing tray F to the folding processing tray G, as shown in FIG. 24, a trailing end of a sheet stack S aligned by the trailing end fences 51 and the jogger fences 53 in the end face binding processing tray F may be pushed up by the hook 52*a*. The sheet stack S may be nipped by the roller 36 of the conveying mechanism 35 located above the end face binding processing tray F and the driven roller 42 opposed to the roller 36, and apply a conveying force to the sheet stack S. In this case, the roller 36 of the conveying mechanism 35 located on a leading end side of the sheet stack S is in a standby state in a position at which the roller 36 does not bump against the leading end of the sheet stack S.

Figure 25A:
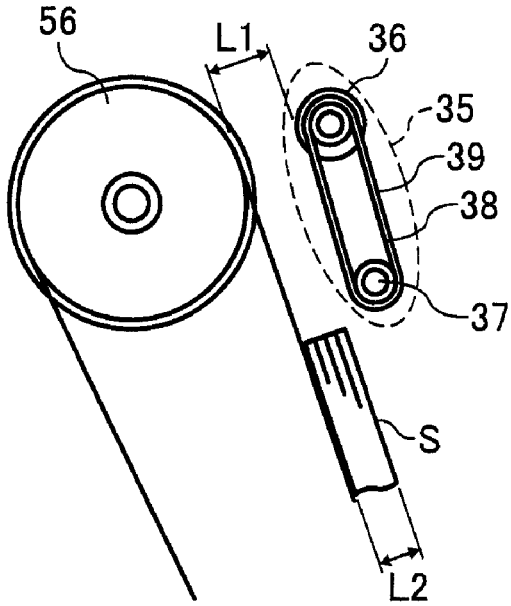
FIG. 25A is a drawing showing an example of action of a conveying mechanism included in the sheet steering mechanism of FIG. 20.
Figure 25B:
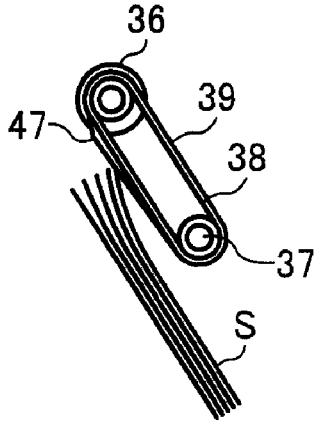
FIG. 25B is a drawing showing another example of action of a conveying mechanism included in the sheet steering mechanism of FIG. 20.

As shown in a drawing for explaining relative positions of the discharging roller 56 and the conveying mechanism 35 in FIG. 25A, a distance L1 is set larger than a maximum thickness L2 of the sheet stack S conveyed from the end face binding processing tray F to the folding processing tray G to prevent collision of the leading end of the sheet stack S and the roller 36. The distance L1 is a distance between a surface on which the sheet stack S is stacked during alignment in the end face binding processing tray F or a surface to which the sheet stack S is guided when the sheet stack S is pushed up by the hook 52*a* and the roller 36.

Since the thickness of the sheet stack S changes according to the number of paper sheets aligned in the end face binding processing tray F and a sheet type, a position at least needed for avoiding collision of the roller 36 and the leading end of the sheet stack DD may also change.

Thus, if a retracting position is varied according to information on the number of paper sheets S and the sheet type, it is also possible to set time for moving from the retracting position to a position at which a conveying force is applied to a necessary minimum time. This may advantageously work for productivity. The information on the number of paper sheets S and the sheet type may be job information from the main body or may be obtained by a sensor in the sheet finishing apparatus PD2. However, when curl larger than anticipated occurs in the sheet stack S aligned by the end face binding processing tray F, it is conceivable that the leading end of paper sheets and the roller 36 come into contact with each other when the sheet stack S is pushed up by the hook 52*a*. Thus, as shown in an enlarged view of a main part of the conveying mechanism 35 in FIG. 25B, a conveyance support member 47 is provided immediately before the roller 36 to reduce an angle of contact between the leading end of the paper sheets and the roller 36. An effect of the conveyance support member 47 may not be different whether the conveyance support member 47 is a fixed member or an elastic member.

Figure 26:
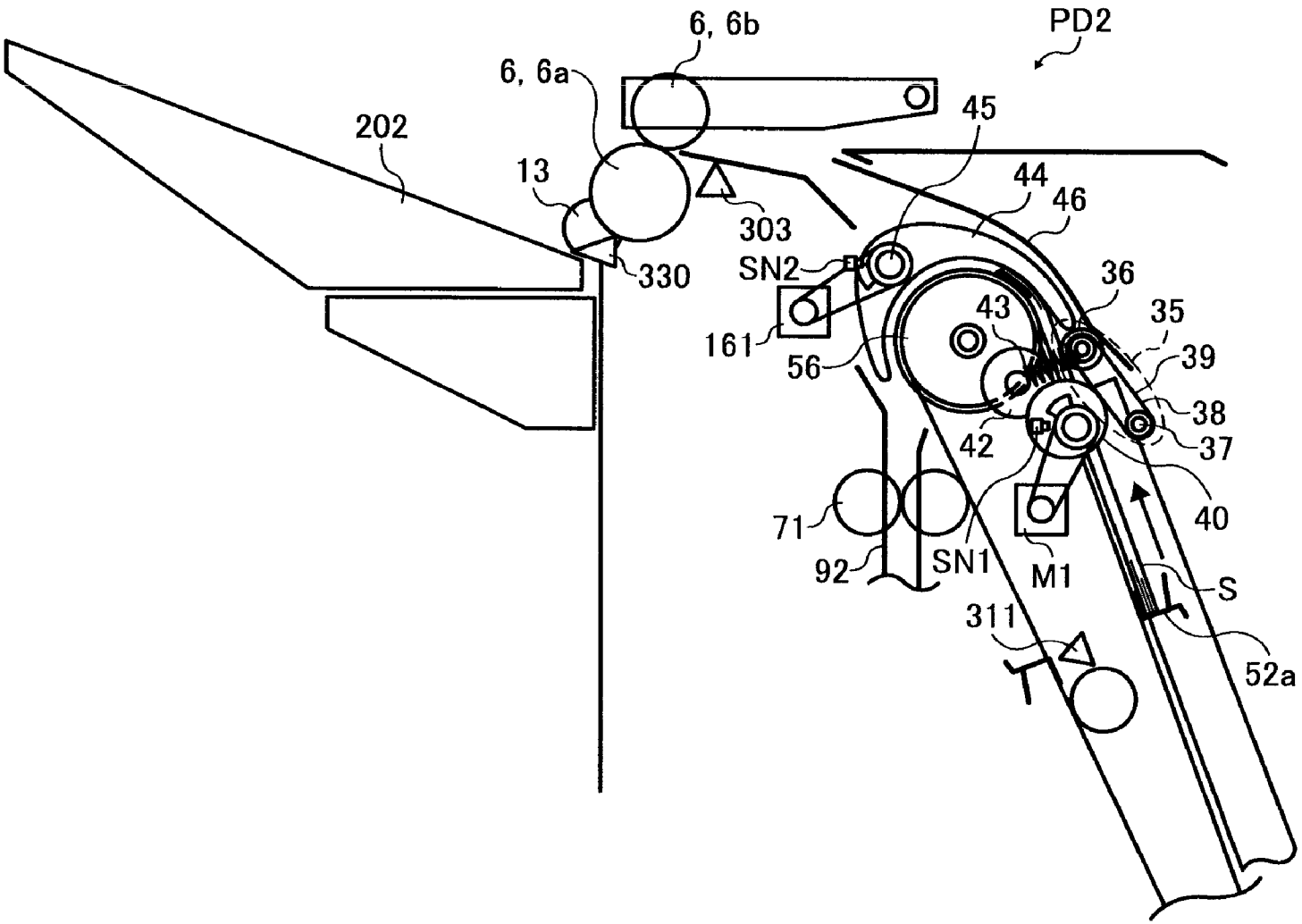
FIG. 26 is a drawing showing another example of sheet conveying action of the sheet steering mechanism of FIG. 20.

As shown in FIG. 26 in which a main part of the sheet stack steering mechanism during the steering operation of the paper sheets S is shown, the roller 36 of the conveying mechanism 35 may be brought into contact with the surface of the paper sheets S to apply a conveying force to the sheet stack S after the leading end of the sheet stack S passes the conveying mechanism 35. In this case, a guide for a turn section may be formed by the turn guide member 44 and the discharging roller 56, and the sheet stack S may be conveyed to the folding processing tray G on the downward side along this guide.

Figure 27:
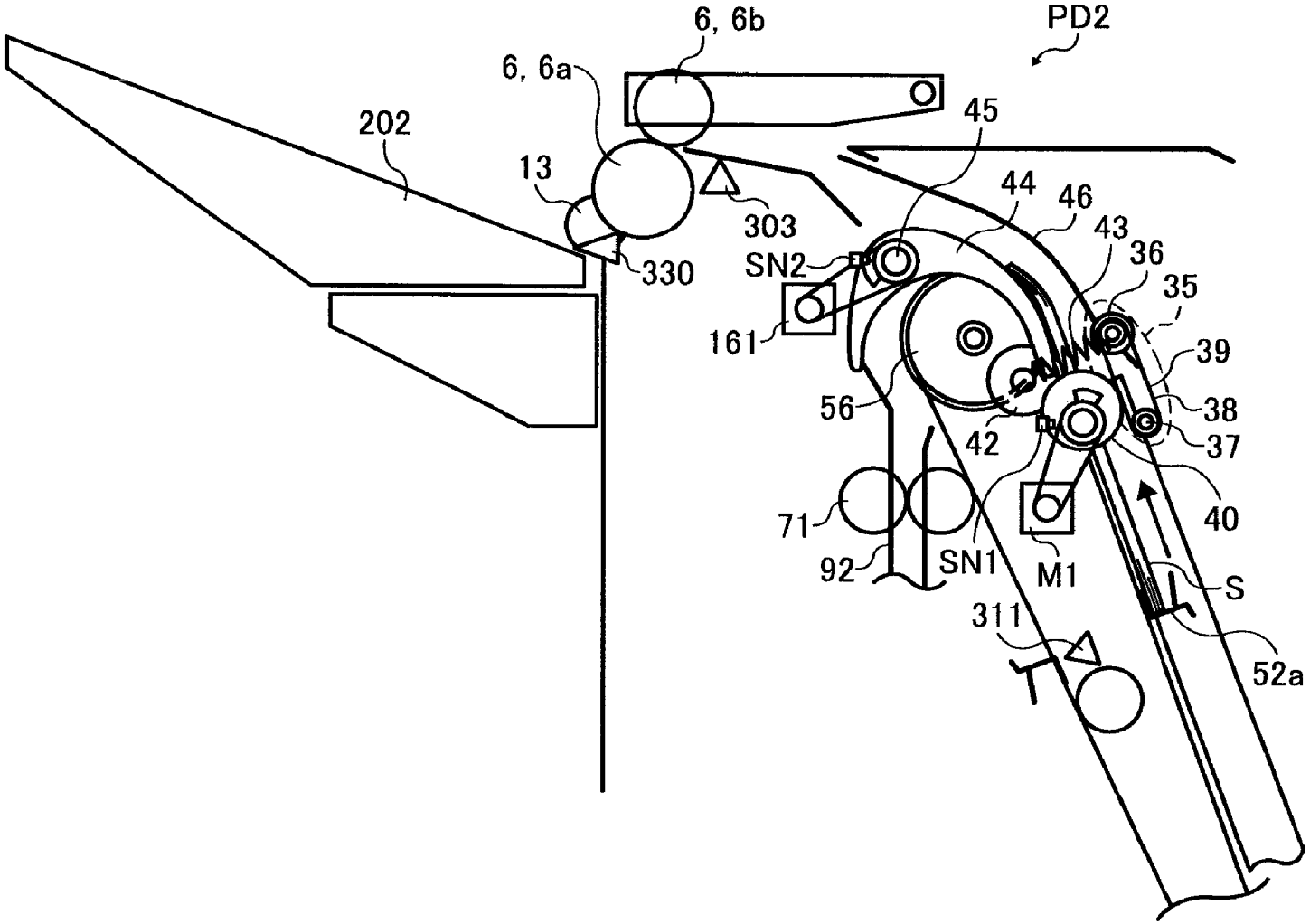
FIG. 27 is a drawing showing another example of sheet conveying action of the sheet steering mechanism of FIG. 20.

Referring to FIG. 27, a schematic structure of the main part of the sheet stack steering mechanism during conveyance of a sheet stack S from the end face binding processing tray F to the shift tray 202 side is described.

When the sheet stack S is conveyed from the end face binding processing tray F to the shift tray 202, as shown in FIG. 27, the turn guide member 44 may be rotated in the clockwise direction in FIG. 27, which is further beyond the angle for the folding processing tray G shown in FIG. 26, and a conveying path connected to the shift tray 202 may be formed by the outer peripheral surface of the turn guide member 44 and the guide plate 46. A trailing end of the sheet stack S aligned by the end face binding processing tray F may be pushed up by the hook 52*a* and the sheet stack S may be conveyed to the shift tray 202. In this case, the roller 36 of the conveying mechanism 35 may not apply a conveying force.

When the discharging roller 56 is a driven roller that is not driven by a driving roller driving by a motor and follows conveyance of the sheet stack S, it is possible to deflect the sheet stack S and convey the sheet stack S to the folding processing tray G side and the sheet stack shift tray 202 side.

(Folding Processing Tray)

Center binding and center folding are performed in the folding processing tray G provided on a downstream side of the end face binding processing tray F. A sheet stack S is guided from the end face binding processing tray F to the folding processing tray G by the sheet stack steering mechanism.

Structures of the center binding tray and the center folding processing tray are explained below.

As shown in FIG. 6, the folding processing tray G is provided on a downstream side of the sheet stack steering mechanism including the conveying mechanism 35, the turn guide member 44, and the discharging roller 56.

The folding processing tray G is provided substantially vertically on the downstream side of the sheet stack steering mechanism. The center folding mechanism, an upper stack conveying guide plate 92, and a lower stack conveying guide plate 91 are arranged in the center, above, and below the folding processing tray G, respectively. A pair of upper stack conveying rollers 71 and a pair of lower stack conveying rollers 72 are provided above and below the upper stack conveying guide plate 92, respectively.

The center binding upper jogger fences 250*a* are arranged on both sides of the upper stack conveying guide plate 92 astride over both the stack conveying rollers 71 and 72. Similarly, the center binding lower jogger fences 250*b* are provided on both sides of the lower stack conveying guide plate 91.

The center binding stapler S2 may be arranged in a place on which the center binding lower jogger fences 250*b* are set. The center binding upper jogger fence 250*a* and the center binding lower jogger fence 250*b* are driven by a driving mechanism (not shown) and perform a sheet alignment operation in a direction perpendicular to the sheet travel direction or the sheet width direction.

The center binding stapler S2 includes a pair of a clincher section and a driver section. Two pairs of the center binding staplers S2 may be provided at a given interval in the sheet width direction. Although the two pairs of the center binding staplers S2 are provided in a fixed state here, it is also possible to move one pair of the clincher section and the driver section in the sheet width direction to bind paper sheets S in two places.

A movable trailing end fence 73 is arranged to traverse the lower stack conveying guide plate 91 in FIG. 6. The movable trailing end fence 73 is movable in the sheet travel direction (a vertical direction in FIG. 6) by a timing belt and a driving mechanism therefore.

The driving mechanism includes, as shown in FIG. 6, a driving pulley and a driven pulley over which the timing belt is laid and a stepping motor that drives the driving pulley. Similarly, a trailing end tapping hook 251 and a driving mechanism therefore may be provided on an upper end side of the upper stack conveying guide plate 92. The trailing end tapping hook 251 is reciprocally movable by a timing belt 252 and the driving mechanism (not shown) in a direction away from the sheet stack steering mechanism and a direction in which the trailing end tapping hook 251 pushes a trailing end of a sheet stack at the time when a sheet stack is lead in.

In FIG. 6, a home position sensor 326 detects a home position of the trailing end tapping hook 251.

The center folding mechanism is provided substantially in the center of the folding processing tray G. The center folding mechanism includes the folding plate 74, the pair of folding rollers 81, and the conveying path H for conveying a folded sheet stack S.

(Folding Plate and the Operation Mechanism)

Figure 28A:
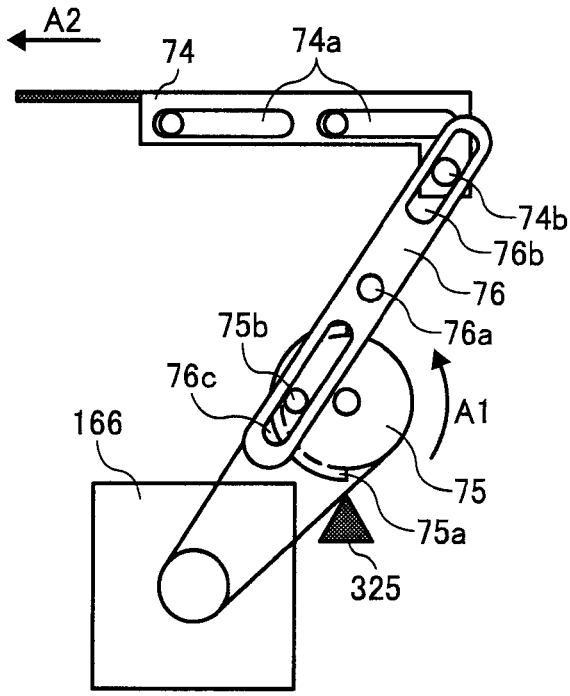
FIG. 28A is a drawing showing an example of action of a folding plate and an operation mechanism included in the sheet steering mechanism of FIG. 20.
Figure 28B:
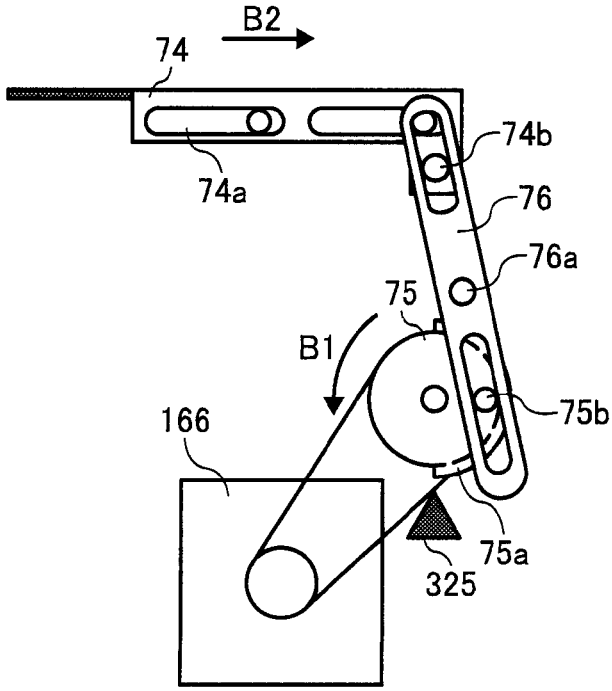
FIG. 28B is a drawing showing another example of action of a folding plate and an operation mechanism included in the sheet steering mechanism of FIG. 20.

Referring to FIGS. 28A and 28B, schematic structures of the folding plate 74 and the operation mechanism are described.

The folding plate 74 is supported by loosely fitting two shafts mounted in a standing manner on front and rear side plates (not shown), respectively, in long hole sections 74*a* thereof. A shaft section 74*b* standing from the folding plate 74 is loosely fit in a long hole section 76*b* of a link arm 76, and the link arm 76 swings around a fulcrum 76*a* thereof, whereby the folding plate 74 reciprocally moves to the left and right in FIGS. 28A and 28B. A shaft section 75*b* of a folding plate driving cam 75 is loosely fit in a long hole section 76*c* of the link arm 76. The long hole section 76*c* of the link arm 76 swings according to a rotational motion of the folding plate driving cam 75. A folding plate driving motor 166 causes the folding plate driving cam 75 to rotate in a direction indicated by arrows A1, A2, B1, and B2 in FIGS. 28A and 28B. The stop position of the folding plate driving cam 75 may be determined on the basis of the output of a folding plate HP sensor 325 responsive to the opposite ends of a semicircular interrupter section 75*a* included in the folding plate driving cam 75.

FIG. 28A shows the folding plate 74 in the home position where the folding plate 74 is fully retracted from the sheet stack storing range of the folding processing tray G. When the folding plate driving cam 75 is rotated in the direction indicated by arrow A1 in FIG. 28A, the folding plate 74 may be moved in the direction indicated by arrow A2 and enters the sheet stack storing range of the folding processing tray G.

FIG. 28B shows a position at which the folding plate 74 pushes the center of a sheet stack on the folding processing tray G into the nip formed between the pair of folding rollers 81. When the folding plate driving cam 75 is rotated in a direction indicated by arrow B1, the folding plate 74 may move in a direction indicated by arrow B2 out of the sheet stack storing range of the folding processing tray G.

In this example embodiment according to the present invention, center folding is performed on condition that a sheet stack is bound or stapled. However, the present invention is applicable when one sheet is folded. Since center binding is unnecessary for the one sheet, the one sheet may be delivered to the folding processing tray G side when the one sheet is discharged. Folding processing is executed by the folding plate 74 and the pair of folding rollers 81 to discharge the sheet onto the lower tray 203 from a pair of sheet discharging rollers 83 (see FIG. 6).

The folding processing tray G further includes a stack detection sensor 321, a movable trailing end fence HP sensor 322, and a folding unit passage sensor 323.

The stack detection sensor 321 detects that a sheet stack S reached a center folding position. The movable trailing end fence HP sensor 322 detects a home position of the movable trailing end fence 73. The folding unit passage sensor 323 detects center folded paper sheets.

In this example embodiment according to the present invention, a detecting lever 501 that detects a stacking height of a center folded sheet stack is provided in the lower tray 203 to be swingable around a fulcrum 501*a*. An angle of the detecting lever 501 may be detected by a sheet surface sensor 505 to perform an operation for lifting and lowering the lower tray 203 and detection of overflow from the lower tray 203.

(Modes and Control Procedures)

Specific operations to be executed in various modes (five modes in this example embodiment) available with the example embodiment will be described hereinafter.

Paper sheets are output according to the following operation modes:

(1) Non-staple mode A: a paper sheet is conveyed via the sheet conveying paths A and B to the upper tray 201 without being stapled;

(2) Non-staple mode B: a paper sheet is routed through the sheet conveying paths A and C to the shift tray 202 without being stapled;

(3) Sort/stack mode: paper sheets are sequentially delivered to the shift tray 202 via the sheet conveying paths A and C. The shift tray 202 is shifted perpendicularly to the direction of sheet discharge copy by copy in order to sort the paper sheets;

(4) Staple mode: paper sheets are conveyed to the end face binding processing tray F via the sheet conveying path A and the sheet finishing path D. A sheet stack including the paper sheets is aligned and stapled on the end face binding processing tray F, and then discharged to the shift tray 202 via the conveying path C; and (5) Center binding and stapling mode: paper sheets are sequentially conveyed to the end face binding processing tray F via the sheet conveying path A and the sheet finishing path D. A sheet stack including the paper sheets is aligned and stapled at the center on the end face binding processing tray F, folded on the folding processing tray G, and then driven out to the lower tray 203 via the sheet conveying path H.

(1) Operations of Non-Staple Mode A

A paper sheet is conveyed via the sheet conveying path A, and sorted and guided by the path selector 15 to the sheet conveying path B. Then, the paper sheet is discharged by the pair of sheet conveying rollers 3 and the pair of sheet discharging rollers 4 to the upper tray 201 without being stapled. An upper sheet discharging sensor 302 may be disposed in the vicinity of the pair of sheet discharging rollers 4 to detect the discharge of a paper sheet. A CPU 360 (see FIG. 38) may cause the upper sheet discharging sensor 302 to monitor the state of the paper sheet to be discharged.

(2) Operations of Non-Staple Mode B

A paper sheet sorted by the path selectors 15 and 16 is guided to the sheet conveying path C. There, the paper sheet is discharged by the pair of sheet conveying rollers 5 and the pair of sheet discharging rollers 6 to the upper tray 201 without being stapled. The shift sheet discharging sensor 303 may be disposed in the vicinity of the pair of sheet discharging rollers 6 to detect the discharge of a paper sheet. The CPU 360 may cause the shift sheet discharging sensor 303 to monitor the state of the paper sheet to be discharged.

(3) Operations of Sort/Stack Mode

Similar to the operations of non-staple mode B, a paper sheet sorted by the path selectors 15 and 16 is guided to the sheet conveying path C, and discharged by the pair of sheet conveying rollers 5 and the pair of sheet discharging rollers 6 to the upper tray 201. At this time, the shift tray 202 may swingably move in a direction perpendicular to the sheet discharging direction for each sheet stack so as to sort a plurality of sheet stacks.

(4) Operations of Staple Mode

A paper sheet sorted by the path selectors 15 and 16 is guided to the sheet finishing path D. There, the paper sheet is discharged by the pairs of sheet conveying rollers 7, 9, and 10 and the pair of staple sheet discharging rollers 11 to the end face binding processing tray F.

In the end face binding processing tray F, the pair of staple sheet discharging rollers 11 may align paper sheets that are sequentially discharged. When the number of discharged paper sheets reaches a given number, the end face binding stapler S1 may perform stapling or binding operation to staple or bind the paper sheets to a sheet stack. Then, the sheet stack stapled or bound by the end face binding stapler S1 may be conveyed to a downward side by the hook 52*a* so as to cause the pair of sheet discharging rollers 6 to discharge the sheet stack to the shift tray 202. The CPU 360 may cause the shift sheet discharging sensor 303 that detects the discharge of the sheet stack to monitor the state of the sheet stack to be discharged.

(Sheet Discharging Operation after Stapling)

As shown in FIG. 11, when the staple mode is selected, the jogger fences 53 each may be moved from the home position to a stand-by position approximately 7 mm short of one end of the width of paper sheets S to be stacked on the end face binding processing tray F. When a paper sheet S being conveyed by the pair of staple sheet discharge rollers 11 passes a staple sheet discharge sensor 305, the jogger fences 53 may move inward from the stand-by position by approximately 5 mm.

Figure 38:
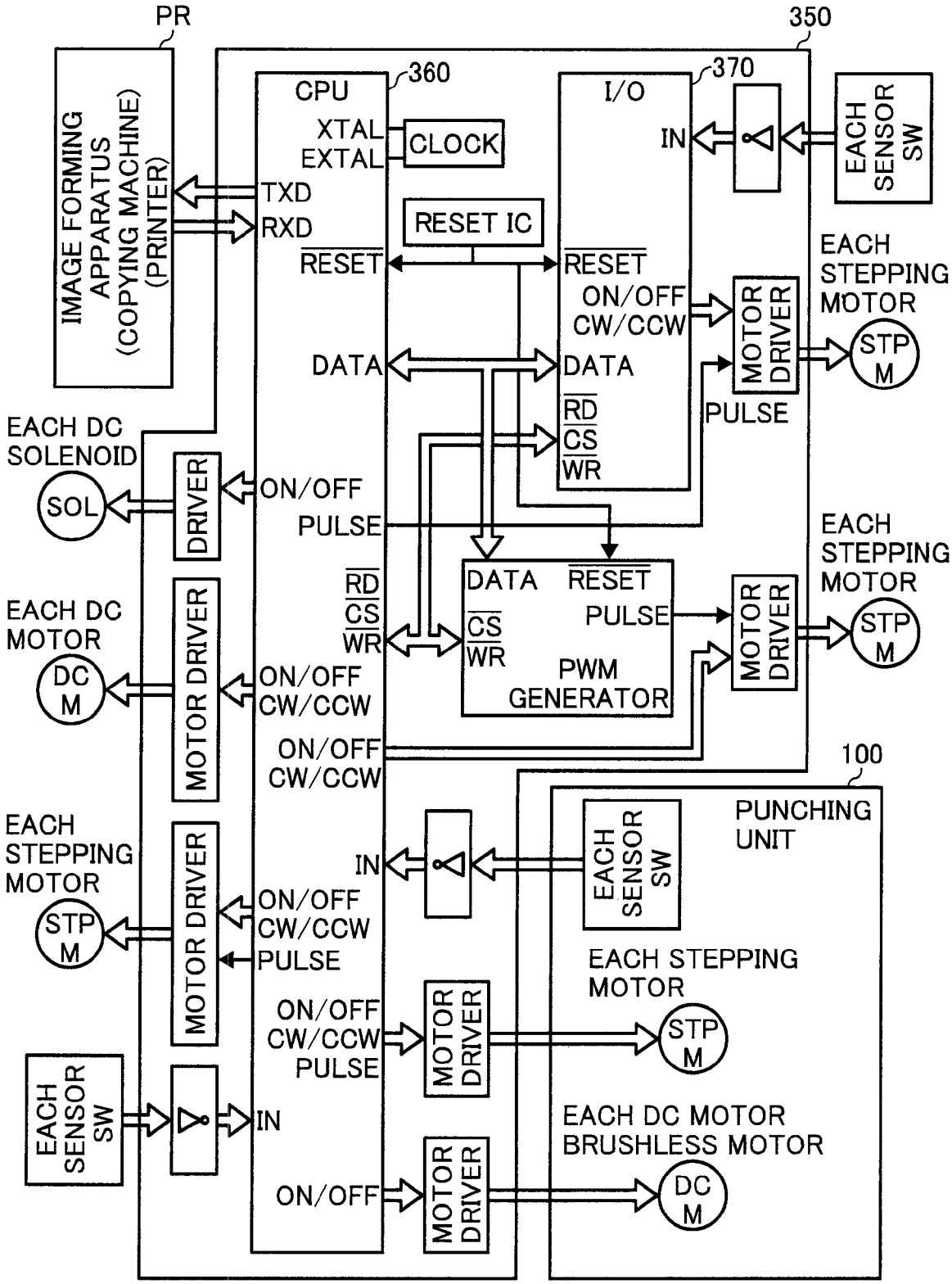
FIG. 38 is a schematic configuration of a control system of the sheet finishing apparatus according to an example embodiment of the present invention.

The staple sheet discharge sensor 305 may sense the trailing end of the paper sheet S and send its output to the CPU 360 (see FIG. 38). In response, the CPU 360 may start counting drive pulses input to the staple motor (not shown) driving the staple discharge roller pair 11. On counting a pre-selected number of pulses, the CPU 360 may energize the solenoid 170. The solenoid 170 may cause the knock roller 12 to contact the paper sheet S and force it downward when energized, so that the paper sheet S may be positioned by the trailing end fences 51. Every time a paper sheet S to be stacked on the end face binding processing tray F passes the inlet sensor 301 or the staple sheet discharging sensor 305, the output of the inlet sensor 301 or the staple sheet discharging sensor 305 may be sent to the CPU 360, causing the CPU 360 to count the paper sheets S.

On the elapse of a pre-selected period of time since the knock solenoid 170 has been turned off, the CPU 360 may cause the jogger motor 158 to move each jogger fence 53 further inward by approximately 2.6 mm and then stop it, thereby aligning the paper sheet S in the sheet width direction. Subsequently, the CPU 360 may move the jogger fences 53 outward by approximately 7.6 mm to the stand-by position and then wait for the next paper sheet. The CPU 360 may repeat such a procedure up to the last page. The CPU 360 may again cause the jogger fences 53 to move inward by approximately 7 mm and then stop, thereby causing the jogger fences 53 to retain the opposite ends of the sheet stack S to be stapled. Subsequently, on the elapse of a given period of time, the CPU 360 may drive the end face binding stapler S1 via a staple motor (not shown) for thereby stapling the sheet stack S. If two or more stapling positions are designated, after stapling at one position the CPU 360 may move the end face binding stapler S1 to another designated position along the trailing end of the sheet stack S via the stapler motor 159. At this position, the end face binding stapler S1 may again staple the sheet stack S. This movement may be repeated when three or more stapling positions are designated.

After the stapling operation, the CPU 360 may drive the discharge belt 52 via the discharge motor 157. At the same time, the CPU 360 may drive a sheet discharging motor to cause the pair of sheet discharging rollers 6 to start rotating in order to receive the stapled sheet stack S lifted by the hook 52*a*. At this instant, the CPU 360 may control the jogger fences 53 in a different manner in accordance with the sheet size and the number of sheets stapled together. For example, when the number of sheets stapled together or the sheet size is smaller than a given value, then the CPU 360 may cause the jogger fences 53 to constantly retain the opposite ends of the sheet stack S until the hook 52*a* fully lifts the trailing end of the sheet stack S. When a given number of pulses are output since the turn-on of the sheet presence and absence sensor 310 or the belt HP sensor 311, the CPU 360 may cause the jogger fences 53 to retract by approximately 2 mm and release the sheet stack S. The given number of pulses corresponds to an interval between the time when the hook 52*a* contacts the trailing end of the sheet stack S and the time when it moves away from the upper ends of the jogger fences 53.

On the other hand, when the number of sheets stapled together or the sheet size is larger than the given value, the CPU 360 may cause the jogger fences 53 to retract by approximately 2 mm beforehand. In any case, as soon as the stapled sheet stack S moves away from the jogger fences 53, the CPU 360 may move the jogger fences 53 further outward by approximately 5 mm to the stand-by positions for thereby preparing it for the next paper sheet. If desired, the restraint to act on the sheet stack S may be controlled on the basis of the distance of each jogger fence from the sheet stack S.

(Operations of Center Binding and Stapling Mode)

Referring to FIGS. 29 through 37, operations of center binding and stapling mode are described.

Figure 29:
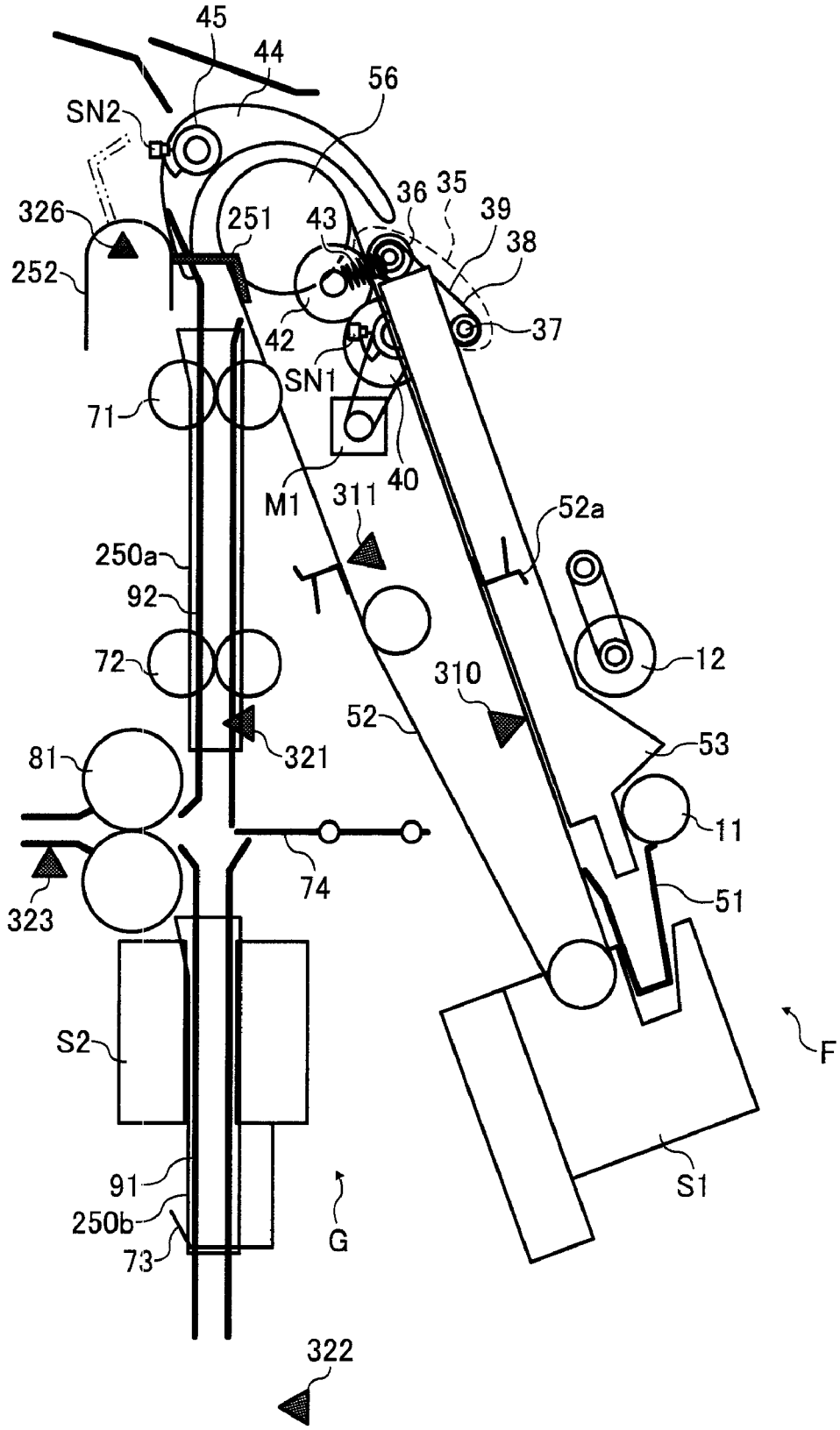
FIG. 29 is a schematic structure of the end face binding processing tray and a folding processing tray.

FIG. 29 is a front view showing the end face binding processing tray F and the folding processing tray G. FIGS. 30 through 37 are drawings showing operations of the center binding and stapling mode.

Figure 30:
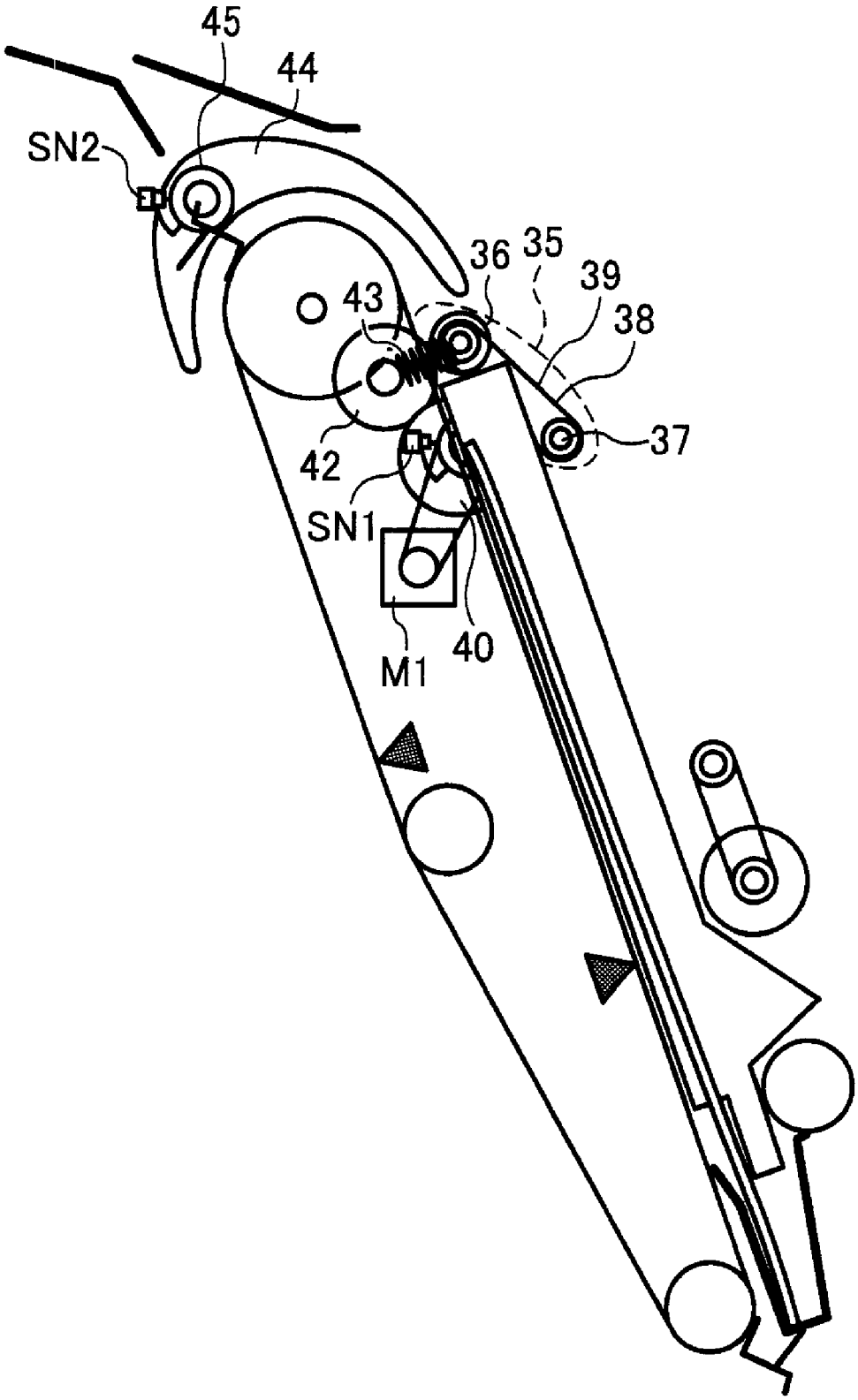
FIG. 30 is a drawing showing an example of action of the end face binding processing tray of FIG. 29.

In FIG. 6, a paper sheet S is steered by the path selectors 15 and 16 from the sheet conveying path A to the sheet finishing path D and then conveyed by the pairs of sheet conveying rollers 7, 9 and 10, and the pair of staple sheet discharging rollers 11 to the end face binding processing tray F, as shown in FIG. 29. The end face binding processing tray F may operate in exactly the same manner as in the staple mode stated earlier before aligning and stapling (see FIG. 30 showing a sheet stack S is aligned by the trailing end fences 51).

Figure 31:
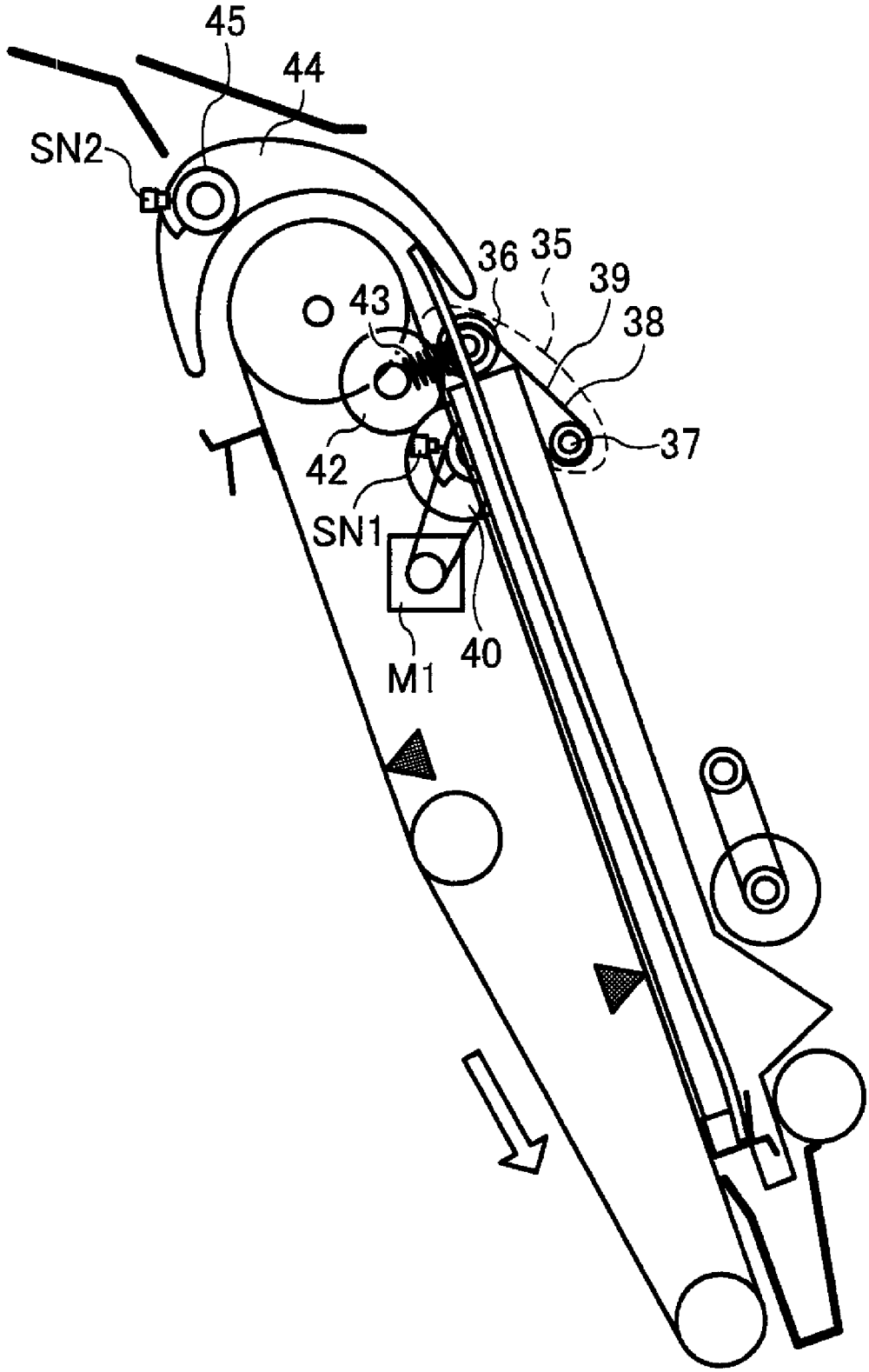
FIG. 31 is a drawing showing another example of action of the end face binding processing tray of FIG. 29.

After the sheet stack S has been provisionally aligned on the end face binding processing tray F, the leading end of the sheet stack S may be lifted up by the hook 52*a*, as shown in FIG. 31. When the roller 36 and the driven roller 42 are separated enough not to interfere the sheet stack S, the sheet stack S may pass therebetween and proceed to a position at which an inner surface of the turn guide member 44 and a circumferential surface of the sheet discharging roller 56.

Figure 32:
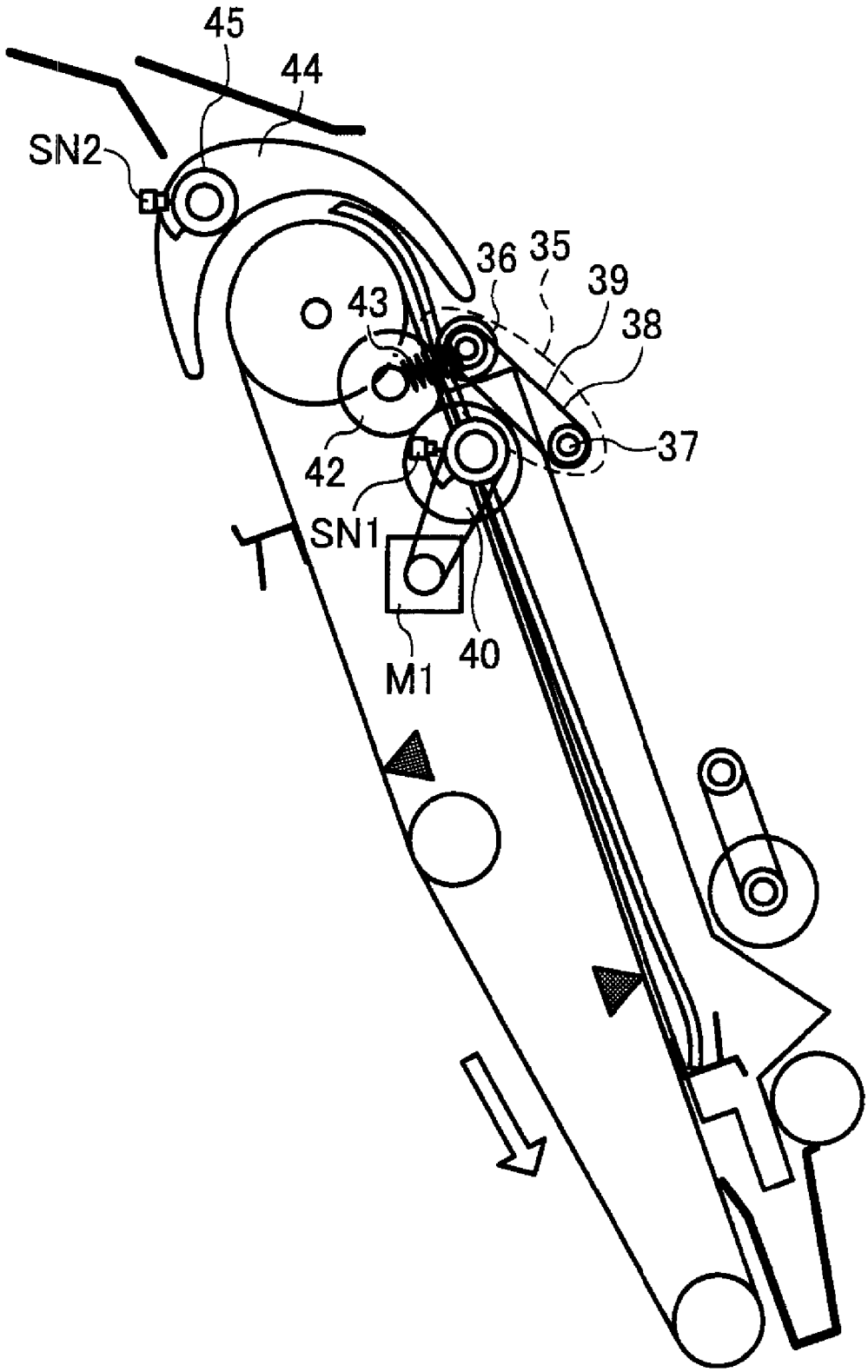
FIG. 32 is a drawing showing another example of action of the end face binding processing tray of FIG. 29.

Then the motor M1 and the cam 40, which are a rotation drive mechanism, may close the roller 36, and the leading end of the sheet stack S may be sandwiched by the roller 36 and the driven roller 42 with a given amount of pressure. The timing belt 38 may transmit a driving force to the roller 36 to rotate. In addition, according to the rotation of the sheet discharging rollers 56, the sheet stack S may be conveyed to the downward direction along the path toward the folding processing tray G, as shown in FIG. 32. The sheet discharging rollers 56 are mounted to a driving shaft (not shown) to be driven in synchronization with the discharge belt 52.

Figure 33:
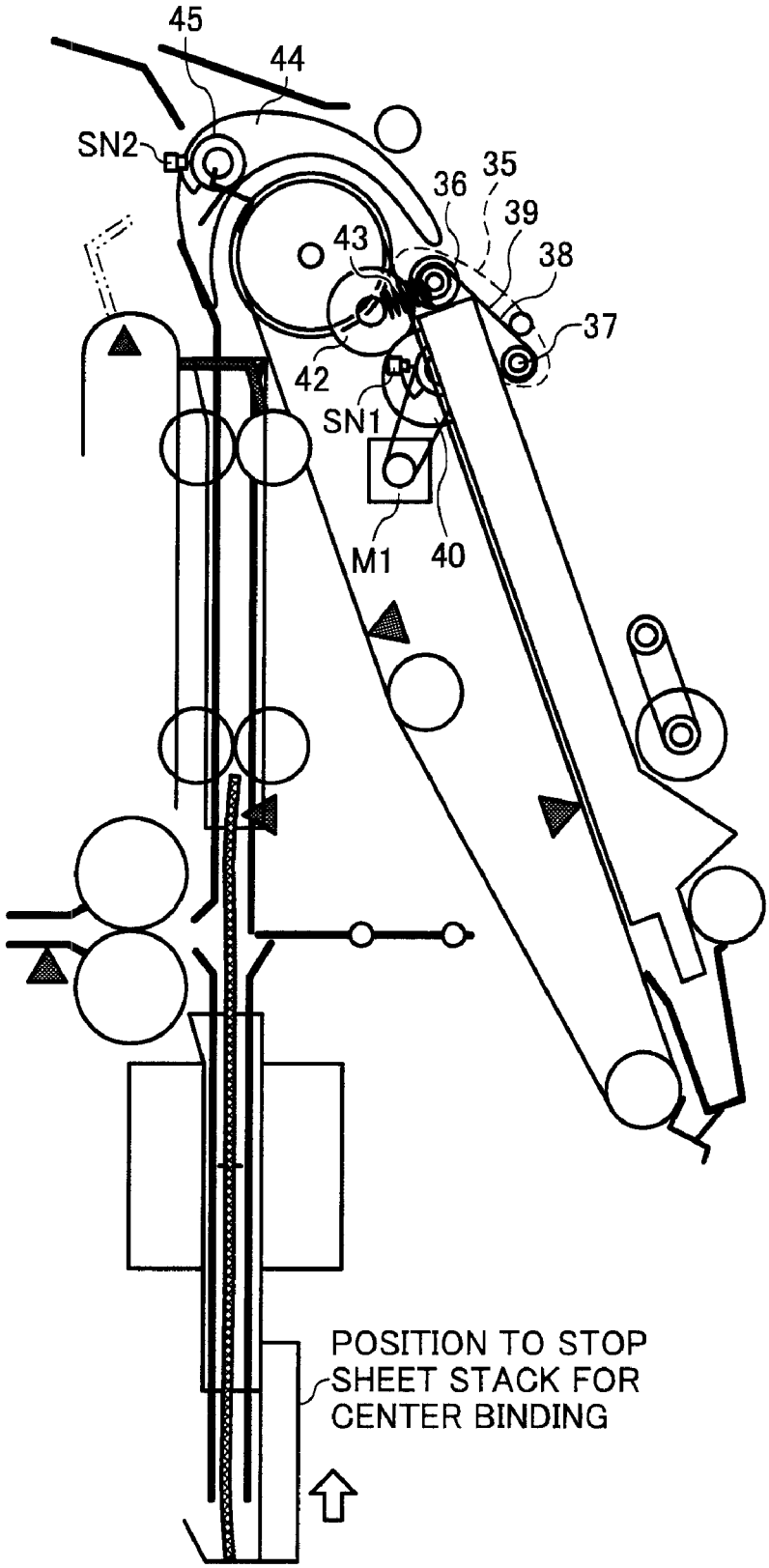
FIG. 33 is a drawing showing an example of action of the folding processing tray of FIG. 29.

The sheet stack S may be conveyed from the position shown in FIG. 32 to the position shown in FIG. 33. Once entering into the folding processing tray G, the sheet stack S may be conveyed by the upper stack conveying rollers 71 and the lower stack conveying rollers 72. At this time, according to the size in the conveying direction of each sheet stack S, the movable trailing end fence 73 may standby at a different stop position.

Figure 34:
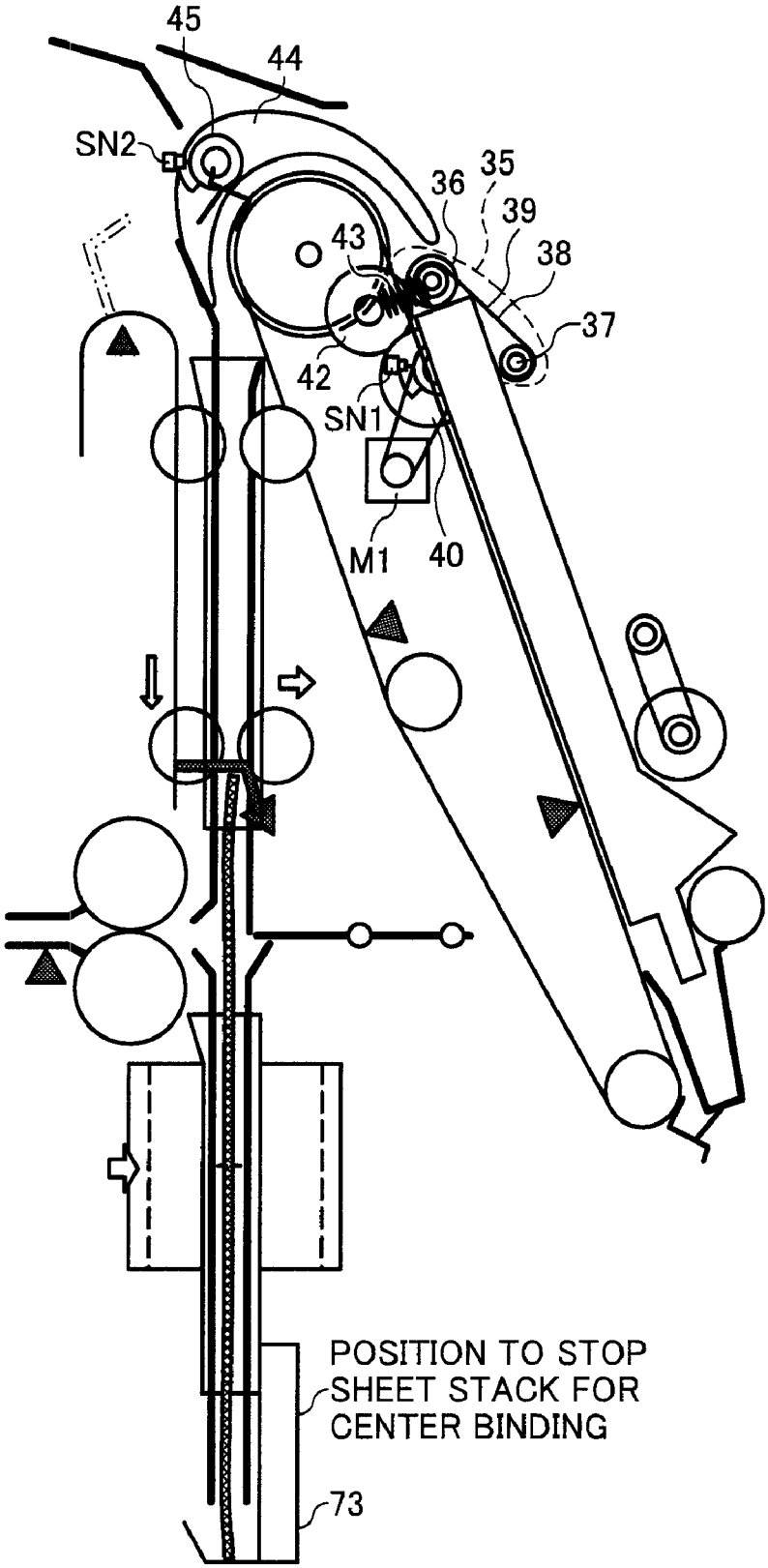
FIG. 34 is a drawing showing another example of action of the folding processing tray of FIG. 29.

When the leading end of the sheet stack S abuts against the movable trailing end fence 73 in the standby condition to be stacked therein, the lower stack conveying rollers 72 may be separated to release the pressure exerted between the lower stack conveying rollers 72 then the trailing end tapping hood 251 may tap the trailing end of the sheet stack S to align the sheet stack S in the sheet travel direction, as shown in FIGS. 33 and 34. The above-described operation may be performed to avoid possible deviation in the sheet stack S during a period from a time that the sheet stack S is provisionally aligned in the end face binding processing tray F to a time that the sheet stack S is stacked to the movable trailing end fence 73. With the above-described operation, the sheet stack S can be finally aligned by the trailing end tapping hood 251.

FIG. 34 shows a center binding position for a sheet stack S. The movable trailing end fence 73 may stand by at the center binding position. The center binding upper jogger fences 250*a* and the center binding lower jogger fences 250*b* may align the sheet stack S in the sheet width direction, and the center binding stapler S2 may bind the sheet stack S at the center portion. The movable trailing end fence 73 may be positioned based on the control of pulses sent from the movable trailing end fence HP sensor 322 (see FIG. 29). The trailing end tapping hook 251 may be positioned based on the control of pulses sent from the trailing end tapping pawl HP sensor 326.

Figure 35:
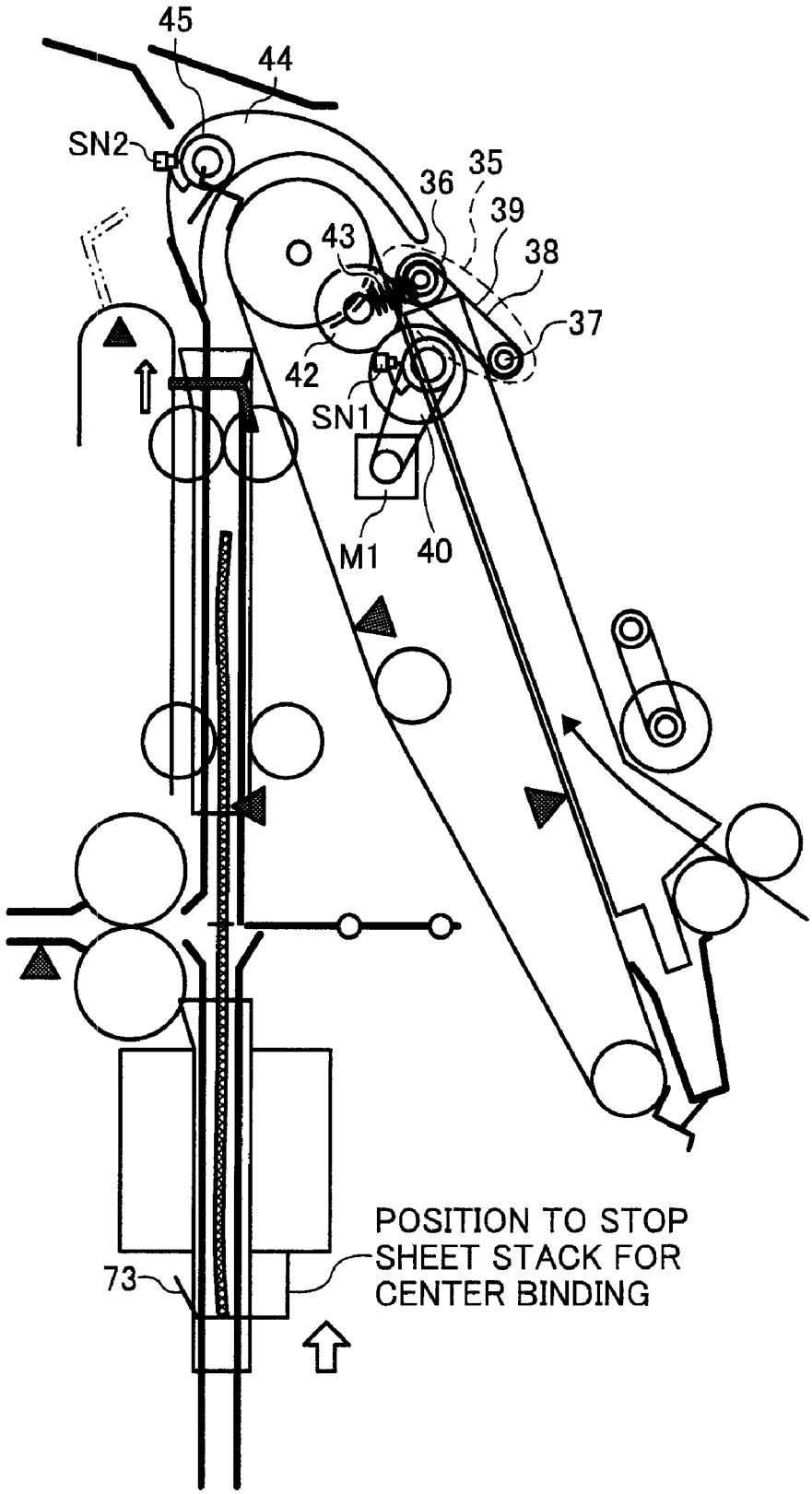
FIG. 35 is a drawing showing another example of action of the folding processing tray of FIG. 29.
Figure 36:
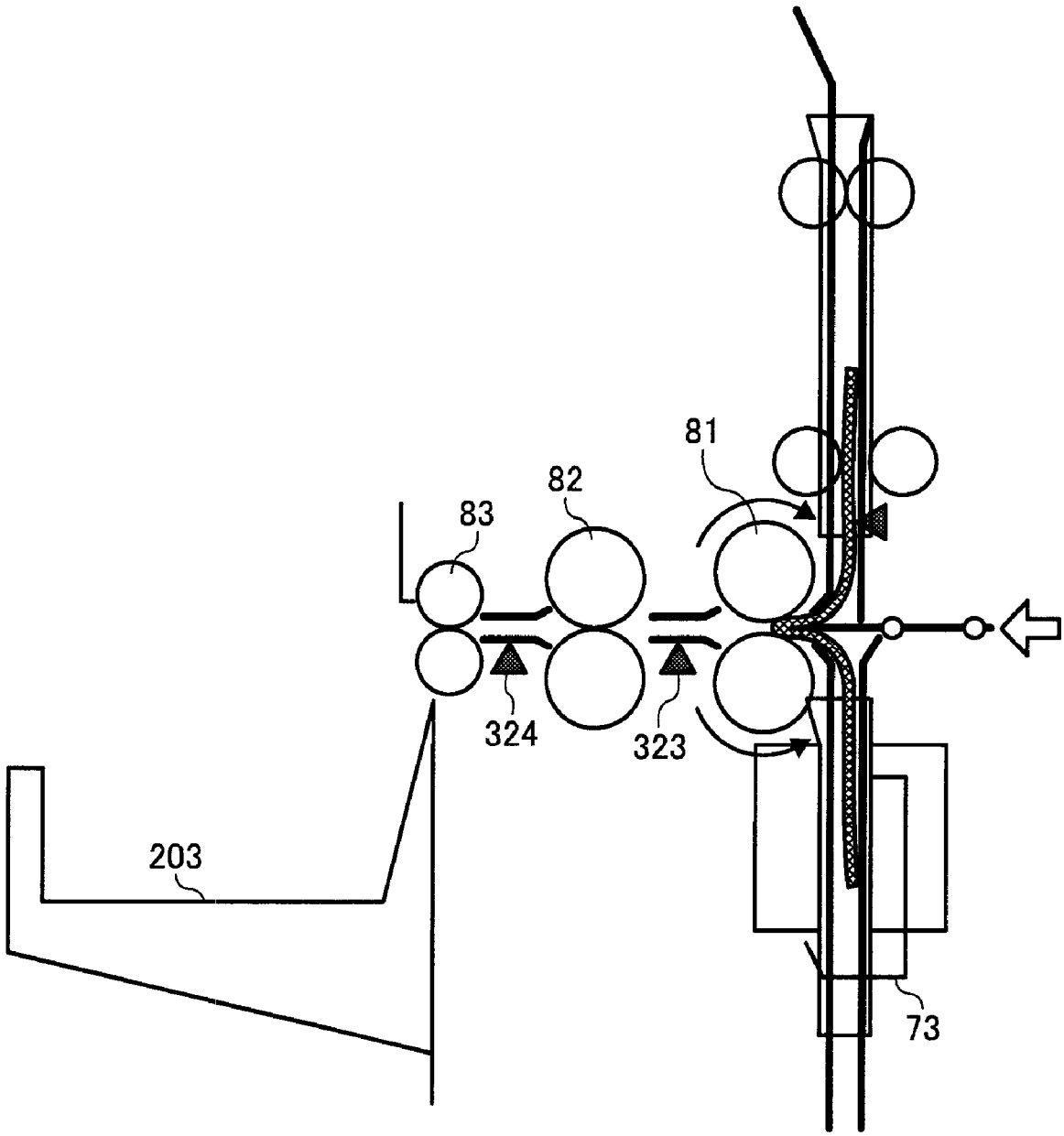
FIG. 36 is a drawing showing another example of action of the folding processing tray of FIG. 29.

As shown in FIG. 35, the center bound sheet stack S may be conveyed in the upward direction with the pressure of the lower stack conveying rollers 72 being released, to a position at which the center folding position corresponds to the folding plate 74. Then, as shown in FIG. 36, the folding plate 74 may push a position in the vicinity of the stapled face of the sheet stack S in a direction substantially perpendicular to the sheet travel direction, which is a moving direction of the folding plate 74. The sheet stack S may then be conveyed to a nip portion of the pair of folding rollers 81 disposed opposite to the folding plate 74 in the moving direction of the folding plate 74.

The pair of folding rollers 81 that is previously rotated may hold the sheet stack at the nip and convey the sheet stack with the pressure applied. This may provide a folding at the center of the sheet stack S.

When the sheet stack S with center binding as described above is conveyed in the upward direction for the folding operation, the sheet stack S can surely be moved with the movable trailing end fence 73 only. On the other hand, when the center bound sheet stack S is conveyed in the downward direction, the conveyance of the sheet stack S may need the sheet conveying rollers and the like as well as the movable trailing end fence 73, which may cause the folding processing tray G to have a complex structure.

Figure 37:
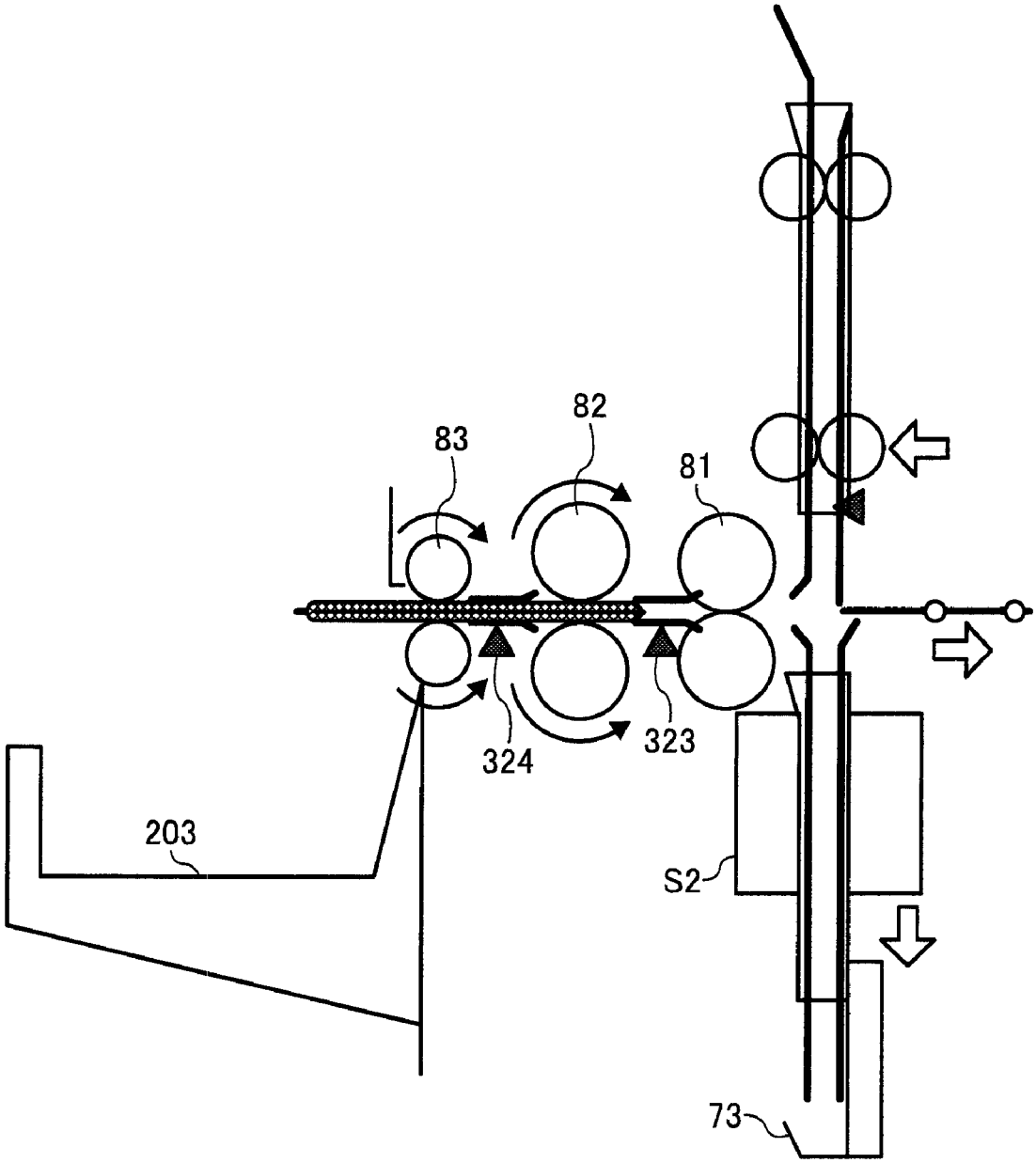
FIG. 37 is a drawing showing another example of action of the folding processing tray of FIG. 29.

As shown in FIG. 37, the sheet stack S with center binding may be more firmly bound by a second pair of folding rollers 82 and be discharged by the pair of sheet discharging rollers 83 to the lower tray 203. When the folding unit passage sensor 323 detects the trailing end of the sheet stack S, the folding plate 74 and the movable trailing end fence 73 may return to the home positions. At the same time, the lower stack conveying rollers 72 may start applying a pressure again. Accordingly, the sheet aligning unit may prepare for a next paper sheet to be conveyed.

When the next job is to process the same number of paper sheets S with the same size as the current job, the movable trailing end fence 73 may move to the position as shown in FIG. 29 to stand by there.

The sheet finishing apparatus PD2 shown in FIG. 6 does not illustrate the second pair of folding rollers 82 shown in FIGS. 36 and 37 because the installation of the second pair of folding rollers 82 may depend on design condition.

(Control Unit)

Reference will be made to FIG. 38 for describing a control system of the entire image processing system included in the illustrative embodiment.

As shown in FIG. 38, the sheet finishing apparatus PD2 of the control system includes the control unit 350 implemented as a microcomputer including a central processing unit (CPU) 360 and an input and output (I/O) interface 370. Signals output from switches and the like arranged on a control panel (not shown) mounted on a main body of the image forming apparatus PR and signals output from various sensors such as the inlet sensor 301, the upper sheet discharge sensor 302, the shift sheet discharging sensor 303, the pre-stack sensor 304, the staple sheet discharge sensor 305, the sheet presence and absence sensor 310, the discharging belt HP sensor 311, the stapler HP sensor 312, the oblique sensor 313, the stack detection sensor 321, the movable trailing end fence HP sensor 322, the folding unit passage sensor 323, the lower sheet discharging sensor 324, the folding plate HP sensor 325, the home position sensor 326, the sheet surface sensors 330, 330*a*, and 330*b*, the sheet discharging guide plate sensor 331, the full sensor 334, the lower limit sensor 335, the shift sensor 336, the sheet surface sensor 505, and the sensors SN1 and SN2 are input to the CPU 360 of the control unit 350 via the I/O interface 370.

The CPU 360 controls, on the basis of the input signals, the tray elevating motor 168 for the shift tray 202, the sheet discharging guide plate motor 167 that opens and closes an opening and closing guide plate, the shift motor 169 that moves the shift tray 202, a knock roller motor (not shown) that drives the tapping (knocking) roller 12, the solenoids such as the knocking solenoid 170, a conveyance motor (not shown) that drives the respective conveying rollers, a sheet discharge motor (not shown) that drives the respective sheet discharging rollers, the discharge motor 157 that drives the discharging belt 52, the stapler moving motor 159 that moves the end face binding stapler S1, the oblique motor 160 that obliquely rotates the end face binding stapler S1, the jogger motor 158 that moves the jogger fences 53, the sheet stack separation motor 161 that swings and drives the turn guide member 44, a sheet stack conveying motor that drives the conveying roller 56 for conveying a sheet stack, a trailing end fence moving motor (not shown) that moves the movable trailing end fence 73, the folding plate driving motor 166 that moves the folding plate 74, a folding roller driving motor (not shown) that drives the pair of folding rollers 81, and the like.

A pulse signal of the staple conveyance motor (not shown) that drives the staple sheet discharging roller is input to the CPU 360 and counted. The knocking solenoid 170 and the jogger motor 158 are controlled according tot this count.

The control of the sheet processing apparatus PD2 is performed by the CPU 360 executing a program stored in a read only memory (ROM) (not shown) using a random access memory (RAM) (not shown) as a work area.

(Sheet Alignment Operations)

The functions of the sheet alignment operations of this example embodiment according to the present invention are basically identical to those of the example embodiment with reference to FIGS. 2 through 4, except that some reference numbers and names of the sheet finishing apparatus PD2 of this example embodiment are different from these of the sheet finishing apparatus PD1 of that example embodiment. Therefore, the sheet alignment operations of this example embodiment are basically described with reference to FIGS. 2 through 4. In the following description, the reference numbers "53*a*" and "53*b*", which are for the first and second jogger fences 53*a* and 53*b* in this example embodiment, correspond to "436*a*" and "436*b*" in FIGS. 2 through 4, and the reference letters "F" and "S1", which are for the end face binding processing tray F and the end face binding stapler S1 in this example embodiment, correspond to "434" and "435" in FIGS. 2 through 4.

When the image forming apparatus PR sends the staple mode signal to staple or bind an end face of the sheet stack S at its far side position, the end face binding stapler S1 and the first and second jogger fences 53*a* and 53*b* of the jogger fences 53 may move in the sheet width direction to a sheet receiving position or the standby position and stand by at the position as shown in FIG. 2.

Under the above-described condition, the paper sheet S may be aligned by the knock roller 12 in the sheet travel direction or the vertical direction and by the first and second jogger fences 53*a* and 53*b* in the sheet width direction or the horizontal direction when the paper sheet S is conveyed to the end face binding processing tray F.

FIGS. 2 through 4 show the actions and states of the jogger fences 53 provided to the sheet finishing apparatus PD2.

As shown in FIG. 2, the first and second jogger fences 53*a* and 53*b* may stay at respective sheet receiving positions before receiving the sheet stack S.

When the sheet stack S is conveyed to the end face binding processing tray F, the first and second jogger fences 53*a* and 53*b* may move from the sheet receiving positions and stop at each given position arranged a given distance away from the sheet width of the sheet stack S, as shown in FIG. 3.

After the above-described movement of the first and second jogger fences 53*a* and 53*b*, the alignment operation of the sheet stack S may start. In the alignment operation, the second jogger fence 53*b*, which is not on the reference side, move to a fixed position and remain stationary thereat as shown in FIG. 4. The first jogger fence 53*a* on the reference side may move toward the second jogger fence 53*b* and push against the side face of the sheet stack S to the second jogger fence 53*b* so that the sheet stack S can be aligned in the sheet width direction. At this time, the first jogger fence 53*a* constantly contacts the side face on the reference side of the sheet stack S. Therefore, the side face on the reference side of the sheet stack S can be preferably aligned regardless of deviation of the paper sheets S in the sheet width direction.

In addition, before the next paper sheet S is conveyed into the end face binding processing tray F, the first and second jogger fences 53*a* and 53*b* may return to the respective sheet receiving positions.

With the above-described alignment operations, the sheet stack S may be aligned in both the sheet width direction and the sheet travel direction, and be stapled at the position in which the sheet stack is aligned.

Then, as previously described, the jogger fence 53*a* may move to press the side surface of the sheet stack S to the jogger fence 53*b* so that the sheet stack S may move in the sheet width direction or horizontal direction with respect to a sheet receiving and discharging position. Therefore, the end face binding stapler S1 may stay at a given standby position for the stapling operation by accounting for the amount of movement. Thereby, the stapling operation can be quickly performed after the sheet alignment operation.

Figure 39A:
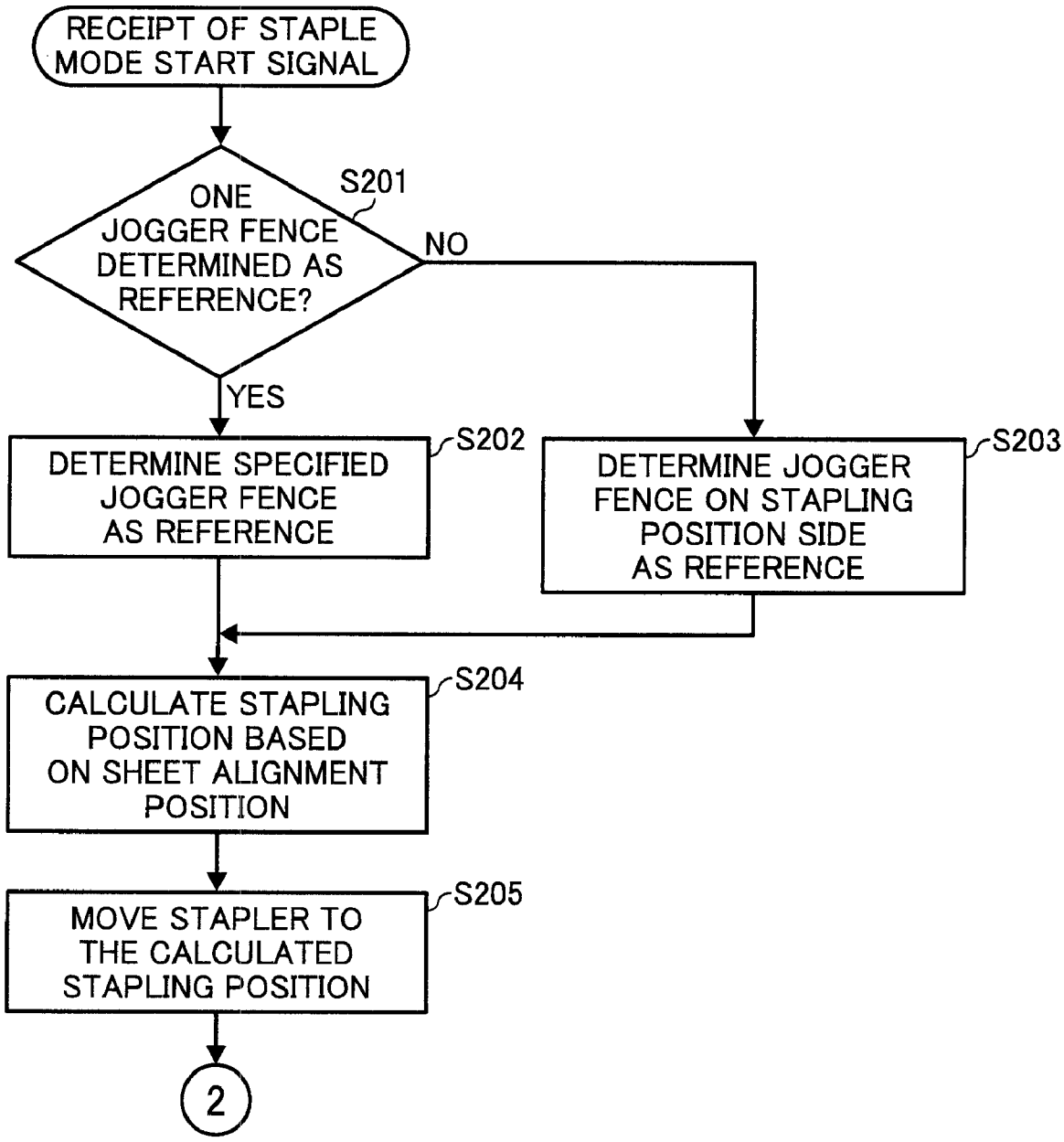
FIG. 39A is a first part of a flowchart showing a procedure of a stapling operation performed by the sheet finishing apparatus of FIG. 6 according to an example embodiment of the present invention.
Figure 39B:
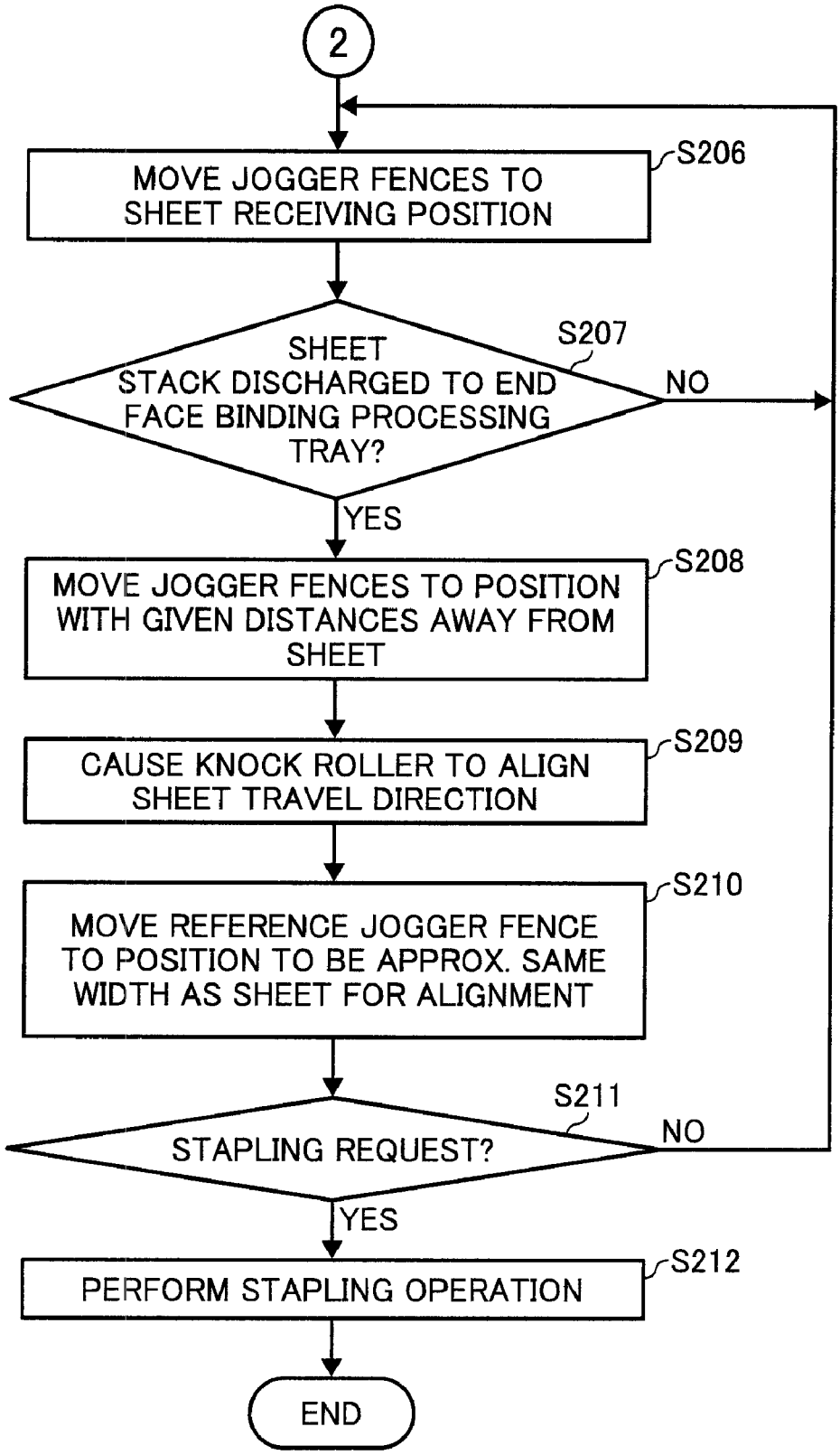
FIG. 39B is a second part of the flowchart following FIG. 39A.

Referring to FIGS. 39A and 39B, two parts of a flowchart showing a procedure of stapling operation are described according to this example embodiment of the present invention.

In the flowchart of FIG. 39A, on receiving a staple mode start signal, the CPU 360 checks whether either one of the first and second jogger fences 53*a* and 53*b* of the jogger fences 53 is specified as a jogger fence on a reference side in step S201.

When one of the first and second jogger fences 53*a* and 53*b* is specified as a jogger fence on a reference side, the result of step S201 is YES, and the specified jogger fence is determined to be a reference jogger fence in S202.

When none of the first and second jogger fences 53*a* and 53*b* is specified as a jogger fence on a reference side, the result of step S201 is NO, and either jogger fence disposed closer to the stapler side is determined to be a reference jogger fence in step S203.

In step S204, the CPU 360 calculates the stapling position based on the position of sheet stack S in the sheet width direction after the sheet alignment operation.

In step S205, the CPU 360 moves the end face binding stapler S1 to the calculated stapling position obtained in step S204.

In the flowchart of FIG. 39B, the first and second jogger fences 53*a* and 53*b* may move to the sheet receiving position in step S206, as shown in FIG. 2, and the paper sheets S are discharged to the end face binding processing tray F in step S207. Then, the CPU 360 causes the first and second jogger fences 53*a* and 53*b* to move to respective given positions arranged a given distance away from the width sheet of the sheet stack S in step S208, as shown in FIG. 3.

The knock roller 12 may align the paper sheets S in the sheet travel direction or vertical direction in step S209.

The CPU 360 causes the first jogger fence 53*a* serving as the reference jogger fence to move to the position at which the distance between the first and second jogger fences 53*a* and 53*b* can form a substantially sheet width direction so as to align the paper sheets S in the sheet width direction in step S210.

In step S211, the CPU 360 checks whether a request of stapling is sent or paper sheets S for one sheet stack SS are discharged and aligned.

When the request of stapling is sent, the result of step S211 is YES, the CPU 360 executes the end face binding operation in step S212.

When the request of stapling is not sent, the result of step S211 is NO, the procedure goes back to step S206 so that the CPU 360 can execute the receipt of a next paper sheet S and repeat operations after S206.

After the end face binding operation in step S212, the CPU 360 causes the hook 52*a* to convey and discharge the bound or stapled sheet stack S.

The hook 52*a* may be generally disposed at a substantially center portion of the sheet receiving and discharging position in the sheet width direction. Since the alignment position of the jogger fences 53 shown in the flowchart of FIGS. 39A and 39B varies in the sheet width direction with respect to the sheet receiving and discharging position. Therefore, the bound or stapled sheet stack S may be easily discharged from the position in an oblique manner. Accordingly, this can cause an insufficient sheet discharging operation, an insufficient sheet storage or accumulation, and so forth can be caused.

To avoid the above-described defects, in this example embodiment of the present invention, the sheet stack S may be bound or stapled, then be returned to a position in the vicinity of the sheet receiving and discharging position in the sheet width direction, and be discharged.

Figure 40:
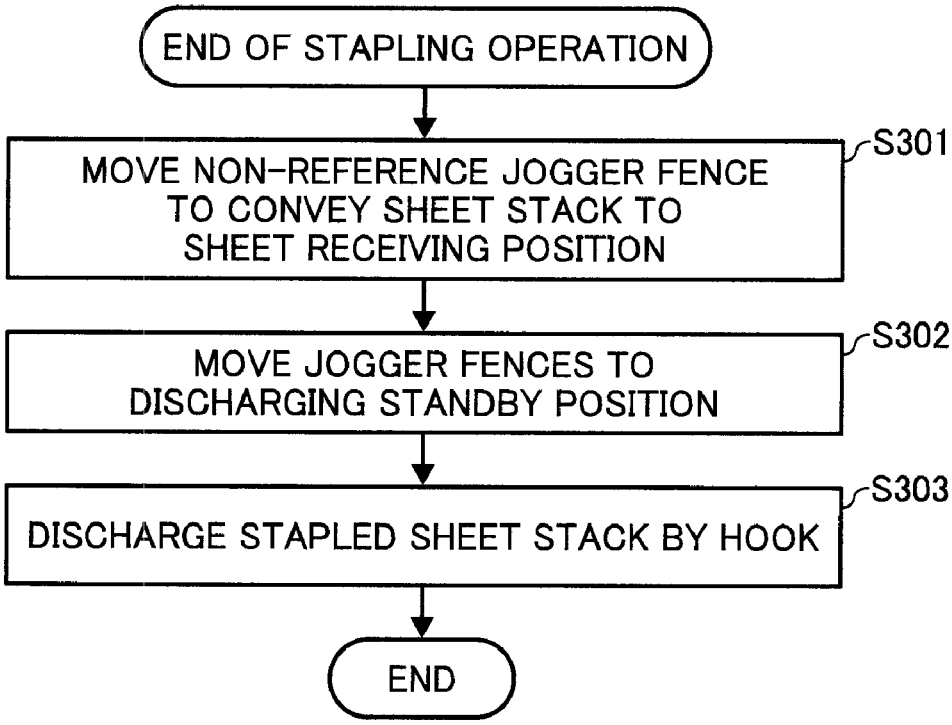
FIG. 40 is a flowchart showing a procedure of an operation after the stapling operation according to an example embodiment of the present invention.

Referring to FIG. 40, a flowchart showing procedures of the above-described operation is described.

In FIG. 40, after the completion of the stapling operation, the non-reference jogger fence, i.e., the second jogger fence 53*b* may be moved to move the sheet stack S back to the sheet receiving position in the sheet width direction or horizontal direction in step S301. Then, the CPU 360 causes the first and second jogger fences 53*a* and 53*b* to move to the discharging standby position in step S302, and the hook 52*a* to help discharge the sheet stack S by lifting the stapled sheet stack in step S303.

Figure 41:
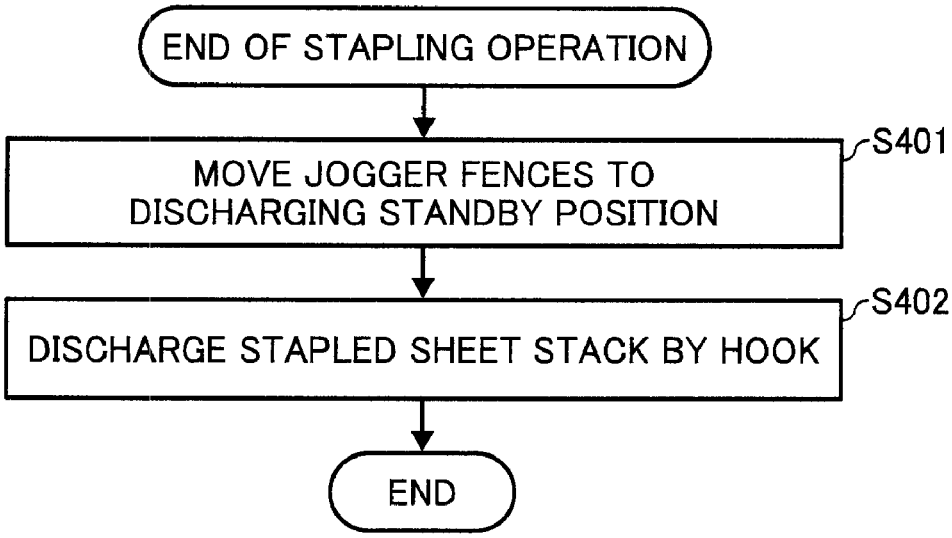
FIG. 41 is a flowchart showing a procedure of another operation after the stapling operation according to an example embodiment of the present invention.

Referring to FIG. 41, a flowchart showing another procedures of a flowchart describing after step S212 of the flowchart of FIG. 39 is described.

According to different shapes of the hook 52*a* and the first and second jogger fences 53*a* and 53*b* and different control of the sheet discharging operations, there may be no insufficient sheet discharging operations, insufficient sheet storage or accumulation, and/or so forth when a stapled sheet stack S is discharged at the position for stapling the sheet stack S in the sheet width direction. In such a case, the sheet discharging operation can be completed earlier if the sheet stack is discharged from the stapling position at which the stapling operation was performed in step S212 of FIG. 39. Accordingly, the next paper sheet S can be received earlier, which can facilitate productivity or increase an amount of productions.

Detailed steps are described below.

After the completion of the stapling operation in the flowchart of FIG. 41, the CPU 360 may cause the first and second jogger fences 53*a* and 53*b* to move to the discharging standby position in step S401.

The CPU 360 may then cause the first and second jogger fences 53*a* and 53*b* to stay at which the sheet stapling or discharging operation has been completed and causes the hook 52*a* to move and push the stapled sheet stack up to discharge, in step S402.

Thus, the discharging operation described in the flowchart shown in FIG. 40 can provide high reliability and the discharging operation described in the flowchart shown in FIG. 41 can provide high productivity. Specifically, when the alignment, binding, and discharging operations can be timely executed for the receipt of the conveyed paper sheet, the discharging operation shown in the flowchart of FIG. 40 may be executed to increase the reliability. On the other hand, when the alignment, binding, and discharging operations cannot be timely executed with the discharging operation shown in the flowchart of FIG. 40, the discharging operation shown in the flowchart of FIG. 41 may be executed to increase the productivity.

The decision that the above-described operations can be timely performed may be made according to the conditions of the sheet stack S to be stapled or bound. That is, as previously described, when the prestacking portion E is arranged at the upstream side of the position at which the sheet alignment operation is executed and the prestacking operation can be performed, as the number of paper sheets S to be bound is large, the number of paper sheets S to be accumulated to the prestacking portion E becomes greater. This condition can save the processing time. On the contrary, when the number of paper sheets S to be bound is small, the processing time may be insufficient and the discharging operation cannot sufficiently be processed.

When paper sheets S are conveyed from the image forming apparatus PR, the savable processing time until the receipt of next paper sheet S may vary depending on the number to be bound, the size of paper sheet, speed to be conveyed, interval between paper sheets, type of paper sheet, and combinations of the above-described parameters. This may be based on the sheet conveyance specification of an image forming apparatus.

In addition, different conditions of the conveyed paper sheet S may vary in specifications of alignment, stapling, and discharging operations and/or specification of the number of stacking paper sheets S in the prestacking portion E. This can cause conditions for sufficient processing and conditions for insufficient processing. There, according to these conditions, the CPU 360 may determine whether the alignment, stapling, and discharging operations can be sufficiently processed. When the operations are sufficiently processed, the CPU 360 may execute the procedure shown in the flowchart of FIG. 40. When the operations cannot be sufficiently processed, the CPU 360 may execute the procedure shown in the flowchart of FIG. 41.

Figure 42:
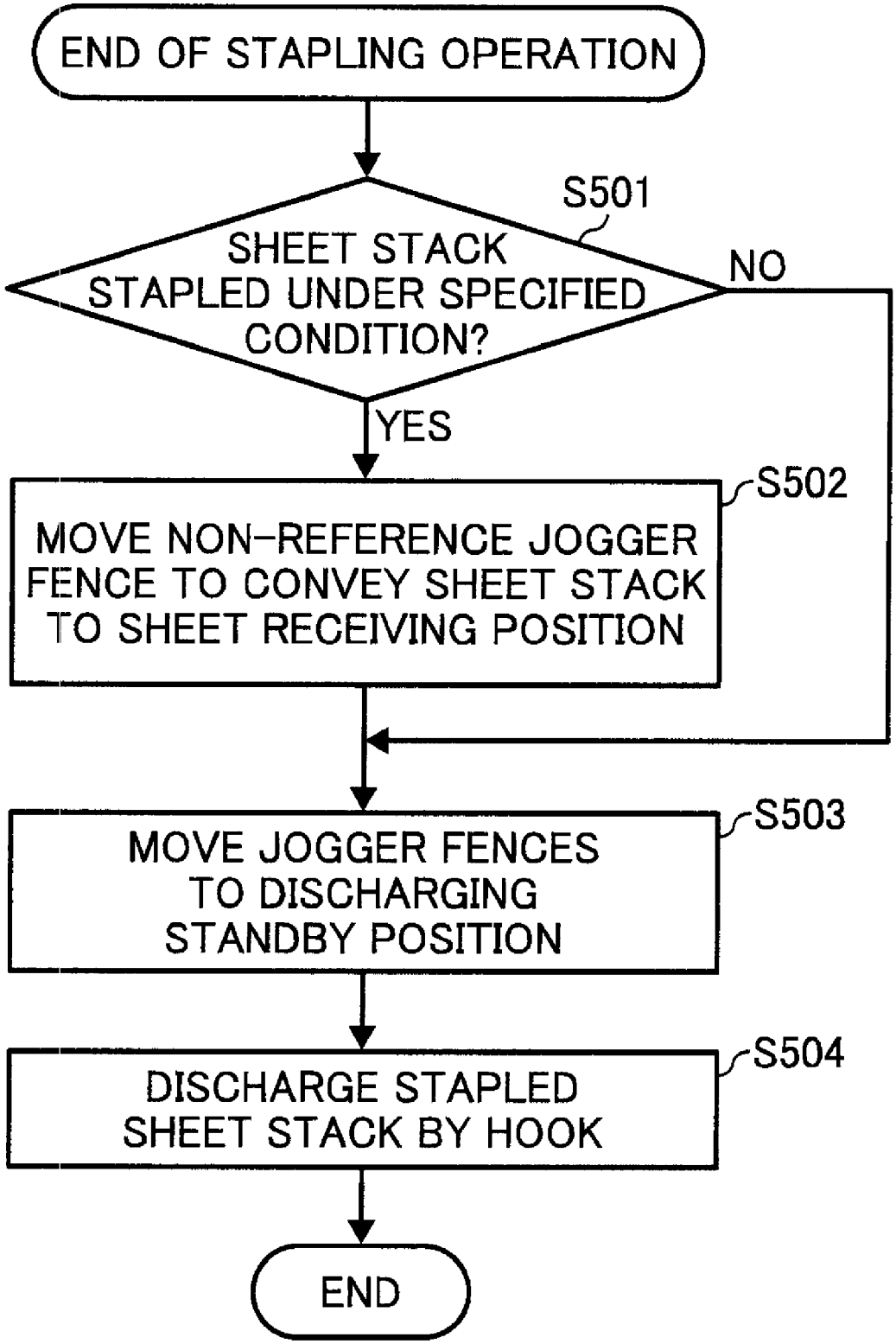
FIG. 42 is a flowchart showing a procedure of another operation after the stapling operation according to an example embodiment of the present invention.

Referring to FIG. 42, a flowchart showing detailed descriptions of the above-described operations is described.

In FIG. 42, when the stapling operation completes, the CPU 360 checks whether the stapled sheet stack S satisfies the specified condition or the condition that can sufficiently process the stapled sheet stack in step S501.

When the stapled sheet stack S satisfies the specified condition, the result of step S501 is YES, and the non-reference jogger fence, i.e., the second jogger fence 53*b* may be moved to move the sheet stack S back to the sheet receiving position in the sheet width direction or horizontal direction in step S502. Then, the CPU 360 causes the first and second jogger fences 53*a* and 53*b* to move to the discharge standby position in step S503.

When the stapled sheet stack S does not satisfy the specified condition, the result of step S501 is NO, and the procedure proceeds to step S503 so as to move the first and second jogger fences 53*a* and 53*b* to the discharging standby position. Then, the CPU 360 causes the hook 52*a* to discharge the sheet stack S from the end face binding processing tray F in step S504.

According to this example embodiment, the following advantages can effectively be achieved.

(1) The jogger fences 53 are arranged at both ends in the width direction of a paper sheet S. One of the jogger fences 53 serves as a reference jogger fence that may slide in the sheet width direction. The other of the jogger fences 53 serves as a stopping jogger fence that may move to a fixed position to stop the sheet stack S pushed by the reference jogger fence. When the reference jogger fence slidably moves toward the stopping jogger fence, the side face of the sheet stack may be pushed by the reference jogger fence and be stopped and received by the stopping jogger fence. This may align the sheet stack S in the sheet width direction. After the alignment of the sheet stack S in the sheet width direction has been completed, the aligned sheet stack S may be bound or stapled at the alignment position in the sheet width direction. Accordingly, the stapling operation can be quickly executed after the sheet alignment.

(2) After the end face binding stapler S1 has executed the stapling operation, the jogger fences 53 may move the stapled sheet stack S in the sheet width direction to the position in the vicinity of the sheet receiving position or the discharging standby position, so as to discharge from the end face binding processing tray F. Therefore, the hook 52*a* may be arranged at a substantially center portion of the sheet stack S to surely discharge the stapled sheet stack S. Accordingly, a sheet discharging failure can be avoided.

(3) After the stapling operation, the stapled sheet stack S may be discharged at the position aligned in the sheet width direction from the end face binding processing tray F. Therefore, the discharge of the stapled sheet stack S can be quickly conducted.

(4) Before the discharge of the stapled sheet stack S, it is determined whether the stapled sheet stack S is returned to the center position according to the conditions of the stapled sheet stack S. Therefore, according to the conditions, the sheet stack S can be smoothly discharged and the discharging operation of the stapled sheet stack S can be efficiently processed.

It is noted that the basic structure and functions of a sheet finishing apparatus according to another example embodiment of the present invention are basically identical to the sheet finishing apparatus PD2. Accordingly, detailed descriptions of components, structure, and functions of the sheet finishing apparatus according to this example embodiment of the present invention will be omitted. Further, in the following description, the reference numbers of the components according to that example embodiment are applied to the reference numbers of the corresponding components according to this example embodiment.

In this example embodiment, the sheet stack S may be aligned then stapled. In that case, the first jogger fence 53*a* may move to push the side surface of the sheet stack in the sheet width direction to abut against the second jogger fence 53*b* that remains stationary at the sheet receiving position. After the sheet alignment operation, the sheet stack S may be bound or stapled at the alignment position where the sheet stack S was aligned. With the above-described action, the side face of the sheet stack S, which is the side face pushed by the reference jogger fence, can be effectively aligned for stapling the sheet stack S. The stapled sheet stack S may be conveyed by the hook 52*a* that is arranged at the substantially center portion of the sheet receiving position in the sheet width direction. The above-described alignment position has been moved in the sheet width direction with respect to the sheet receiving position. That is, the stapled sheet stack S is held off the sheet receiving position. In a case in which the sheet stack S is discharged from the current position that is off the sheet receiving position in the sheet width direction, the hook 52*a* cannot hold or support the center portion of the sheet stack and the sheet stack S may easily lean or slant to one side in an oblique manner. This can cause an insufficient sheet discharging operation, an insufficient sheet storage or accumulation, and so forth. Therefore, after the stapling operation, the sheet stack S may be moved to the sheet receiving position arranged at the center portion, then discharged, as shown in the flowchart of FIG. 42. However, a given period of time may be taken for the above-described movement of the sheet stack S, which may lower the level of productivity.

That is, when the prestacking portion E is arranged at the upstream side of the position at which the sheet alignment operation is executed, as the number of paper sheets S to be bound is large, the number of paper sheets S to be accumulated to the prestacking portion E becomes greater. On the contrary, when the number of paper sheets S to be bound is small, the processing time may be insufficient and the discharging operation cannot sufficiently be processed.

In this example embodiment, only the alignment operation performed immediately before the stapling operation may be executed by moving the first and second jogger fences 53*a* and 53*b* inwardly by the same amount of distance. At this time, since the sheet stack S stays at the sheet receiving position (at the center portion thereof), the discharging operation can be executed immediately after the stapling operation of the sheet stack S. With the above-described action, the period of time for the movement of the sheet stack can be reduced or avoided, if possible, so as to enhance the productivity.

When paper sheets S are conveyed from the image forming apparatus PR, the savable processing time until the receipt of next paper sheet S may vary depending on the number to be bound, the size of paper sheet, speed to be conveyed, interval between paper sheets, type of paper sheet, and combinations of the above-described parameters. This may be based on the sheet conveyance specification of an image forming apparatus.

In addition, different conditions of the conveyed paper sheet S may vary in specifications of alignment, stapling, and discharging operations and/or specification of the number of stacking paper sheets S in the prestacking portion E. This can cause conditions for sufficient processing and conditions for insufficient processing. There, according to these conditions, the CPU 360 may determine whether the alignment, stapling, and discharging operations can be sufficiently processed. When the operations are sufficiently processed, the CPU 360 may execute the procedure shown in the flowchart of FIG. 40. When the operations cannot be sufficiently processed, the CPU 360 may execute the procedure shown in the flowchart of FIG. 41.

Figure 43A:
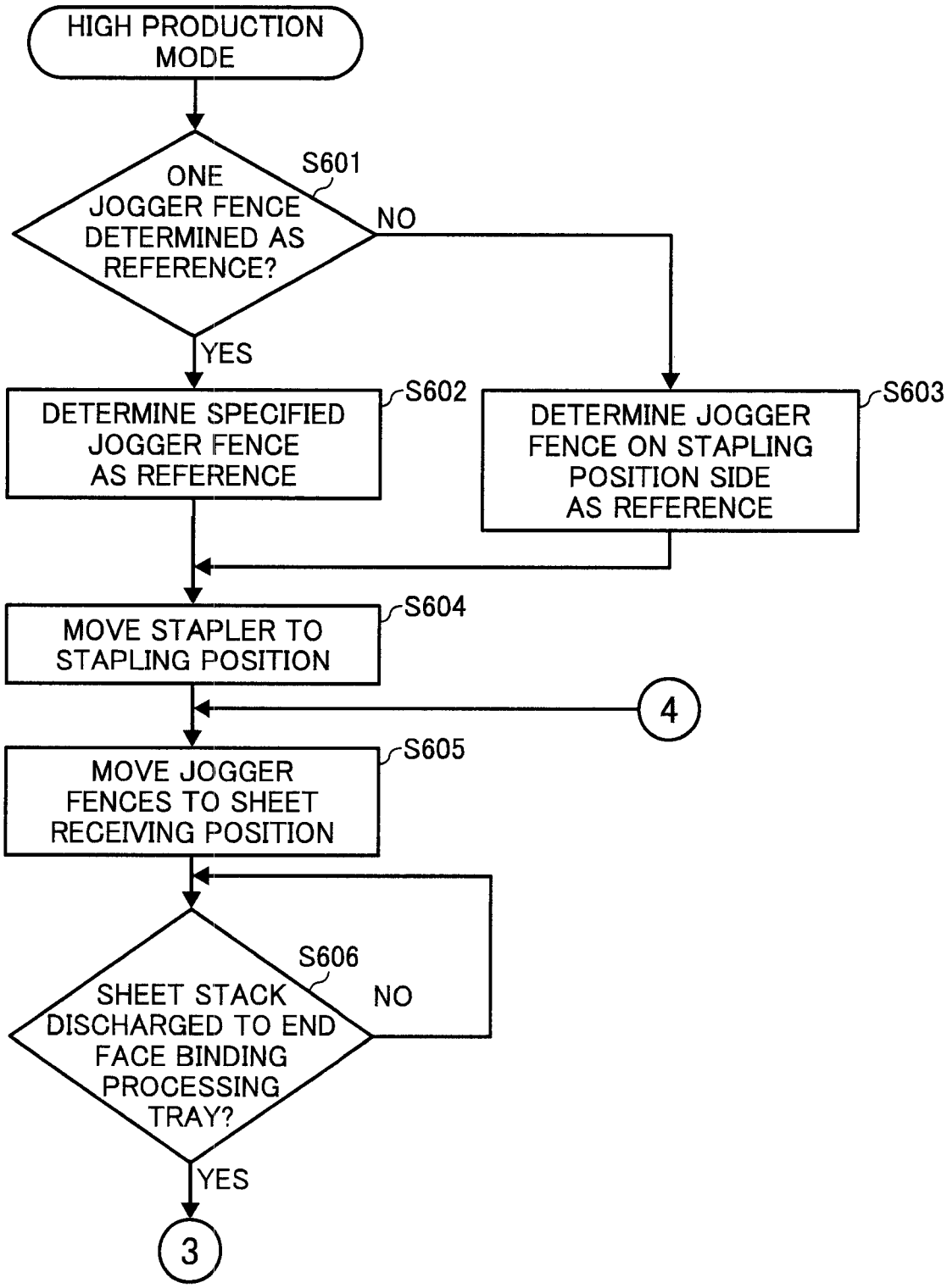
FIG. 43A is a first part of a flowchart showing a procedure in a high production mode according to a third example embodiment of the present invention.
Figure 43B:
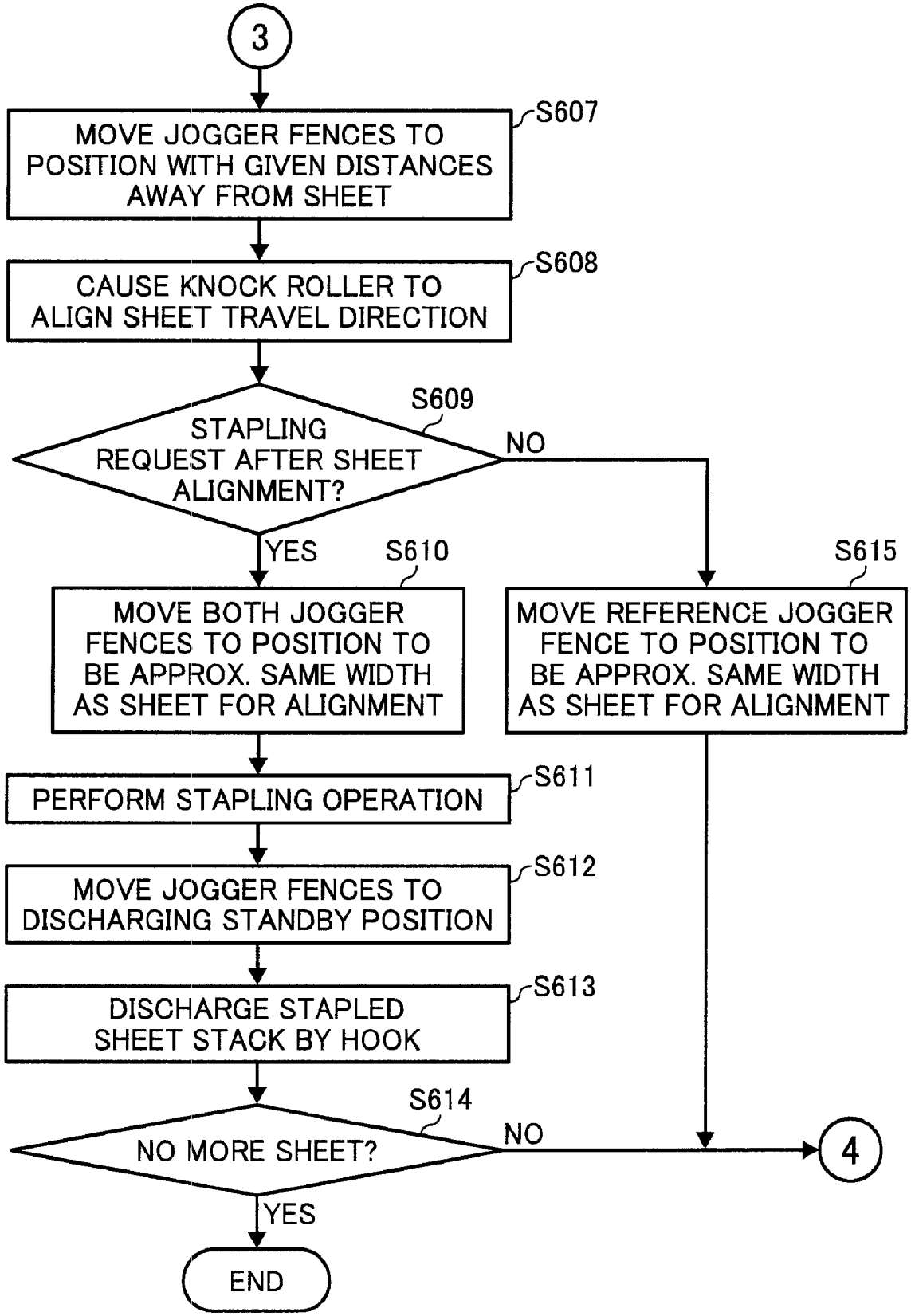
FIG. 43B is a second part of the flowchart following FIG. 43A.

Referring to FIGS. 43A and 43B, two parts of a flowchart showing a procedure of the stapling operation in a high production mode according to this example embodiment of the present invention is described.

The operations and basic controls in this example embodiment are basically identical to the operations and basic controls in the example embodiment corresponding to FIG. 6, etc.

In the flowchart of FIGS. 43A and 43B, when the image forming apparatus PR is set to the high production mode, the CPU 360 checks whether either one of the first and second jogger fences 53*a* and 53*b* of the jogger fences 53 of the jogger fences 53 is specified as a jogger fence on a reference side in step S601.

When one of the first and second jogger fences 53*a* and 53*b* is specified as a jogger fence on a reference side, the result of step S601 is YES, and the specified jogger fence is determined to be a reference jogger fence in S602.

When none of the first and second jogger fences 53*a* and 53*b* is specified as a jogger fence on a reference side, the result of step S601 is NO, and either jogger fence disposed closer to the stapler side is determined to be a reference jogger fence in step S603.

Then, in step S604, the CPU 360 causes the end face binding stapler S1 to move to the stapling position previously set, according to the sheet size.

The CPU 360 may then cause the first and second jogger fences 53*a* and 53*b* to move to the sheet receiving position (see FIG. 2) in step S605, and the sheet stack S to be discharged to the end face binding processing tray F in step S606. Then, the CPU 360 may cause the first and second jogger fences 53*a* and 53*b* to move to respective given positions arranged a given distance away from the width of the sheet stack S in step S607, as shown in FIG. 3, the knock roller 12 to align the paper sheets S in the sheet travel direction or vertical direction in step S608, and determines whether a request of the stapling operation after the sheet alignment of the sheet stack S is sent or not in step S609.

When the request of the stapling operation is sent, the result of step S609 is YES, the CPU 360 causes the first and second jogger fences 53*a* and 53*b* to move to the position at which the distance between the first and second jogger fences 53*a* and 53*b* can form a substantially sheet width direction so as to align the paper sheets S in the sheet width direction in step S610.

The CPU 360 then executes the end face binding operation in step S611, causes the first and second jogger fences 53*a* and 53*b* to move to the discharging standby position in step S612, and the hook 52*a* to help discharge the sheet stack S by lifting the stapled sheet stack S in step S613.

The CPU 360 then checks whether there is no more paper sheet in step S614.

When there is no more paper sheet, the result of step S614 is YES, and the CPU 360 completes the stapling operation.

When there is another paper sheet, the result of step S614 is NO, and the process goes back to step S605 to repeat the operation from and after step S605.

When the request of the stapling operation is not sent, the result of step S609 is NO, the CPU 360 causes the reference jogger fence, i.e., the first jogger fence 53*a* to move to the position at which the distance between the first and second jogger fences 53*a* and 53*b* can form a substantially sheet width direction so as to align the paper sheets S in the sheet width direction in step S615. Then, the process goes back to step S605 to repeat the operation from and after step S605.

The above-described operations according to the flowchart of FIGS. 43A and 43B can increase the processing speed of the procedure from the stapling operation to the discharging operation. However, in the alignment operation immediately before the stapling operation, the CPU 360 may execute the stapling operation by moving the first and second jogger fences 53*a* and 53*b* inwardly by the same amount of distance. This cannot guarantee the preferable alignment of a sheet stack S on the reference side.

Figure 44:
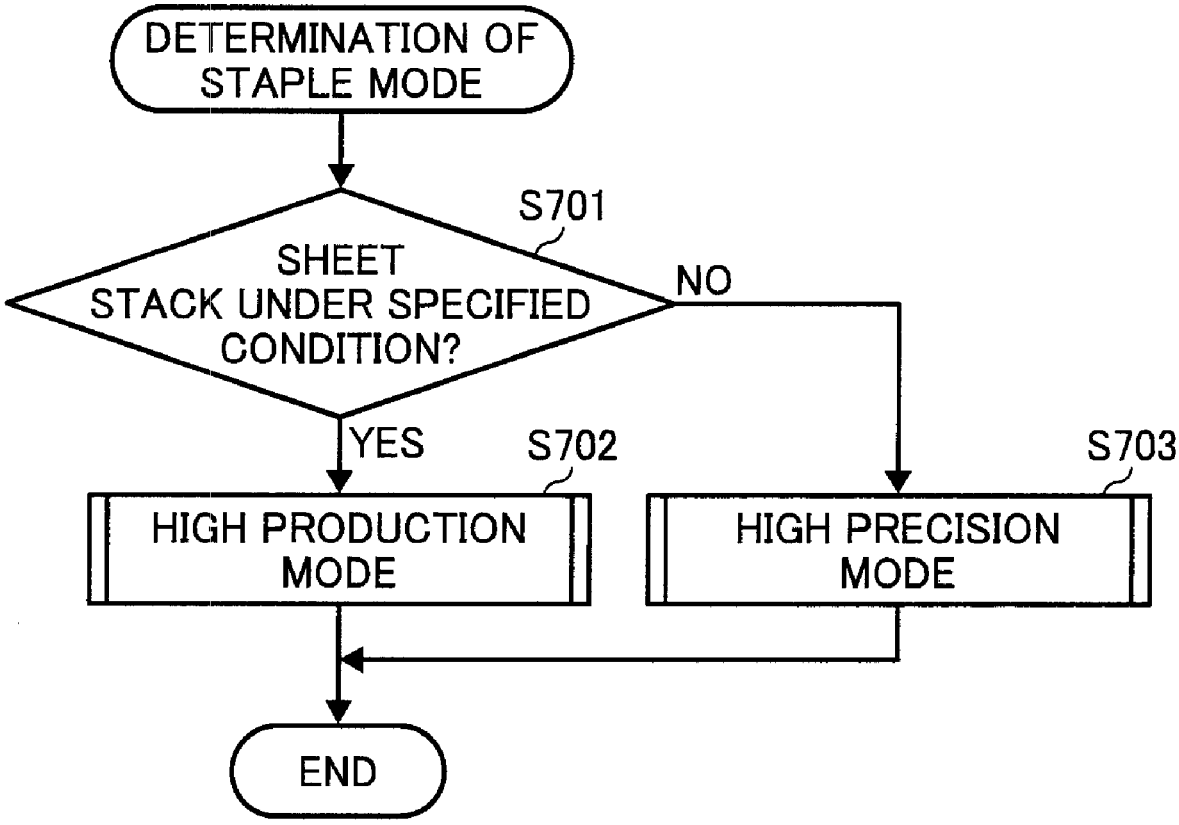
FIG. 44 is a flowchart showing a procedure of determining a stapling mode.
Figure 45A:
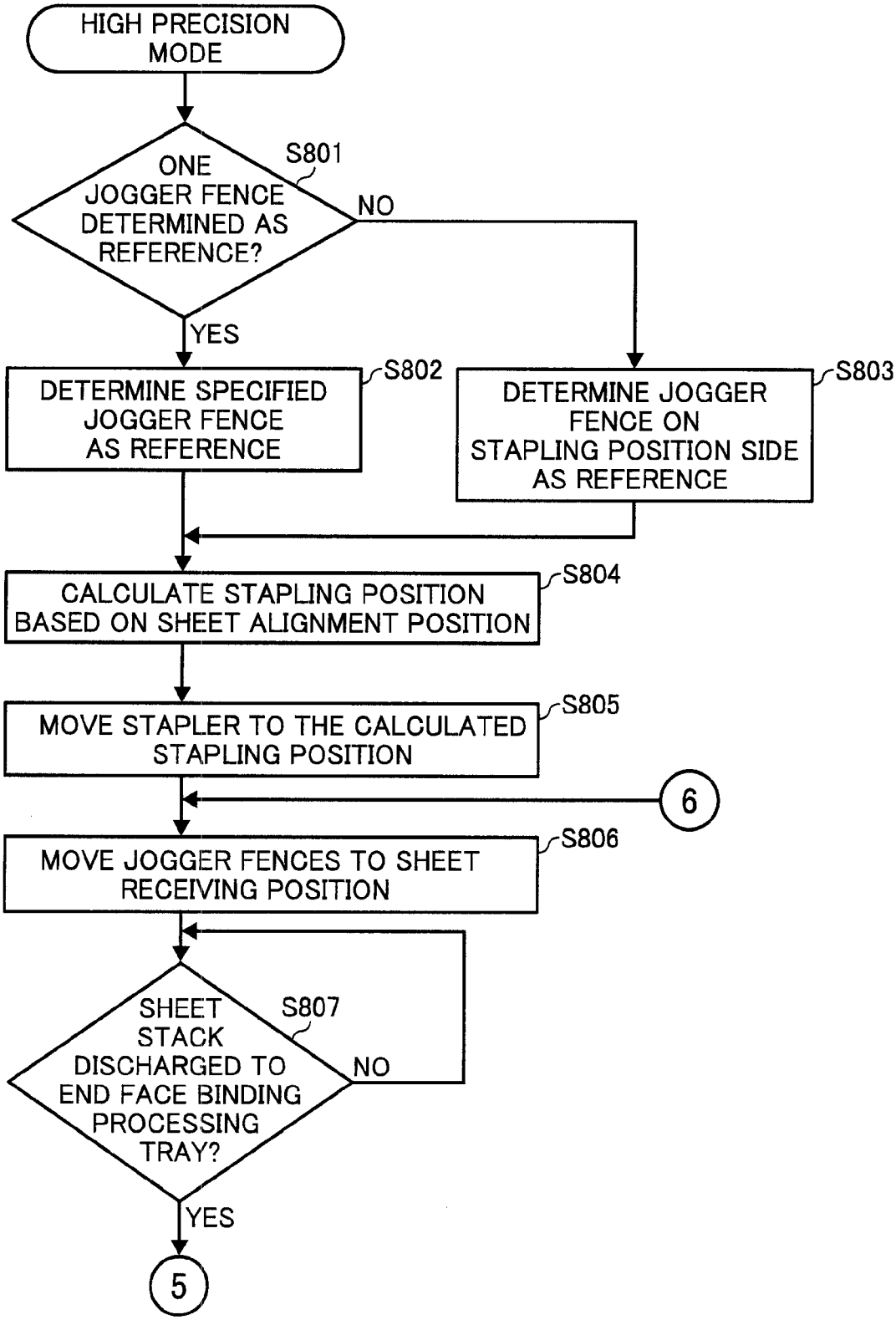
FIG. 45A is a first part of a flowchart showing a procedure in a high precision mode.
Figure 45B:
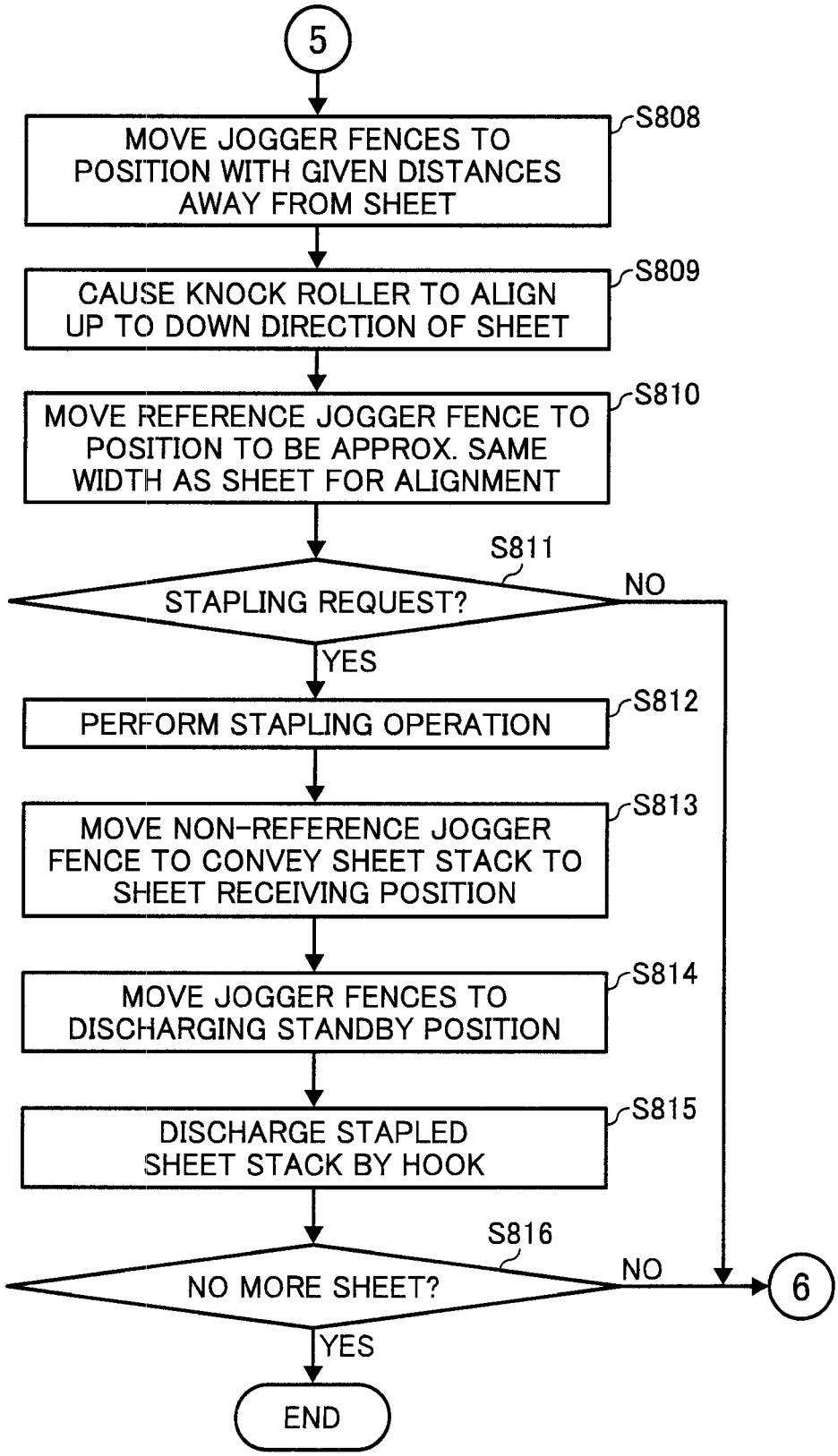
FIG. 45B is a second part of the flowchart following FIG. 45A.

Referring to FIGS. 44, 45A, and 45B, flowcharts showing procedures regarding stapling modes are described. The flowchart of FIG. 44 shows a procedure of determination of a stapling mode, and the flowchart of FIGS. 45A and 45B show procedures of a high precision mode, which includes subroutines of step S703.

In the flowchart of FIG. 44, the CPU 360 checks whether the sheet stack S satisfies the specified conditions or the condition that sufficient alignment, stapling, and discharging operations can be performed when receiving a next paper sheets in step S701.

When the sheet stack S satisfies the specified conditions, the result of step S701 is YES, and operations having emphasis on productivity may be performed in step S702.

When the sheet stack S does not satisfy the specified conditions, the result of step S701 is NO, and operations having emphasis on precision or a high precision mode shown in FIG. 45 may be performed in step S703.

In the flowchart showing two parts in FIGS. 45A and 45B, the CPU 360 checks whether either one of the first and second jogger fences 53*a* and 53*b* of the jogger fences 53 is specified as a jogger fence on a reference side in step S801.

When one of the first and second jogger fences 53*a* and 53*b* is specified as a jogger fence on a reference side, the result of step S801 is YES, and the specified jogger fence is determined to be a reference jogger fence in S802.

When none of the first and second jogger fences 53*a* and 53*b* is specified as a jogger fence on a reference side, the result of step S801 is NO, and either jogger fence disposed closer to the stapler side is determined to be a reference jogger fence in step S803.

In step S804, the CPU 360 calculates the stapling position based on the position of sheet stack S in the sheet width direction after the sheet alignment operation.

In step S805, the CPU 360 moves the end face binding stapler S1 to the calculated stapling position obtained in step S804.

The first and second jogger fences 53*a* and 53*b* may move to the sheet receiving position in step S806, as shown in FIG. 2, and the paper sheets S are discharged to the end face binding processing tray F in step S807.

In the flowchart of FIG. 45B, the CPU 360 causes the first and second jogger fences 53*a* and 53*b* to move to respective given positions arranged a given distance away from the width of the sheet stack S in step S808, as shown in FIG. 3.

The knock roller 12 may align the paper sheets S in the sheet travel direction or vertical direction in step S809.

The CPU 360 causes the first jogger fence 53*a* serving as the reference jogger fence to move to the position at which the distance between the first and second jogger fences 53*a* and 53*b* can form a substantially sheet width direction so as to align the paper sheets S in the sheet width direction in step S810.

In step S811, the CPU 360 checks whether a request of stapling is sent or paper sheets S for one sheet stack S are discharged and aligned.

When the request of stapling is sent, the result of step S811 is YES, the CPU 360 executes the end face binding operation in step S812.

When the request of stapling is not sent, the result of step S811 is NO, the procedure goes back to step S806 so that the CPU 360 can execute the receipt of a next paper sheet S and repeat operations after S806.

In the flowchart of FIG. 45B, after the completion of the stapling operation in step S812, the non-reference jogger fence, i.e., the second jogger fence 53*b* may be moved to move the sheet stack S back to the sheet receiving position in the sheet width direction or horizontal direction in step S813. Then, the CPU 360 causes the first and second jogger fences 53*a* and 53*b* to move to the discharging standby position in step S814, and the hook 52*a* to help discharge the sheet stack S by lifting the stapled sheet stack in step S815.

The CPU then checks whether there is no more paper sheet S in step S816. When there is no more paper sheet S, the result of step S816 is YES, and the CPU 360 completes the operation. When there is another paper sheet S, the result of step S816 is NO, and the process goes back to step S809 to repeat the operation from and after step S809.

According to this example embodiment, the following advantages can effectively be achieved.

(1) The first and second jogger fences 53*a* and 53*b* are arranged at both ends in the width direction of a paper sheet S. The first jogger fence 53*a*, which is arranged on the reference side, may serve as a reference jogger fence that may slide in the sheet width direction. The second jogger fence 53*b*, which is arranged on the opposite side, may serve as a stopping jogger fence that may move to a fixed position and remain stationary thereat to stop the sheet stack S pushed by the reference jogger fence. When the first jogger fence 53*a* slidably moves toward the second jogger fence 53*b*, the side face of the sheet stack S may be pushed by the first jogger fence 53*a* and may be stopped and received by the second jogger fence 53*b*. This may align the sheet stack S in the sheet width direction. Only the alignment operation performed immediately before the stapling operation may be executed at the center portion in the sheet width direction at the sheet receiving position. Thereby, high speed productivity can be kept.

(2) When the stapled sheet stack S satisfies the specified conditions, the sheet stack S may be aligned according to the procedures described in the flowchart of FIGS. 43A and 43B. On the other hand, when the stapled sheet stack S does not satisfy the specified conditions, the sheet stack S may be aligned according to the procedures described in the flowchart of FIGS. 45A and 45B. Specifically, in the alignment according to this example embodiment, a reference jogger fence may move and a non-reference jogger fence or a stopping jogger fence may remain stationary at a fixed position. After the completion of the alignment, the sheet stack S may be stapled at the alignment position, then be moved to the center portion in the sheet width direction of the sheet receiving position, and be discharged to the outside of the sheet finishing apparatus. With the above-described operation and structure, the level of accuracy in alignment of paper sheets S can be increased and the level of process productivity can be kept at high speed.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sheet alignment device comprising:

an accommodating unit configured to temporarily accommodate a paper sheet and a paper sheet stack including the paper sheet therein; and a sheet alignment unit configured to align the sheet stack including the paper sheet in a direction perpendicular to a sheet travel direction, the sheet alignment unit having a first alignment member configured to move between a sheet receiving position and a sheet alignment position along the direction perpendicular to the sheet travel direction so as to push the sheet stack and a second alignment member configured to move to a fixed position and remain stationary so as to stop the sheet stack pushed by the first alignment member and the second alignment member returns to the sheet receiving position before the first alignment member moves thereto after the sheet alignment operation.

2. The sheet alignment device according to claim 1, wherein:

the first and second alignment members come to given respective positions in the vicinity of respective side surfaces of the sheet stack in a sheet width direction immediately before a start of the sheet alignment operation.

3. The sheet alignment device according to claim 1, further comprising:

a control unit configured to control to set an arbitrary reference side for the sheet alignment operation, wherein the first alignment member is set to the reference side.

4. The sheet alignment device according to claim 3, wherein:

of the first and second alignment members, that alignment member which is arranged on a stapling side of the sheet stack is set as the reference side unless the control unit specifies the reference side.

5. A sheet finishing apparatus comprising:

a sheet alignment unit including the following, an accommodating unit configured to temporarily accommodate a paper sheet and a paper sheet stack including the paper sheet therein, and a sheet alignment unit configured to align the sheet stack including the paper sheet in a direction perpendicular to a sheet travel direction, the sheet alignment unit having a first alignment member configured to move between a sheet receiving position and a sheet alignment position along the direction perpendicular to the sheet travel direction so as to push the sheet stack and a second alignment member configured to move to a fixed position and remain stationary thereat so as to stop the sheet stack pushed by the first alignment member and the second alignment member returns to the sheet receiving position before the first alignment member moves thereto after the sheet alignment operation; and a sheet binding unit configured to bind the sheet stack of the accommodating unit.

6. The sheet finishing apparatus according to claim 5, wherein the sheet stack is processed at a first position arranged by the first alignment member to be closer to the second alignment member from a center portion of the sheet stack stored in the accommodating unit.

7. The sheet finishing apparatus according to claim 6, wherein:

the sheet binding unit is configured to bind the sheet stack at the first position.

8. The sheet finishing apparatus according to claim 7, further comprising:

a discharging unit configured to discharge the sheet stack bound by the sheet binding unit from the accommodating unit, wherein the first and second alignment members move the bound sheet stack from the first position to a second position in the vicinity of the center portion so that the discharging unit discharges the sheet stack therefrom.

9. The sheet finishing apparatus according to claim 7, further comprising:

a discharging unit configured to discharge the sheet stack bound by the sheet binding unit from the accommodating unit, wherein the bound sheet stack is discharged from the first position.

10. The sheet finishing apparatus according to claim 7, further comprising:

a discharging unit configured to discharge the sheet stack bound by the sheet binding unit from the accommodating unit, wherein the control unit selects, according to a given condition, one of:

a first mode to cause the first and second alignment members to move the bound sheet stack from the first position to a second position in the vicinity of the center portion so that the discharging unit discharges the sheet stack therefrom; and a second mode to discharge the bound sheet stack from the first position.

11. The sheet alignment device according to claim 10, wherein:

the first mode is selected when the sheet stack satisfies the given condition.

12. The sheet alignment device according to claim 10, wherein:

the second mode is selected when the sheet stack does not satisfy the given condition.

13. The sheet finishing apparatus according to claim 6, wherein:

the sheet alignment unit is configured to align the sheet stack at the first position, and the sheet alignment operation immediately before the sheet binding operation is conducted at the center portion of the sheet stack when the sheet binding unit performs the sheet binding operation.

14. The sheet finishing apparatus according to claim 13, further comprising:

a discharging unit configured to discharge the sheet stack bound by the sheet binding unit from the accommodating unit, wherein the bound sheet stack is conveyed from the first position when the sheet stack satisfies a given condition.

15. The sheet finishing apparatus according to claim 14, wherein:

when the sheet stack satisfies the given condition, the sheet stack is aligned and bound by the sheet alignment unit at the first position, is moved by the first and second alignment members from the first position to the second position, and is discharged by the discharging unit.

16. The sheet finishing apparatus according to claim 10, wherein:

the given condition is determined based on at least one of a number of paper sheets to be bound, a size of paper sheet, a speed to be conveyed, an interval between paper sheets, and a type of paper sheet.

17. An image processing system comprising:

an image-forming unit to form images on sheets, respectively; and a sheet alignment device including the following, an accommodating unit configured to receive sheets from the image-forming unit and to temporarily accommodate a paper sheet and a paper sheet stack including the paper sheet therein, and a sheet alignment unit configured to align the sheet stack including the paper sheet in a direction perpendicular to a sheet travel direction, the sheet alignment unit having a first alignment member configured to move between a sheet receiving position and a sheet alignment position along the direction perpendicular to the sheet travel direction so as to push the sheet stack and a second alignment member configured to move to a fixed position and remain thereat so as to stop the sheet stack pushed by the first alignment member and the second alignment member returns to the sheet receiving position before the first alignment member moves thereto after the sheet alignment operation.

18. The image processing system according to claim 17, further comprising:

a sheet finishing apparatus including the sheet alignment device according to claim 18; and a sheet binding unit configured to bind the sheet stack of the accommodating unit;

wherein the sheet stack is processed at a first position arranged by the first alignment member to be closer to the second alignment member from a center portion of the sheet stack stored in the accommodating unit.

19. A sheet alignment device comprising:

an accommodating unit configured to temporarily accommodate a paper sheet and a paper sheet stack including the paper sheet therein; and a sheet alignment unit configured to align the sheet stack including the paper sheet in a direction perpendicular to a sheet travel direction, the sheet alignment unit having first and second alignment members configured to move between a sheet receiving position and a sheet alignment position along the direction perpendicular to the sheet travel direction, wherein one of the alignment members pushes the sheet stack against the other alignment member while the other alignment member remains stationary; and a controller configured to control the first and second alignment members and set either alignment member as a reference jogger, wherein the controller urges the second alignment member to remain stationary while urging the first alignment member to push the sheet stack against the second alignment member when the first alignment member is set as the reference jogger and urges the first alignment member to remain stationary while urging the second alignment member to push the sheet stack against the first alignment member when the second alignment member is set as the reference jogger.

* * * * *